US010578405B1

(12) United States Patent
Campbell

(10) Patent No.: US 10,578,405 B1
(45) **Date of Patent: *Mar. 3, 2020**

(54) SIGHT ADJUSTABLE ROTATING SMART PHONE MOUNT FOR FIREARMS

(71) Applicant: Robert Marshall Campbell, Miami, FL (US)

(72) Inventor: Robert Marshall Campbell, Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/977,581

(22) Filed: May 11, 2018

Related U.S. Application Data

(63) Continuation of application No. 15/398,582, filed on Jan. 4, 2017, now Pat. No. 10,006,742.

(60) Provisional application No. 62/387,779, filed on Jan. 4, 2016, provisional application No. 62/387,781, filed on Jan. 4, 2016, provisional application No. 62/387,782, filed on Jan. 4, 2016, provisional application No. 62/387,783, filed on Jan. 4, 2016.

(51) Int. Cl.

| | |
|---|---|
| ***F41G 1/41*** | (2006.01) |
| ***F41G 11/00*** | (2006.01) |
| ***F41G 1/38*** | (2006.01) |
| ***F41G 1/46*** | (2006.01) |
| ***F41G 1/16*** | (2006.01) |

(52) U.S. Cl.
CPC ..... *F41G 11/003* (2013.01); *F41G 1/16* (2013.01); *F41G 1/38* (2013.01); *F41G 1/46* (2013.01)

(58) Field of Classification Search
CPC ..... F41G 1/00; F41G 1/30; F41G 1/38; F41G 1/387; F41G 1/393; F41G 1/40; F41G 1/41; F41G 11/003
USPC ..... 42/111, 118, 119, 124, 125, 126, 127
See application file for complete search history.

(56) References Cited

U.S. PATENT DOCUMENTS

| | | | | |
|---|---|---|---|---|
| 1,481,294 | A * | 1/1924 | Luellen | F41G 1/30 42/136 |
| 2,685,814 | A * | 8/1954 | Sloan | F41G 1/473 356/17 |
| 3,861,051 | A * | 1/1975 | Killian | F41G 1/467 33/265 |
| 4,084,326 | A * | 4/1978 | Numbers | F41G 1/30 356/254 |
| 7,065,916 | B2 | 6/2006 | Ballard | |
| 7,140,142 | B2 | 11/2006 | Ballard | |
| 7,437,847 | B1 | 10/2008 | Mabry | |

(Continued)

*Primary Examiner* — Bret Hayes
(74) *Attorney, Agent, or Firm* — Malin Haley DiMaggio & Bowne, P.A.

(57) ABSTRACT

Sight adjustable and rotating smart phone mounts for firearms which mount the smart phone and lens on the rail of the firearm behind the sights. The phone mounts rotate, and are vertically and laterally adjustable, and include mirror assemblies. The smart phone and mirror assemblies are secured in precise positions to be in alignment with one another, and the mirror assemblies remain in axial viewing alignment with the firearm sights, and reflect the view to the smart phone camera lens, as the mount is rotated through 180° from side-to-side of the firearm. A shooter views an enlarged target area on the smart phone screen, and most importantly, can view and record the target area from the either side of the firearm standing perpendicular to the firearm rail and barrel. In such position, the shooters can fire around obstacles and building without becoming a target themselves and out of harms way.

3 Claims, 48 Drawing Sheets

(56) References Cited

U.S. PATENT DOCUMENTS

| | | | | |
|---|---|---|---|---|
| 7,552,558 | B1 | 6/2009 | Ballard | |
| 7,614,805 | B2 | 11/2009 | Showalter | |
| 8,091,265 | B1 | 1/2012 | Teetzel et al. | |
| 8,297,173 | B1 | 10/2012 | Teetzel et al. | |
| 8,656,624 | B2 | 2/2014 | Holmberg | |
| 8,793,917 | B2 | 8/2014 | Russell | |
| 8,911,162 | B2 | 12/2014 | Kuehl et al. | |
| 8,971,959 | B2 | 3/2015 | Hunt et al. | |
| 8,978,539 | B2 | 3/2015 | Teetzel et al. | |
| 9,080,839 | B2 | 7/2015 | Arachequesne | |
| 9,151,571 | B2 | 10/2015 | Russell | |
| 10,006,742 | B1 * | 6/2018 | Campbell | F41G 11/003 |
| 2008/0107414 | A1 * | 5/2008 | Showalter | F41G 11/004 396/429 |
| 2011/0035984 | A1 | 2/2011 | Liu | |
| 2013/0344461 | A1 | 12/2013 | Tello | |
| 2014/0215876 | A1 | 8/2014 | Popa-Simil | |
| 2016/0047626 | A1 | 2/2016 | Kremer et al. | |
| 2017/0023332 | A1 * | 1/2017 | Campbell | F41G 1/30 |
| 2017/0030679 | A1 * | 2/2017 | Campbell | F41G 1/30 |
| 2017/0130817 | A1 | 5/2017 | Matsubara | |
| 2017/0142301 | A1 * | 5/2017 | Simmon | F41C 27/00 |
| 2017/0276456 | A1 * | 9/2017 | Campbell | F41G 1/30 |

* cited by examiner

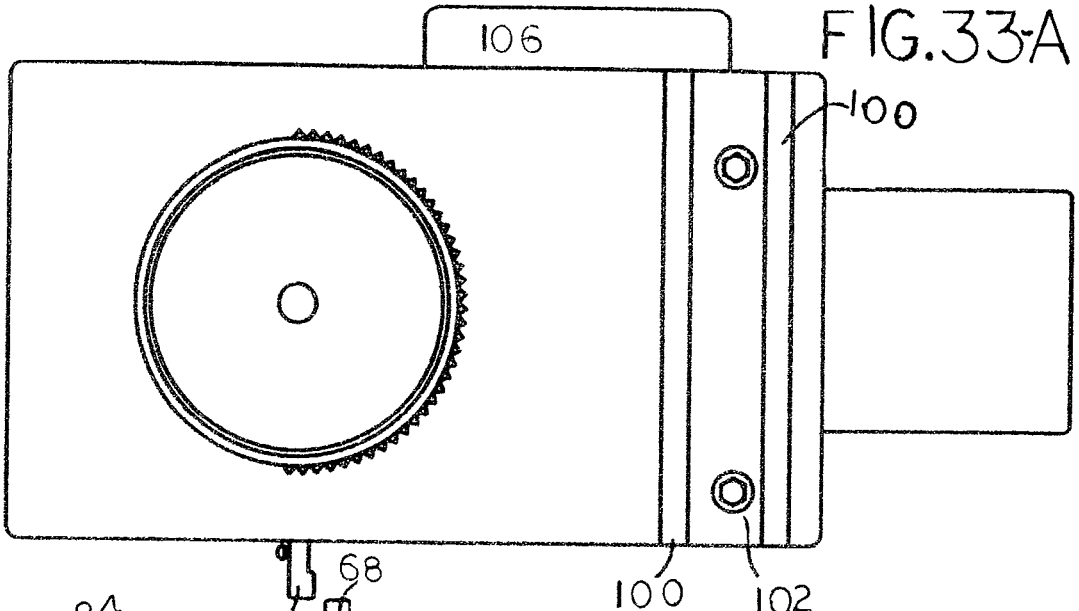
FIG.33-A
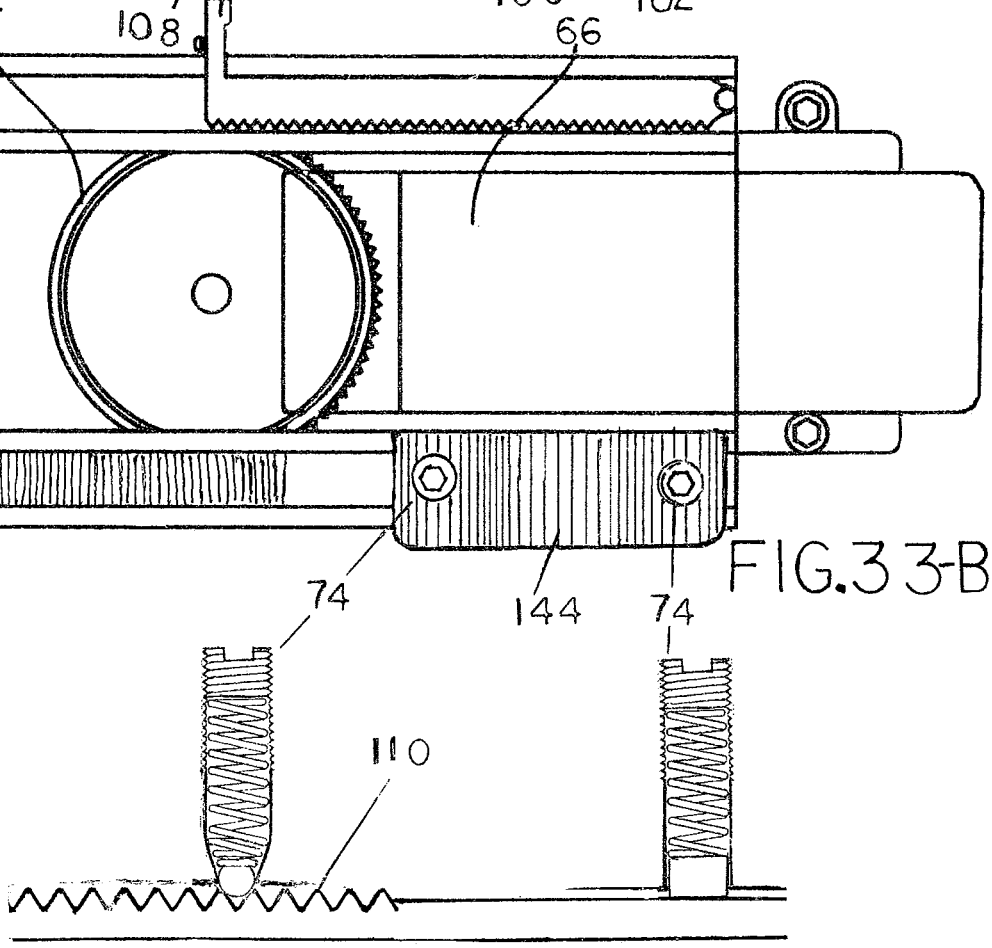
FIG.33-B 66
72
92
90
94
88
144
134
68
156
150
152

SIGHT ADJUSTABLE ROTATING SMART PHONE MOUNT FOR FIREARMS

CROSS REFERENCE TO RELATED APPLICATIONS

This application is a Continuation of U.S. Utility patent application Ser. No. 15/398,582 filed on Jan. 4, 2017, and also claims the benefit of the following: U.S. Provisional Application No. 62/387,779 filed on Jan. 4, 2016; U.S. Provisional Application No. 62/387,781 filed on Jan. 4, 2016; U.S. Provisional Application No. 62/387,782 filed on Jan. 4, 2016; and, U.S. Provisional Application No. 62/387,783 filed on Jan. 4, 2016.

STATEMENT REGARDING FEDERALLY SPONSORED RESEARCH OR DEVELOPMENT

N/A

BACKGROUND OF THE INVENTION

1. Field of the Invention

The present inventions generally relates to the field of firearm accessories and sights, and more particularly to accessories which can utilize and enhance a primary sight such as a rifle scope. More specifically, the present inventions relate to accessories which are mounted to the mounting rails of a rifle or pistol, and are specifically designed to use a smart phone on the weapon to improve the target view of a first scope or sight, the position of the shooter when viewing a target, the capabilities for photographs or video, amongst other features. The inventions relate to mounts and mirror assemblies specifically designed for securing a smart phone or device on the rail systems of firearms. An individual mount rotates 180°, 90° to each side of the weapon. The device was designed to mount any smart phone on the rotating and adjustable smart phone mount. When the camera of the smart phone is secured in the smart phone mount, it is easily adjusted to have the camera on the smart phone perfectly centered at the perfect height to view existing sights such as red dot sights, iron sights, laser sights, etc., with no obstructions as well as to use along with sight apps for smart phones which provide the capability of transmitting communications, video, GPS locations, and other features. Additionally, the custom mount has the ability to view targets and surrounding areas while being positioned in a perpendicular manner to the axis of the firearm such that the shooter can view targets, and fire, behind positions such as doors, walls, vehicle and the like. This is most significant in maintaining safety of people at risk such as those in the military, police agencies, or defending themselves.

2. Description of Related Art

As is well appreciated in the art of weaponry and particularly rifles and hand guns, there have been numerous attempts to develop more efficient, accurate accessories and user friendly sight systems. In general, firearm accessories have long been established for mounting on rifles and pistols. Such accessories include red dot sights, high powered lights, night vision, scopes, laser sights, and the like. All of the aforementioned firearm accessories aid in locating and pinpointing a target, however, the aforementioned prior art offers no protection to the user in a theater of combat in that they fail to provide the user with the ability to accurately pinpoint a target while taking cover during incoming fire in a theater of combat, meaning the user would have to expose himself as a target for the accurate use of a firearm.

In other words, in order to accurately locate, pinpoint, and fire on a target, the user of the firearm must then become exposed as a target in order to do so, which presents a severe problem. First responders, soldiers, and law enforcement personnel often encounter hostile combatants, violent actors, or offenders who carry pistols, rifles, or other weapons. In military scenarios, battles and other military operations often occur in urban theaters requiring armed forces to patrol and engage in battle in towns and cities. Personnel on patrol in dangerous areas must regularly take cover behind obstacles such as buildings, vehicles, trees, homes, etc. and have to locate and fire on hostile combatants from protective cover. The problem is that with friendly combatants' entire body being behind cover, a clear lineal view to be able to locate and accurately fire on advancing hostile forces cannot be accomplished without looking over or around these fortified structures to both locate and fire on hostiles, exposing himself as a target while doing so. Know statistics establish that as much as 50 percent of American casualties occur on the battlefield while doing so.

Currently available solutions to the problems and in the prior art that actually accomplish the task of supplying a combatant with the ability to effectively both locate and engage a target without becoming a target have been very high tech and complex solutions. They present problems unto themselves in that they are seriously lacking in their overall range of versatility, application, and adaptability, which is restrictive in their overall range of function, as current solutions to these problems are exclusive to themselves and only function as a complete unit, so they are restricted to being used with either the type of firearm they were designed to be used with or they become as integral part of firearm itself.

The present higher tech solutions to the problem of locating and engaging a target without becoming a target also consists of multiple bulky components and electronic devices that all require space as well as add additional weight to a soldier's existing heavy load. Another problem with the present solution to this problem is in their exclusivity with combinations of very expensive high-tech components, which not only limits their versatility and range of application but also creates additional problems of dependability in that all of these components are dependent on each other to work as a functioning unit. Furthermore, the cost of repair, service, and maintenance of these systems quite often make them unaffordable for most small entities such as militias, micro-states, police departments, or individuals.

There are several known lower tech mirrored mechanical solutions, which include rail mounted rotatable split beam mirrors that allow the user to view the target image provided by the red dot sight as the image is split and viewed from two positions from two small viewing ports or windows located at exactly 90 degrees to the firearm so that the user can view the target image but only from exactly 90 degrees to the firearm and the other one located directly behind the red dot sight when using the firearm in the conventional manner. This restricts the view of the target image acquired by the red dot sight to a certain extent in that these red dot sights come with variety of viewing window sizes, most of which are much larger than the one on the device. Split beam mirrors also have inherent problems such as image displacement, ghost imaging, problems with reflective light, and others.

Other known mirrored mechanical solutions consist of a rail mounted fold up mirror that when folded up and put into service, this mirror does not fully rise to an angle of 90° but rather stops into use at a much lesser angle. This restricts its range of use or positions that the user would have available to place himself in relation to the firearm and maintain a clear line of vision to the target image provided by the sight that this device is working in conjunction with. Another problem is that the mirror has an angled base that when this mirror is laid down into a position of non-use on top of the upper platform of this device, where the mirror assembly is rotatably coupled to the lower rail mount and the angled base of the mirror assembly lays over the hinge that connects the mirror assembly to the lower rail mount when this mirror assembly is put into a position of non-use. The devices sits at an even higher profile off of rail mount restricting more of the target image provided by the sight or further restricts the height requirements of the target viewing device it is working in conjunction with when this device is locked down in a position of non-use. On the back side of this mirror, is an iron sight that is an integral part of the back side of the mirror assembly that automatically comes into service when the mirror is lowered and locked into a position of non-use. This iron sight is advertised as an aid to the user to find the reticle provided by the sight of the accessory device. The problem is that this iron sight is not removable and it blocks a large part of the target image in that this iron sight extends up into parts of at least one half of the red dot sight's viewing window where target image provided by the red dot type sight is acquired by the user. This iron sight with all of its target acquisition restrictions would also, in most cases, prove to be of no use when used in conjunction with most of the red dot type sights in that most of the newer red dot type sights produced today are parallax free type red dot sights. In a parallax free sight, the reticle and the target image remain true to each other no matter what position the user is viewing target image provided by the sight, and not only would this part of the mirror assembly block a large part of the target image, but in most applications it would prove to be of no use. This device, as well as the aforementioned mechanical solutions, mount on the firearm's weapon rail at one height on the rail and the red dot sights they work in conjunction with, all mount at various heights on firearm's rail mount which renders these devices unusable unless the sight that it is being used in conjunction with mounts at the same height on firearm's mounting rail. Many of these red dot sights are also made for fast, easy target acquisition and with reticle in sight to be easily viewed from angles that these devices would not allow the red dot to be viewed from which would further restrict the overall function of the sights and restricting the view of the surrounding area when trying to locate targets using firearm in conventional manner. These devices are not only very limited in their range of use but they also hinder these red dot sight's abilities when using them in the conventional manner.

Other know devices offer no tactical solutions but use a smart phone for target acquisition and/or display that mount on a rifle. One such device is by Intelliscope™ and is simply a smart phone mount that attaches to a weapons rail and uses the camera on the smart phone, along with sight apps that are programmable into the smart phone, solely as its sighting device. The problem with using the smart phone camera as a sight in this manner is a serious lack of accuracy that can be acquired in this manner. The device is made mainly for paint ball guns or novice shooters. Another device also offers no tactical advantage but uses a smart phone to acquire a target image from a scope on a firearm. This device consists of a smart phone case with a bracket or clamp that attaches the smart phone in this case with the camera on the smart phone in the vantage point to view the target image provided by the scope, so that, instead of viewing the target image provided by the scope through the back lens of the scope, the target image is viewed on the screen of the smart phone but it is very limited in its range of use and versatility. T his device is made exclusively for high powered scopes and the smart phone case is exclusive to the type and size of the particular smart; if the owner ever changes smart phones the case must be changed as well. These smart phone cases are also made for a very limited range of smart phones.

Therefore, the representative art and conventional accessory mounts for gun rails and sights, including those utilizing smart phones, are problematic in varying ways, and do not relate to the structural or functional features of Applicant's improved, rotatably and adjustable mounts, and optical system.

Accordingly, there is a need in the art for a more accurate, efficient and user friendly smart phone mount and sight system for guns, one that allows for use in different configurations and angular orientation, adjustability, increases gun alignment and speed in target acquisition, and improved field of view. It is, therefore, to the effective resolution of the aforementioned problems and shortcomings of the prior art that the present inventions are directed. However, in view of the accessory sight and mount systems in existence at the time of the present inventions, it was not obvious to those persons of ordinary skill in the pertinent art as to how the identified needs could be fulfilled in an advantageous manner.

SUMMARY OF THE INVENTIONS

Applicant's present inventions provide a device that accomplishes the task of locating and engaging a target from a safe, secure position superior to high tech, highly complex and extremely expensive conventional products. Applicant's core device is relatively simple but highly effective mirrored mechanical device consisting of a vertically and horizontally adjustable and rotatable smart phone mount with an easily adjustable or self-adjusting mirror assembly. The core device acquires its target image by working in conjunction with various types of existing highly accurate target viewing or sighting devices on the firearm such as reflex or red dot sights or scopes. This is accomplished with this device's vertical and lateral smart phone adjusting or positioning abilities that allow the user to position the camera lens on the smart phone in the perfect vantage point of the gun sight or target viewing device that it is working in conjunction with while maintaining this vantage point of the viewing device at various positions up to 90° to each side of the firearm, enabling the user to view the target image provided by the gun sight or scope, with the target image of where the firearm is aiming always remaining in the perfect center of the smart phone screen behind the reticle. The camera lens remains in coaxial alignment with the sight, both when the user is viewing the target image provided by the sight while using the firearm in the conventional manner or from behind the firearm, as well as from various positions that the user would position himself on either side of the firearm. By simply rotating the firearm to maintain a clear lineal view of the target image displayed in the smart phone screen, the user can view and engage targets from basically any position that the user would have to place himself, in relation to the firearm. All of this while maintaining the ability to access and take advantage of all of the other abilities of the smart phone while doing. This further enhances and expands the abilities of this device such as the application of numerous sighting apps as well as features including the smart phone's ability to record photos and video for evidentiary use, and maintain communication with personnel, but also in numerous recreational ways as well.

Another real advantage of using a smart phone as a sight screen is in the screen's size, as the smart phone's screen would is many times larger than the average viewing window in the weapons reflex type sight or scope. Another great advantage of using a smart phone as a sight screen would be in the smart phone camera's zooming ability. The target image would initially be viewed in the smart phone screen as it was acquired by the camera from the front window of the sight with no magnification. If the user desires, this image can be zoomed in or enlarged. Further, all Droid and iPhones can be programmed in the settings of the phone to magnify this image as much as desired, and in other smart phones, this same ability can be achieved with an app that can be downloaded to the smart phone. Applicant's smart phone and mount instantly becomes a high powered scope with limitless adjustable magnification, expanding and enhancing tactical advantages of this device. The mount and its ability to employ any type or size of smart phone with its ability to vertically and laterally position the camera lens of the smart phone so that it remains in the perfect vantage point for the target acquisition of the sight or target viewing device has many advantages. The features mentioned herein are coveted by hunters and recreational shooters as well, which is the inventions include two basic designs, a tactical version and a non-tactical version.

The non-tactical embodiments of Applicant's invention include a rail mountable smart phone mount with vertical and horizontal smart phone adjusting abilities engineered to mount any size or type of smart phone with the camera lens in the perfect position or vantage point to acquire the target image from the various types of sights and target viewing devices. This provides anyone with the ability to use their smart phone in conjunction with their favorite sight or target viewing device on their firearm to radically enhance the sighting abilities of their firearm as well as to give the user the full range of other advantages and technology that a smart phone would offer when using it with a firearm.

The embodiments of the tactical designs of the inventions is basically the core rail mountable smart phone mount with vertical and horizontal smart phone adjusting abilities that give the user the ability to mount the smart phone with the smart phone's camera positioned in coaxial alignment and the perfect vantage point of the sight or target viewing device it is working in conjunction with. This tactical version is engineered in four basic embodiments, all of which have rotating rail mounts that rotate and lock into various angles of use up to 90° to each side of the firearm while the camera on the smart phone maintains the ability to keep the linear alignment to acquire the target image from the sight or target viewing device on the firearm. This is accomplished with four engineering designs of an easily adjustable or self-adjusting mirrored device which is fully described in the details and in conjunction with illustrations hereinafter.

The first primary embodiment includes a unit having two mirrors that are connected on both sides of the camera lens on the smart phone mount, with the opposing ends being connected to arms on the rail mount. These mirror pivot points on arms and to each side of the smart phone camera lens are perfectly positioned so that when the smart phone mount is rotated and locked into different positions on the rail mount, these mirrors come into adjustment automatically as the smart phone is rotated and locked into different positions about the firearm. The second core design includes telescopic mount arms that hold and secure the mirror on the rail mount, and extend or retract as the device is rotated and the mirrors are positioned; in this design, target insights on firearm and surrounding area can be viewed with the smart phone lens being set at 60°, not zoomed and set at 1.0.

The third primary embodiment relates to a rotating angle adjusting mirror that adjusts the angle of mirror with a finger pull and rotates the finger pull and mirror assembly to the other side of the camera lens on the smart phone in order to view the target from the other side of the firearm, and allows the user to view targets through sights on the firearms or with sight apps on the smart phone screen, and from any position the user is in in relationship to the firearm itself.

Finally, the fourth primary embodiment relates to an angle adjusting mirror that adjusts the angle of the mirror with a finger pull that has a cam track that an arm and finger pull on the mirror rides within and adjusts the mirror angle, and also flips the mirror over and adjusts the angle on the other side, also having another finger pull that slides and locks the mirror assembly back and forth in two positions on each side of the smart phone camera lens to view targets on either side of the firearm after the smart phone mount is rotated accordingly. This allows a shooter to view targets through sights on the firearms or with sight apps as indicated above.

Accordingly, it is an object of the present invention to provide more efficient, improved and superior designs for accessory smart phone mounts and sight systems for guns, which enhance speed and accuracy in gun alignment, target acquisition and viewing, aim and shooting.

It is another object of the present invention to provide improved accessory smart phone mounts and sight systems for guns that are secured to the gun rail, and are adjustable and rotatable for multiple configurations.

It is another object of the present invention to provide improved accessory smart phone mounts and sight systems for guns that improve viewing of targets through the primary gun sights through the smart phone lens, widen the field of view, and maintain the smart phone lens in coaxial alignment with the gun sights and reticles upon rotation of the mount.

It is another object of the present invention to provide improved accessory smart phone mounts and sight systems for guns that improve viewing of targets through the primary gun sights through the smart phone lens, when the smart phone is rotated to a position 90° and parallel to the rifle barrel, thereby allowing for firing around obstacles, walls and the like, placing the shooter out of harms way.

It is yet another object of the present invention to provide an improved accessory smart phone mounts and sight systems for guns that improve viewing of targets through the primary gun sights through the smart phone lens which are cost effective and operationally efficient.

Finally, is an object of the present invention to provide an improved accessory smart phone mounts and sight systems for guns which incorporates all of the above mentioned functions, objects and features.

In accordance with these and other objects which will become apparent hereinafter, the instant invention will now be described with particular reference to the accompanying drawings.

BRIEF DESCRIPTION OF THE DRAWINGS

FIG. 5 is a front view of one embodiment of the present invention illustrating the smart phone mount and the component bracket that the smart phone mounting bracket is secured to.

FIG. 23 is a front view illustrating the component bracket of FIG. 22 that the smart phone mounting bracket is secured to.

FIG. 33A is an enlarged backside view of the platform that the adjusting mirror assembly is mounted upon.

FIG. 33B is an enlarged front view of the adjusting mirror assembly mounted upon the platform of FIG. 33A, and gear components.

DETAILED DESCRIPTION

The inventive subject matter of the instant inventive embodiments for the sight adjustable and rotating smart phone mounts include core engineering designs for the mounts which have mirrored devices that are mechanically different from one another but each has the mount for a smart phone on weapons rail systems behind sights on the firearms such as red dot type sights and scopes, iron sights and others. The smart phone mounts adjust the smart phone camera lens to be in a perfect vantage point and coaxial linear alignment with the firearm sights including the surrounding area. The mounts also rotate the smart phone from side to side through 180° on the firearm and lock into various desired positions of use. There are four primary embodiments which include multiple mirrors, a variation with retractable mirror support arms, a single mirror which flips positions, and a rotating angle adjusting mirror assembly that adjusts the mirror angle with a finger pull mechanism.

The details of the above as described in the summary of the inventions are set forth in the following descriptions in conjunction with the drawings.

Figure 1:
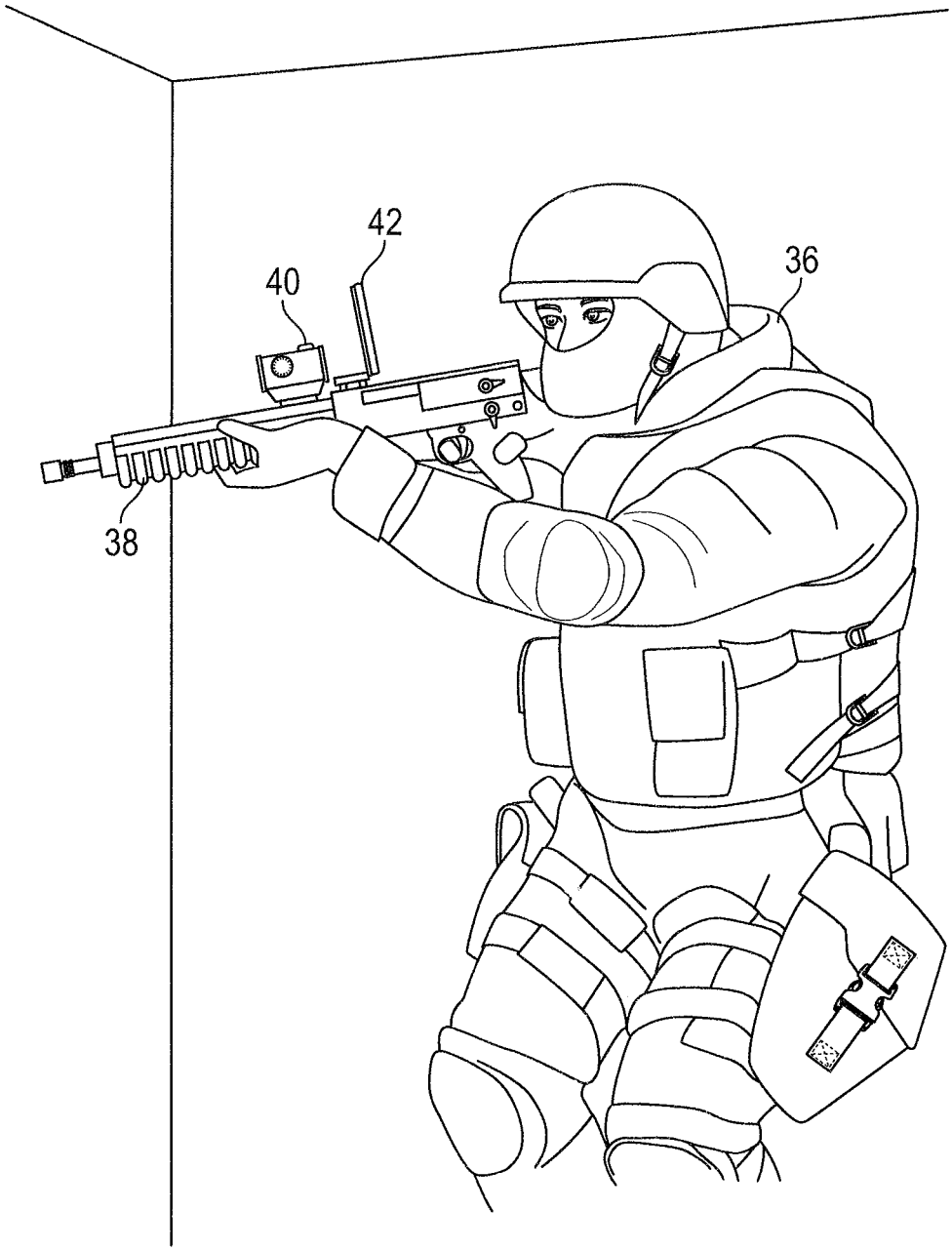
FIG. 1 is a side perspective view of one embodiment of the present invention illustrating the improved smart phone mount and phone secured to a gun rail behind the primary gun sight and in use by a shooter.

With respect to FIG. 1, shown is a combatant 36 utilizing the rotating smart phone and mount 42 in a conventional manner aiming down the barrel 38 of the rifle in the direction of the target. The smart phone has been adjusted, and is receiving and displaying the target image from the firearm's red dot sight or scope 40.

Figure 2:
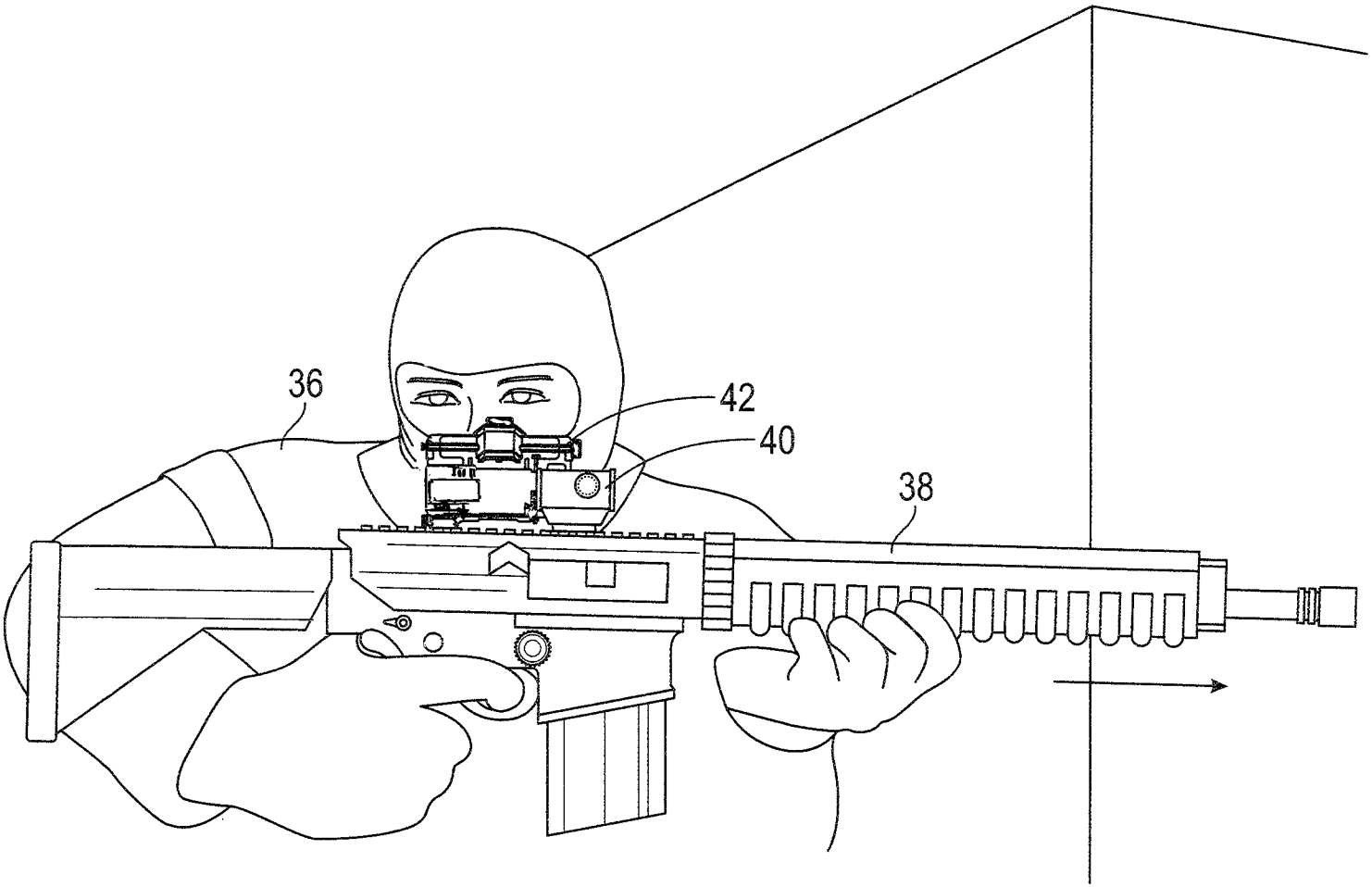
FIG. 2 is an alternative front perspective view of one embodiment of the present invention illustrating the improved smart phone mount and phone secured to a gun and rotated 90°, and in use by a shooter viewing the target in a perpendicular position to the gun barrel.

FIG. 2 depicts the image of the combatant 36 utilizing the rotating smart phone and mount 42 in an unconventional manner positioned on the side of the weapon, and receiving the target image from the rifle scope 40 that the mount's rotatable phone and mirror assembly which reflects the target image 90° from the weapon scope to the camera lens. This allows the combatant to view the target image when being positioned perpendicularly to the axis of the weapon, that is, from the side of the firearm. In this manner, a user can fire the weapon from behind or around buildings, walls or other obstructions, without allowing the person to become a target itself.

Figure 3:
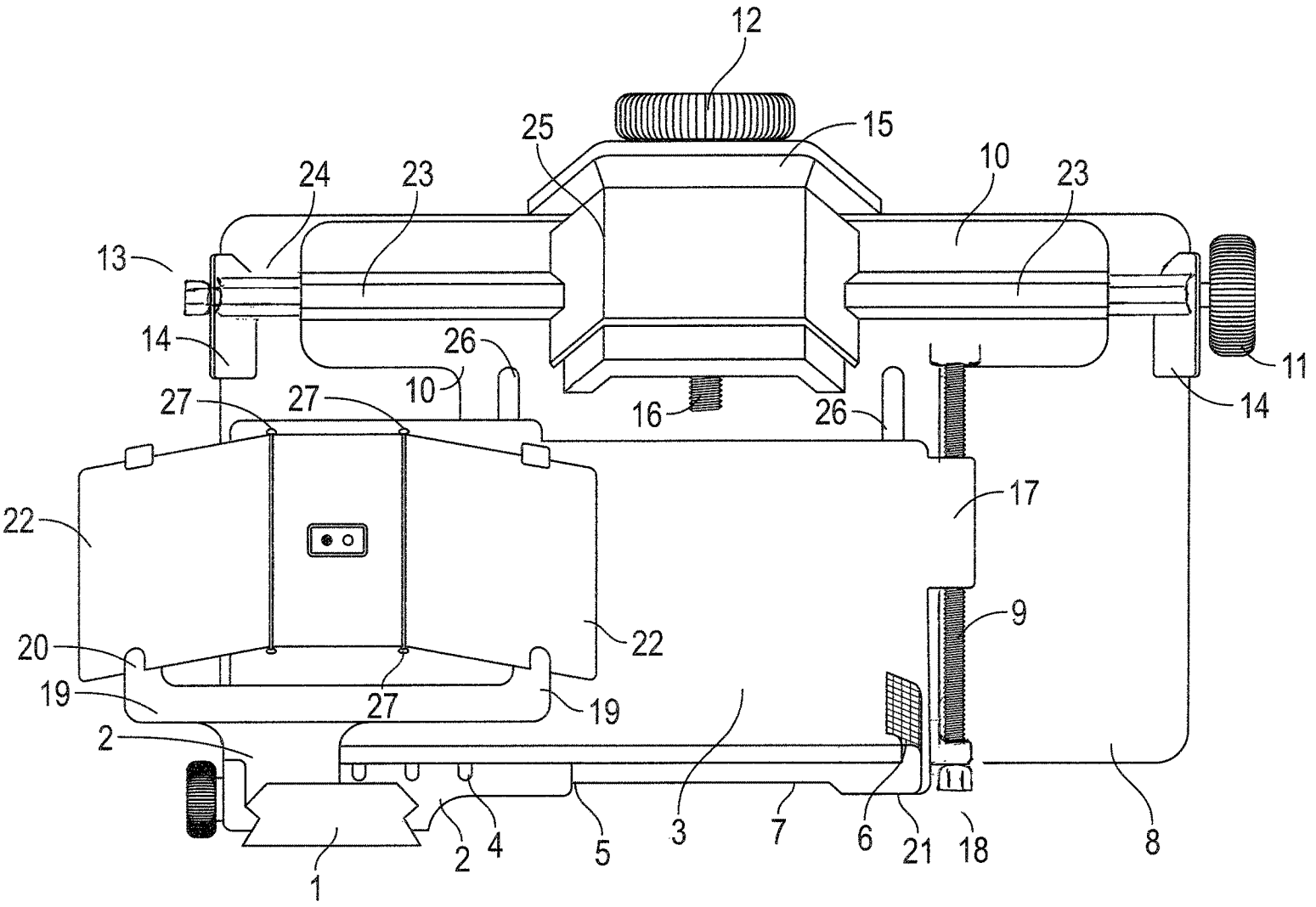
FIG. 3 is a front view of one embodiment of the present invention illustrating the smart phone mount having adjustable components.

FIG. 3 illustrates a front view of an embodiment of the smart phone mount having adjustable components. The smart phone is shown mounted in position that has the camera lens in the upper center part of the smart phone as located on many conventional phones. Rail mount 2, secured to the weapon rail 1, is the platform that the entire remaining components of the mounting device are attached to, mounted upon and rotates thereon. The mounting device and associated components rotate 180°, 90° on each side of the weapon, and lock into different selective position on rail mount 2.

Plate member 3 is a part of the device that rotates and locks into different positions on top of rail mount 2 and the smart phone mounting base adjusts vertically on. Plate member 3 includes an opening defining a lens window through which the camera lens receives images.

Rail mount 2 includes recesses or holes 4 to accommodate finger pull 6 locked into different positions. Pin 5 as described hereinafter locks into rail mount 2 when adjusted and smart phone bracket is locked into various positions to each side of weapon rail 1. Finger pull 6 operates pin 5 that locks into rail mount 2 when adjusted and the smart phone bracket is locked into select positions about weapon rail 1. Finger pull housing 7 retains pin 5 and a spring assembly that maintains finger pull 6 into the recesses 4 in rail mount 2 locked in the desired locations. Use of finger pull 6 and the pin/spring assembly allow the user to actively retract the finger pull and rotate the smart phone around to the desired location on rail mount 2 and snap into place.

Smart phone 8 is shown as secured on smart phone mount 10. The smart phone is mounted to the bracket or plate on the back side of smart phone mount 10 as shown. Tensioning knob 11 secures the smart phone in place after lateral adjustments are made. Tensioning knob 12 secures smart phone 8 downwardly into a lower cradle smart phone mount 10.

Brackets 14 secure the smart phone in the mounting device laterally. Lateral adjustments for the smart phone are made by threaded member 13; once an adjustment is made, the smart phone is easily removed by simply loosening tensioning knobs 11, 13. The smart phone can be re-mounted in the device which does not require any further adjustment.

Top bracket 15 functions in conjunction with tensioning knob 12 and securely locks the smart phone in place. Brackets 14, 15, along with the cradle at the bottom of the smart phone mounting base, are all slightly angled inwardly to maintain smart phone in a tight and secure fashion against the back of the smart phone mounting plate 10.

Threaded rod 16 is integral to tensioning knob 12, and threads through a threaded collet. The threaded collet is integral to the top of the smart phone mounting plate and on the reverse side of smart phone mounting plate 10 and located beneath members 15 and 25.

Protracted threaded housing 17 of plate member 3 is a component of the device that rotates and locks into different positions about rail mount 2, and smart phone mounting base 10 adjusts vertically upon. Housing 17 accommodates threaded rod 9 which is threaded therethrough and provides the vertical adjustment position of smart phone eight and mounting bracket 10. Threaded rod 9 includes a Phillips or Allen head 18 allowing for the vertical adjustment.

Turning now to components of the mirror assembly, the mirror arms include horizontal member 19 and vertical arms 20, which are integral to weapon rail mount 2. As the device is rotated on rail mount 2, reflective side mirrors 22 automatically adjust to view targets from either side of the firearm as the mirror arms remain stationary and parallel to the weapon rail. Mirrors 22 pivot and slide on arms 20 as the device is rotated through 180°.

Housing section 21 encloses the spring and pin 5 rod assembly that is engaged by finger pull 6 and operates as described.

Housing channel 23 of bracket 10 that receives brackets 24 which secure and adjusts smart phone 8 into the smart phone mounting bracket 10 laterally. Housing 23 would have a threaded collet or similar hardware mounted on the back side of the smart phone mounting plate 10 and the outside edges of this housing for which the threaded rod that is adjusted with knob 11 and knob/Allen head 13.

Brackets 24 also house the threaded rod, and are integral to brackets 14 that secure the smart phone laterally as referenced above. This threaded rod interfaces with a threaded collet that is integral to the back side of the smart phone mounting plate 10.

Housing 25 receives top bracket 15 for the adjustable part of the smart phone mounting bracket 10 that is integral to the smart phone mounting base.

Tracks 26 are channel like members of the smart phone mounting base 10 of this assembly, and receive protruding male columns on the back side of plate member 3. Tracks 26 are secured to plate member 3 and slidingly engage the plate member male columns for vertical adjustment. As will be appreciated by one of ordinary skill in the art, the tracks and columns can be of a tongue and groove design, T track, L track or any similar inter-related structure.

Hinge members 27 are secured to plate 3 and provide for pivotal and rotational movement of mirrors 22 as the mount assembly is rotated about rail mount 2. Pin members could also be used in lieu of hinge members 27, as well as any similar pivoting hardware.

The smart phone camera lens 28 is shown with the field of view through plate 3 and receives various images from mirrors 22 as the mount assembly is rotated through 180° as described above. The camera lens 28 is positioned to view the sites of the firearm at the precise vantage point and alignment, and also can be utilized with sight apps and various technology in a completely unobstructed view. FIG. 3 illustrates a typical smart phones wherein the lens is positioned in a central portion of the smart phone back.

Figure 4:
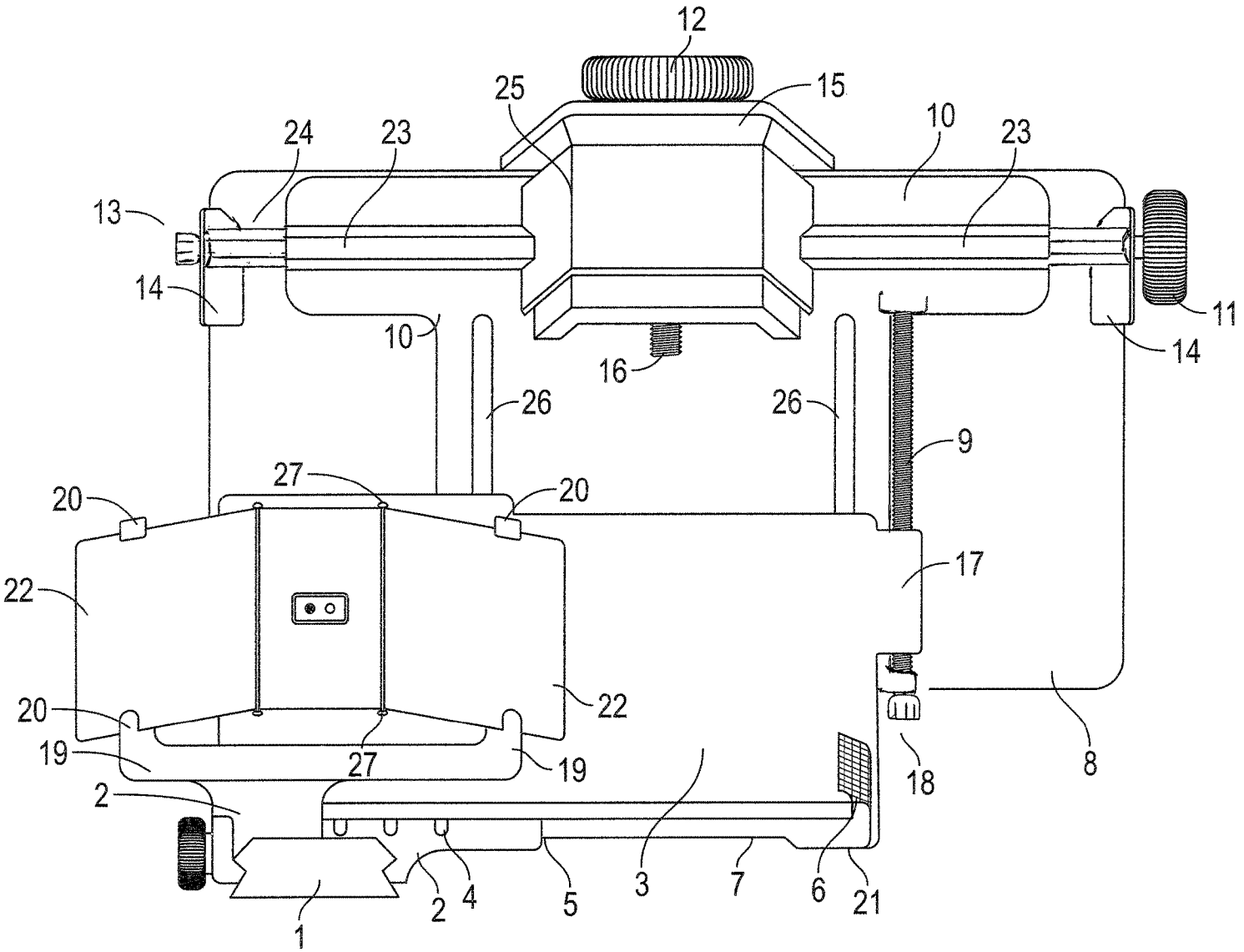
FIG. 4 is an alternative front view of the embodiment shown in FIG. 3, when adjusted for use with a smart phone of a different size or lens configuration.

Turning now to FIG. 4, the inventive mount assembly is shown in a position that has been vertically raised about plate 3 to accommodate the lens 28 position for smart phones having a different configuration and position of the lens on the back side of the smart phone, for example iPhones and others which placed the lens position closer to the back side corner of the phone. Note the vertical adjustment in FIG. 4, as opposed to the lens adjustment illustrated in FIG. 3. Of course the smart phone viewing screen on opposite side of lens 28 changes with the vertical position as well.

Figure 5:
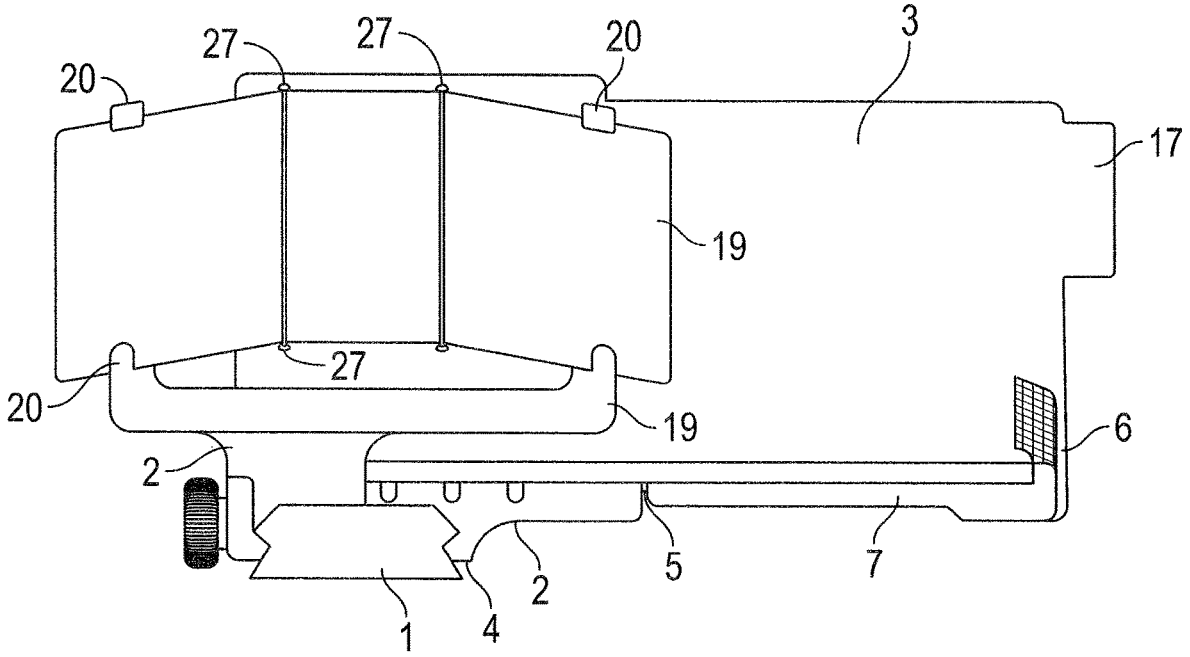

FIG. 5 is a front view illustrating plate 3, which receives the smart phone mounting base 10, and rail mount 2 with related components and parts, and the smart phone mounting base 10 removed. As referenced above, the rail mount is the platform that the complementary phone mount assembly attaches to, rotates upon, and locks into different angular positions about the rail mount to.

Figure 6:
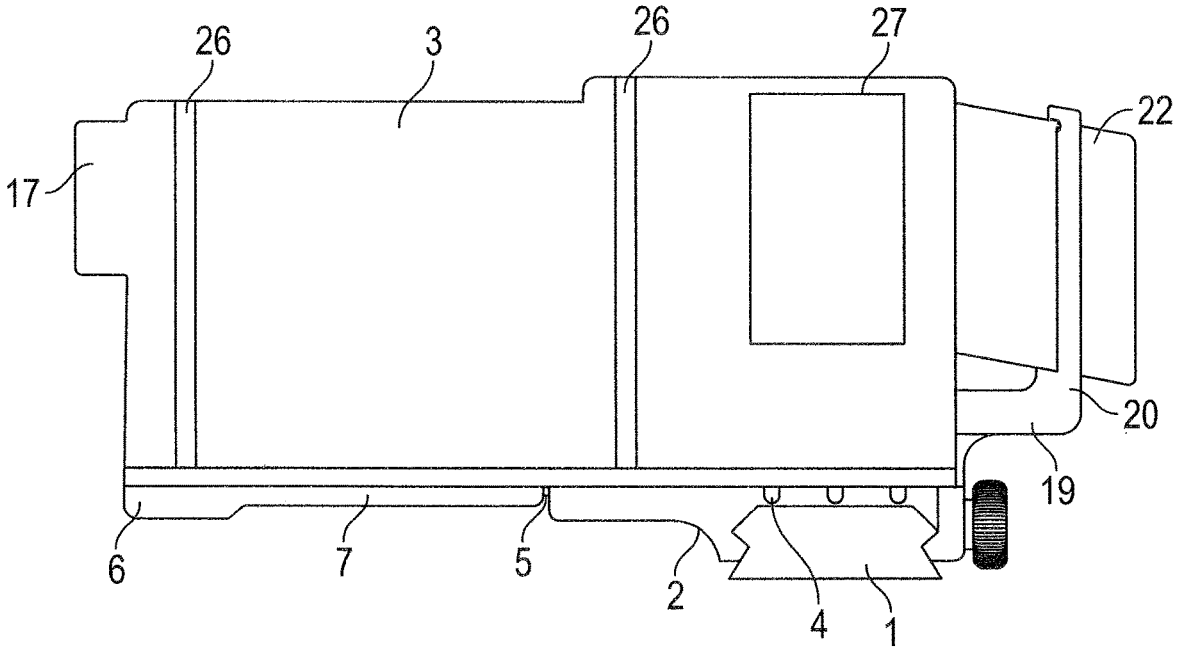
FIG. 6 is a view of the backside of the apparatus shown in FIG. 5.

FIG. 6 is a back side view of the structure shown in FIG. 5, also with the smart phone mounting base 10 of FIG. 3 removed. Plate member 3 includes the opening defining a lens window as shown, through which the camera lens receives images.

Figure 7:
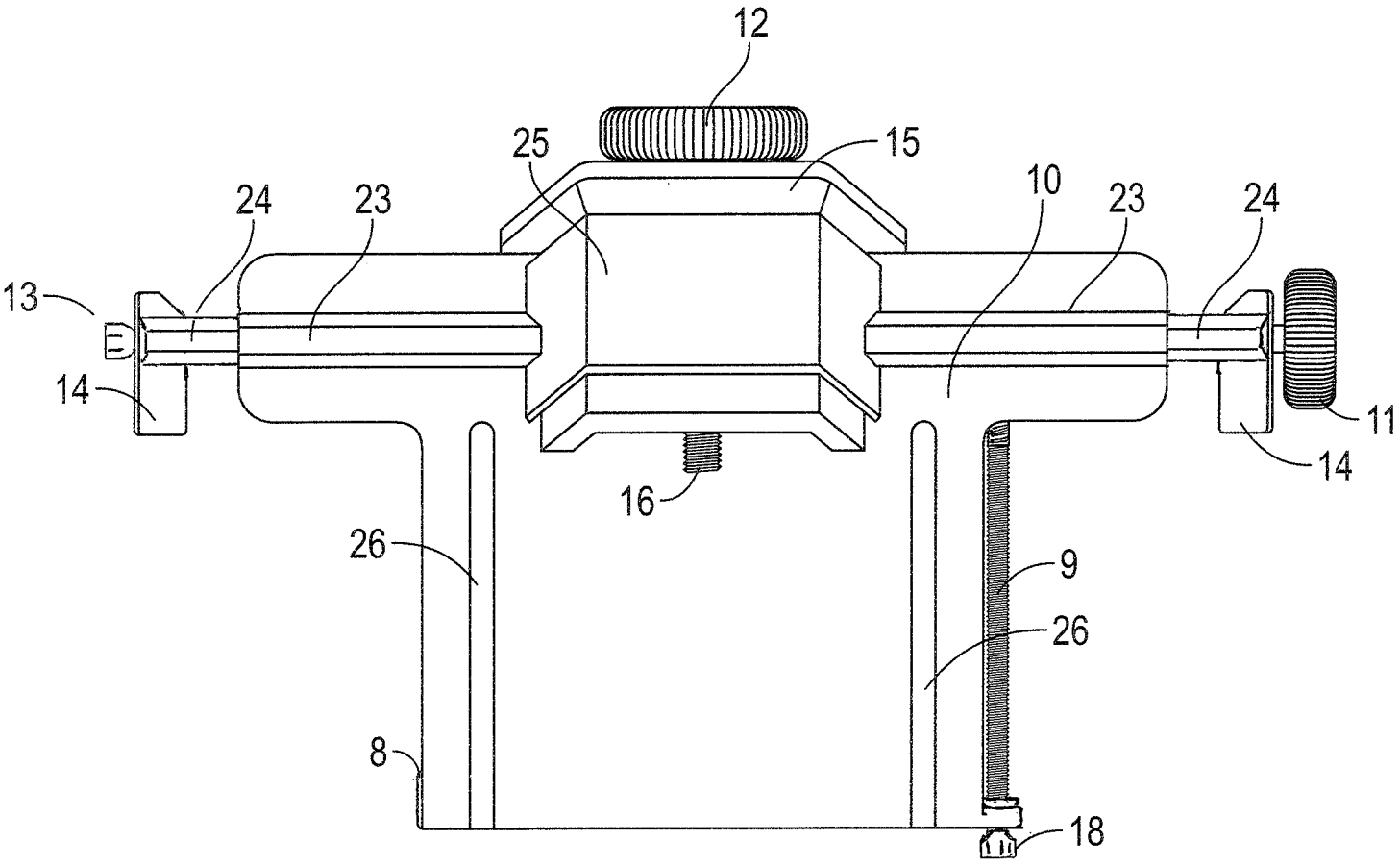
FIG. 7 is a front view of one embodiment of the present invention illustrating the adjustable smart phone mounting bracket.

FIG. 7 is a front view of one embodiment of the present invention illustrating the adjustable smart phone mounting bracket 10 shown when removed from lower bracket 3 of FIG. 3. It can be seen tracks 26 locked into and slide vertically to select up and down positions in conjunction with the tracks located on plate member 3 is shown in FIG. 6. As mentioned, these interlocking tracks can be female channels and male columns, tongue and groove assemblies and other complementary designs. The smart phone mounts to the backside of mounting bracket 10 and is secured thereto as described above. Mounting bracket 10 includes a lower cradle or curved flange 8'. The smart phone rests within this cradle and is tightened and locked into position once adjustments are made with tensioning knob 12.

Figure 8:
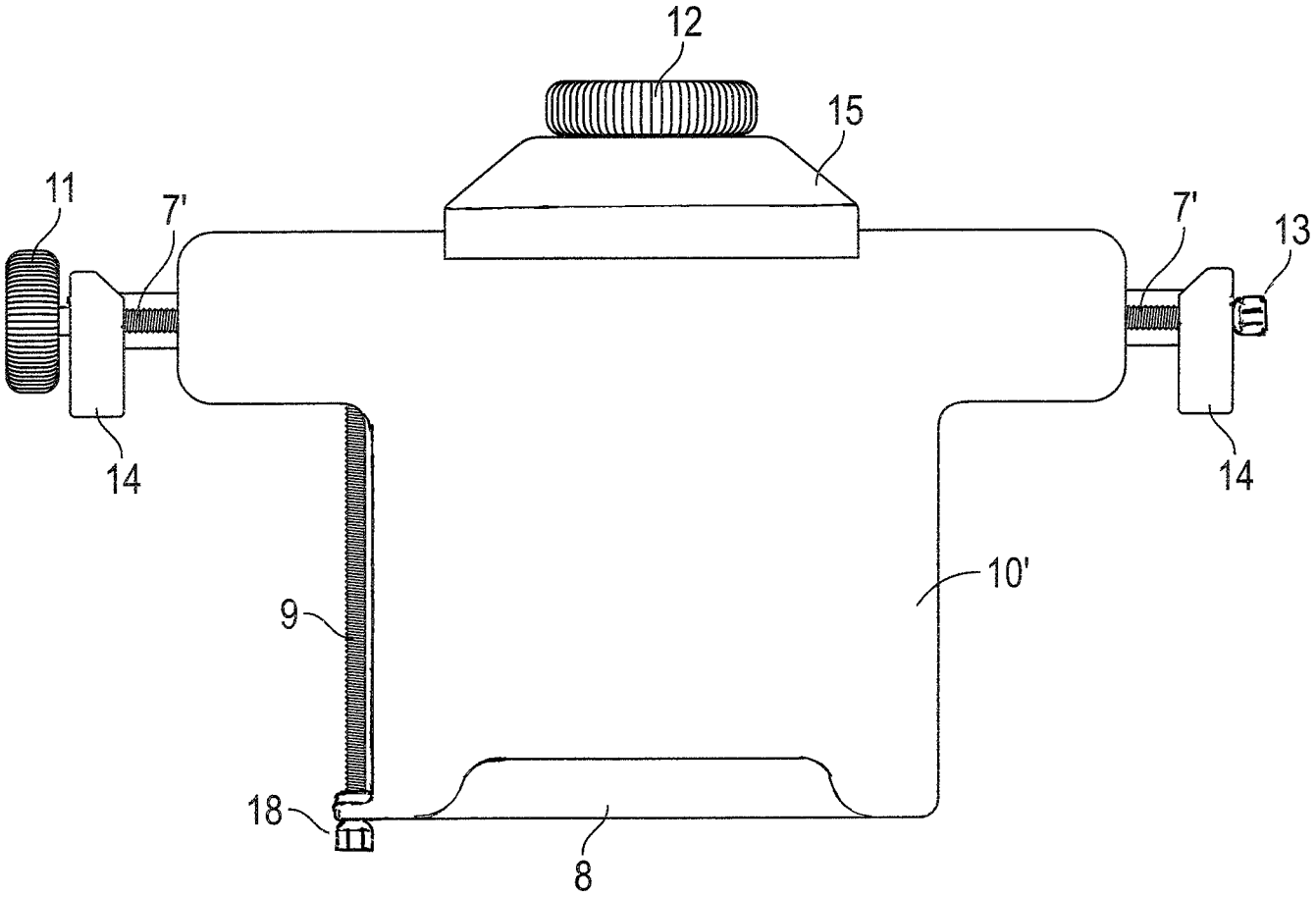
FIG. 8 is a view of the backside of the apparatus shown in FIG. 7.

FIG. 8 is a view of the backside of the apparatus shown in FIG. 7, and depicts the cradle 8' within which the smart phone rests. Brackets 14 are related hardware adjust the smart phone laterally as referenced in FIG. 3. Base plate 10' secures the smart phone with the upper bracket 15. Threaded rods 7' are integral to brackets 14 in this illustration and are inserted into threaded collets on the backside edge of plate 10' for making lateral adjustments and securing a smart phone to the bracket assembly.

Figure 9:
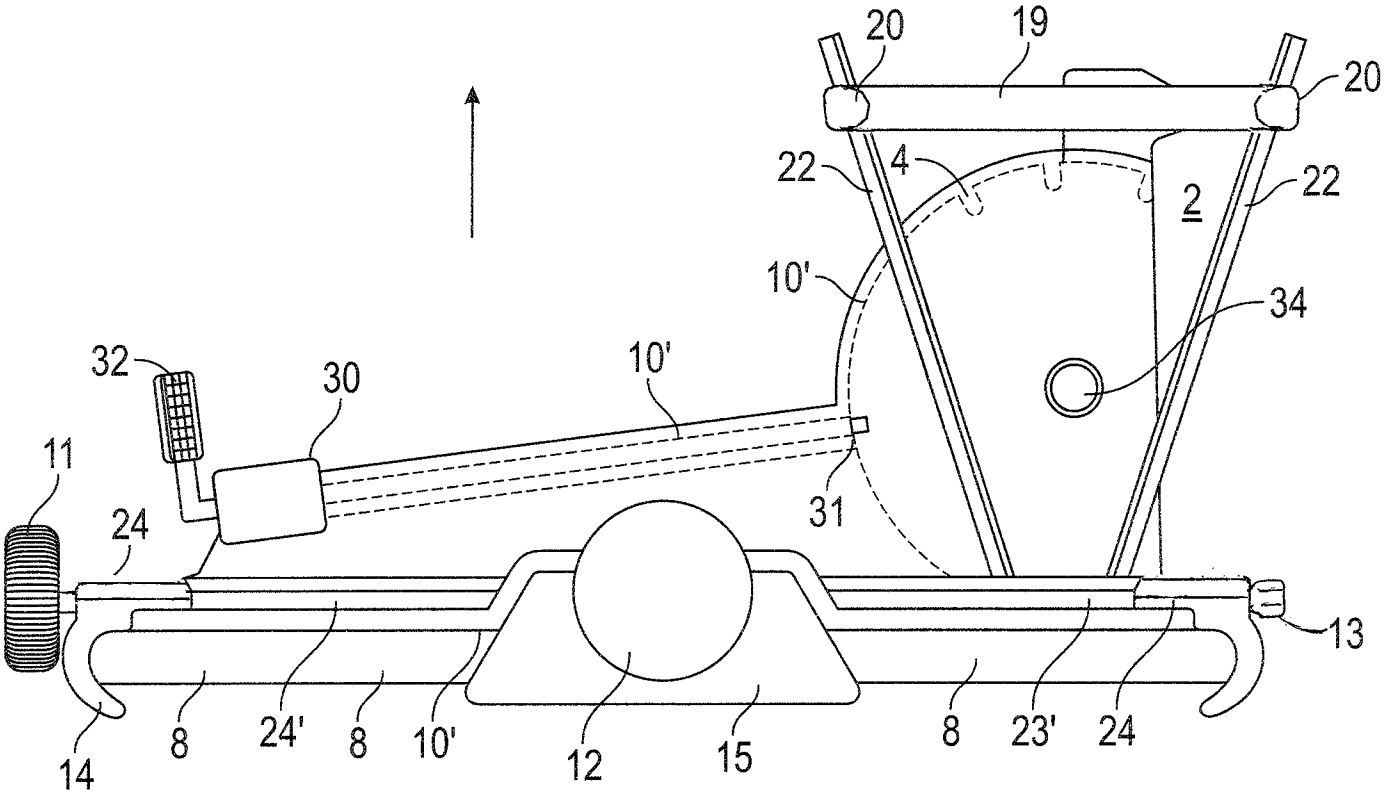
FIG. 9 is a top plan view of one embodiment of the present invention illustrating the improved rotatable smart phone mount, components, and phone secured thereto, when viewing a target in the conventional manner in conjunction with a rifle barrel and rail.

FIG. 9 is a top plan view of the apparatus shown in FIG. 3 illustrating the improved rotatable smart phone mount, components, and phone secured thereto, when viewing a target in the conventional manner in conjunction with a rifle barrel and rail. Rifle rail mount 2 is shown in hidden lines beneath base plate 10', which is integral to the smart phone mounting base, and rides on and rotates on rail mount 2. Spring 30 is located inside the housing of the rod that the finger pull controls in releasable fashion to lock in various positions and angles of operation as described above. Pin 31 is part of the rod and finger pull 9 that snaps into place within various recesses/holes 4 and rail mount 2, with the spring biased and quick release finger pull assembly.

Housing 24 for the threaded rod is integral to brackets 14, and its threads engage the threaded collets integral to the backside of the smart phone mounting plate as referenced herein. Housing 24' receives brackets 24 securing and adjusting the smart phone laterally within the smart phone mounting bracket. As mentioned, housing 24 would also include integral collets mounted on the backside of the smart phone mounting plate towards the periphery. Pin or shaft 34 is the securing hardware and point of rotation between rail mount 2 and the smart phone bracket assembly and plate 10'.

Figure 10:
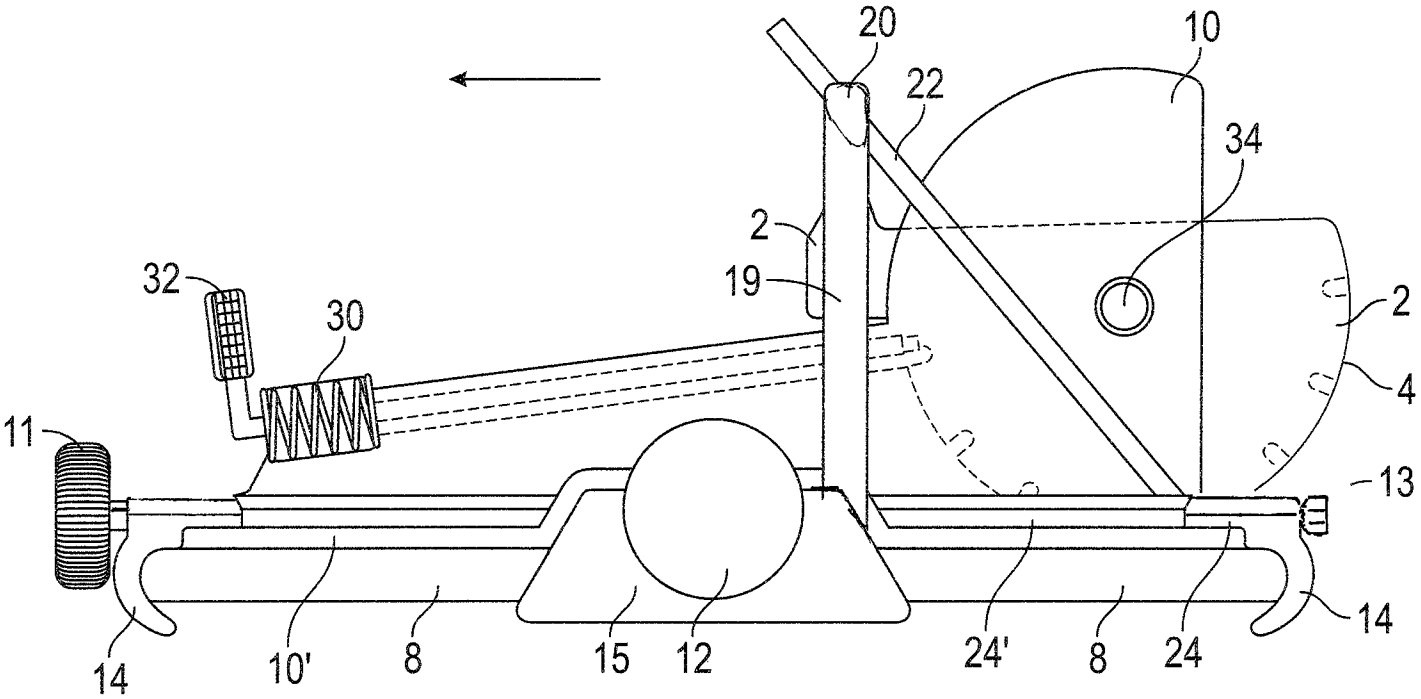
FIG. 10 is a top plan view of one embodiment of the present invention illustrating the improved rotatable smart phone mount, components, and phone secured thereto, when viewing a target in an unconventional manner in a position of the user standing perpendicular to a rifle barrel and rail.

FIG. 10 is alternative top plan view of the apparatus and novel mount and mechanical components shown in FIG. 9, illustrating the improved rotatable smart phone mount, components, and phone secured thereto, when viewing a target in an unconventional manner in a position of the user standing perpendicular to a rifle barrel and rail. The smart phone mounting assembly has rotated to the left side of the firearm and locked into this position, and is now parallel to the gun rail mount 2. The camera lens now views reflected images from mirror 22 and through the rifle sights or scope.

Figure 11:
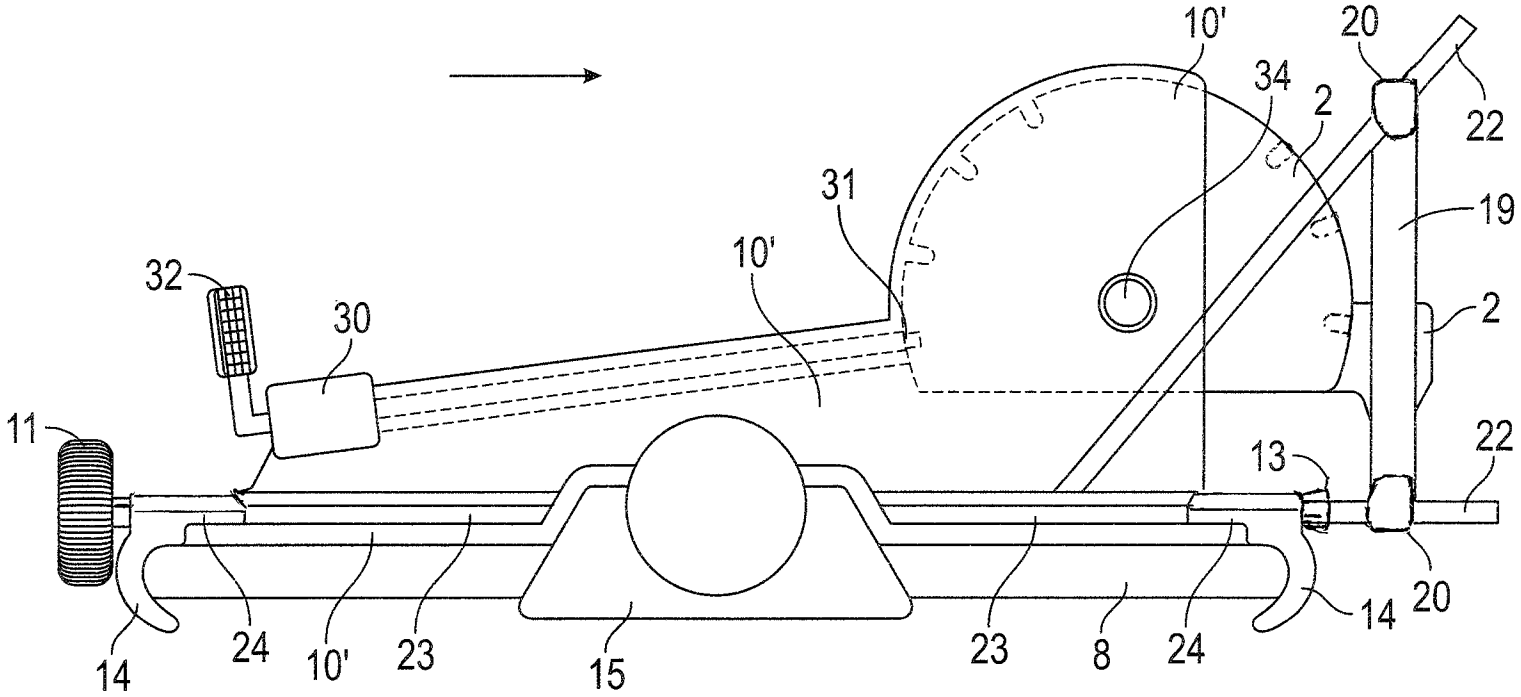
FIG. 11 is an alternative top plan view of the apparatus shown in FIG. 10 when viewing a target in an unconventional manner in a position on the opposite side of the rifle barrel and rail.

FIG. 11 is alternative top plan view of the apparatus and novel mount and mechanical components shown in FIG. 9, illustrating the improved rotatable smart phone mount, components, and phone secured thereto, when viewing a target in an unconventional manner in a position of the user standing perpendicular to a rifle barrel and rail. The smart phone mounting assembly has rotated to the right side of the firearm and locked into this position, and is now also parallel to the gun rail mount 2. The camera lens now views reflected images from mirror 22 and through the rifle sights or scope from the right side of the weapon.

Figure 12:
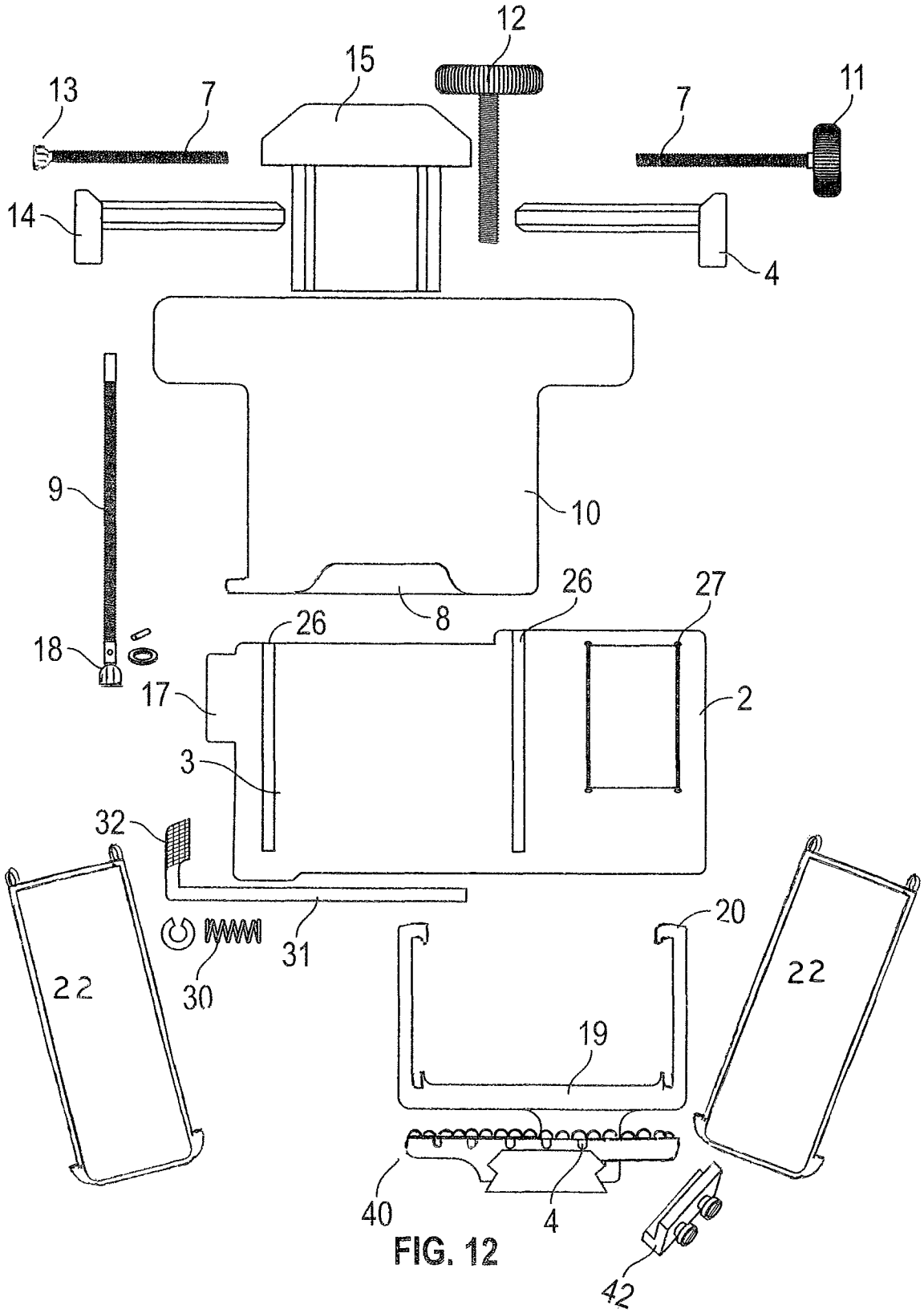
FIG. 12 is an exploded backside perspective assembly view of the apparatus shown in FIG. 3.

FIG. 12 is an exploded backside perspective assembly view of the apparatus and mechanical components shown and described in FIG. 3 through FIG. 9. In addition, an alternative rail mount base 40 is incorporated into the rail mount apparatus. Rail mount base 40 includes a ball bearing and race assembly as described hereinafter. Also shown is clamping pin assembly 42 which locks the rail mount base to gun rail 1.

Figure 13:
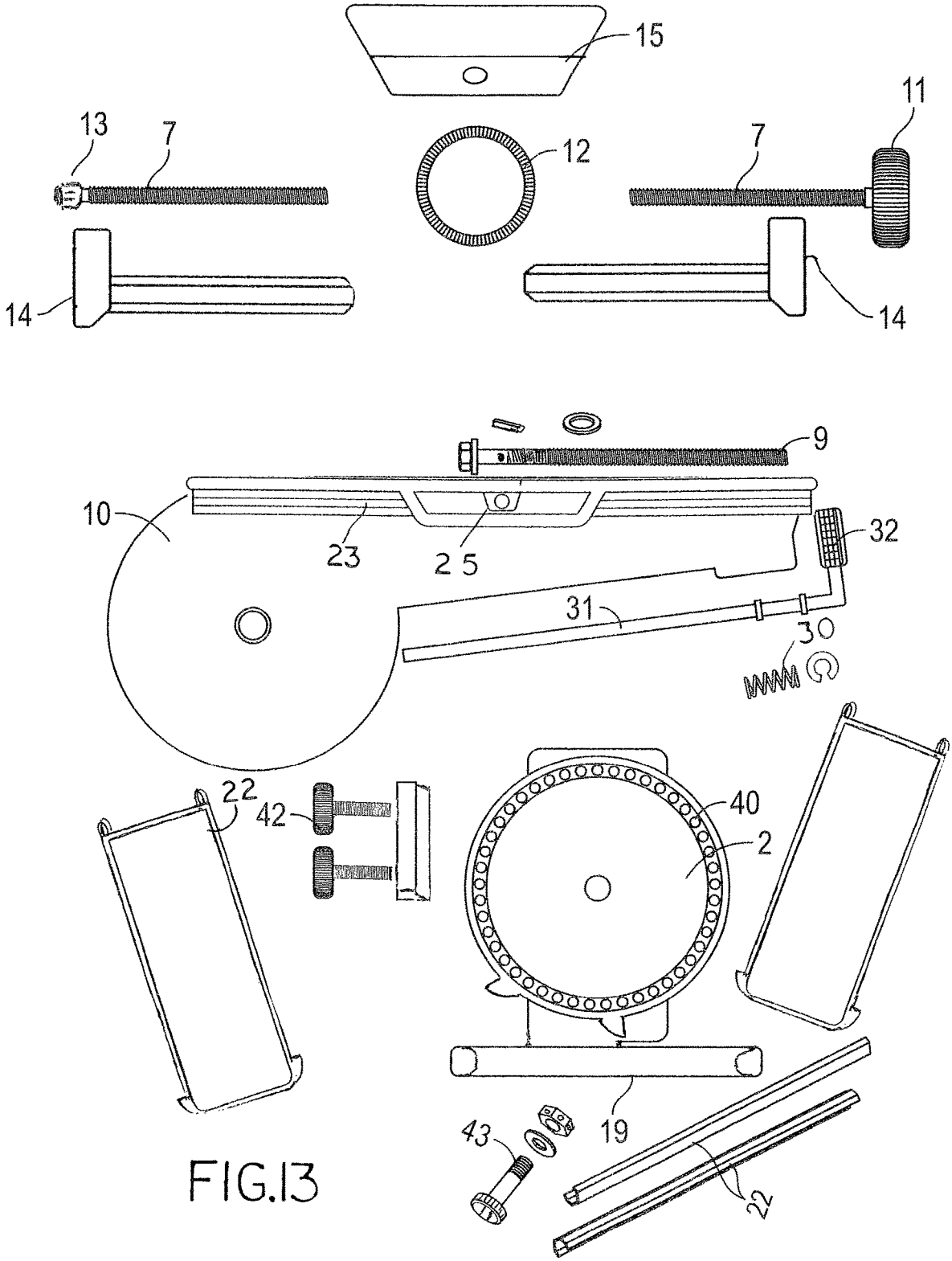
FIG. 13 is an exploded top plan perspective assembly view of the apparatus shown in FIG. 3.

FIG. 13 is an exploded top plan perspective assembly view of the apparatus shown in FIG. 3 through FIG. 9. Circular ball bearing race 40 and bearings are shown on rail mount 2, which in this embodiment engages and complements the corresponding circular shape of smart phone mount plate 10'.

Figure 14:
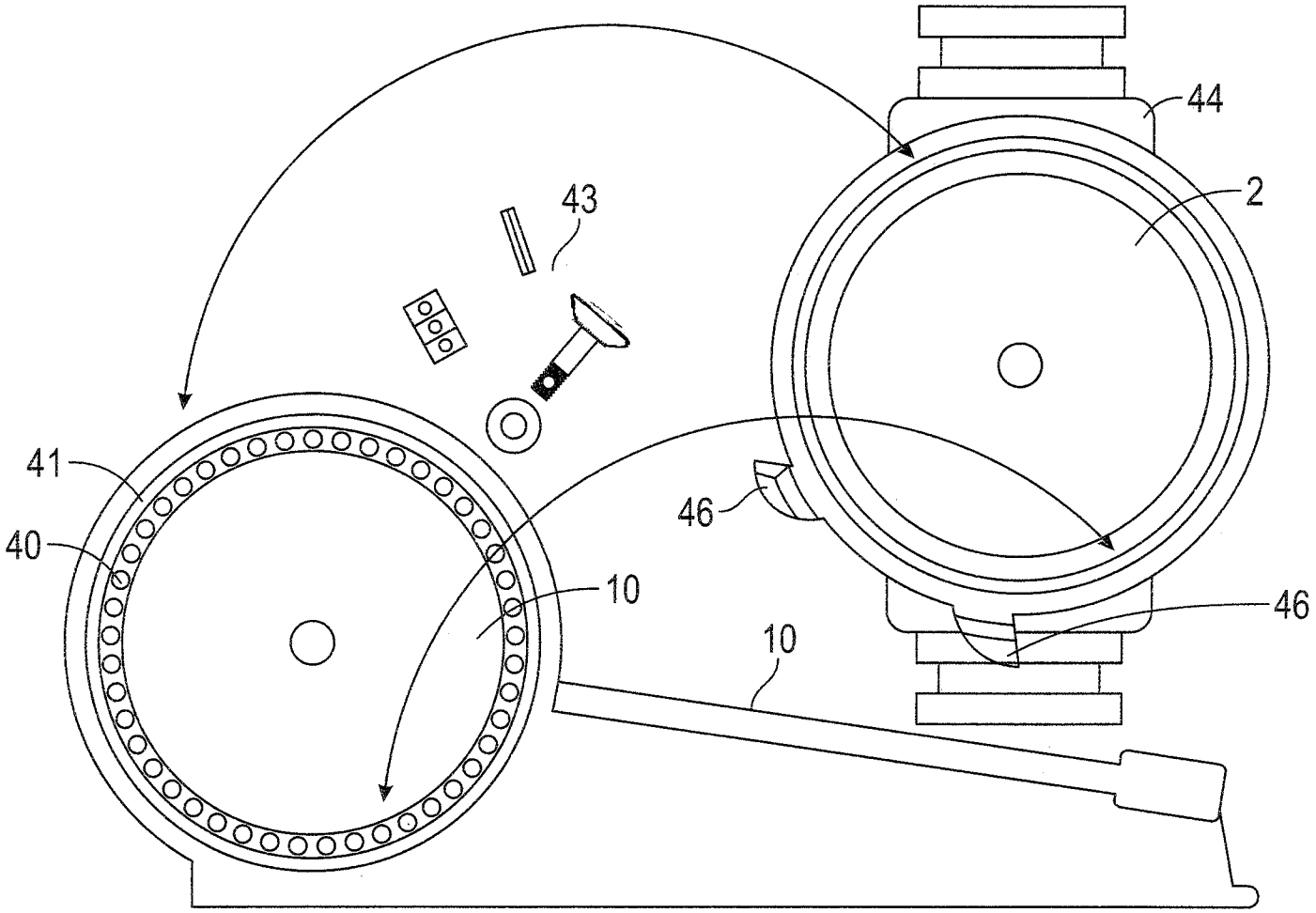
FIG. 14 is an enlarged top plan view of the rail mount, bearing and race components of the instant inventions.

FIG. 14 is an enlarged top plan view of the rail mount, bearing and race components of the instant inventions. Ball bearing race 40 is shown positioned beneath mount plate 10' and would be interposed between plate 10' and the circular upper surface of rail mount 2. Plate 10' complementary and interfacing circular channels 41', which interlock with geometrically complementary circular channels 2' of rail mount 2. Base mount plate 10' rotates about rail mount 2, with the bearing race 40 interposed and sandwiched between these housings. Rail mount stops 46 limit the 90° rotation about each side of rail mount 2.

Figure 15:
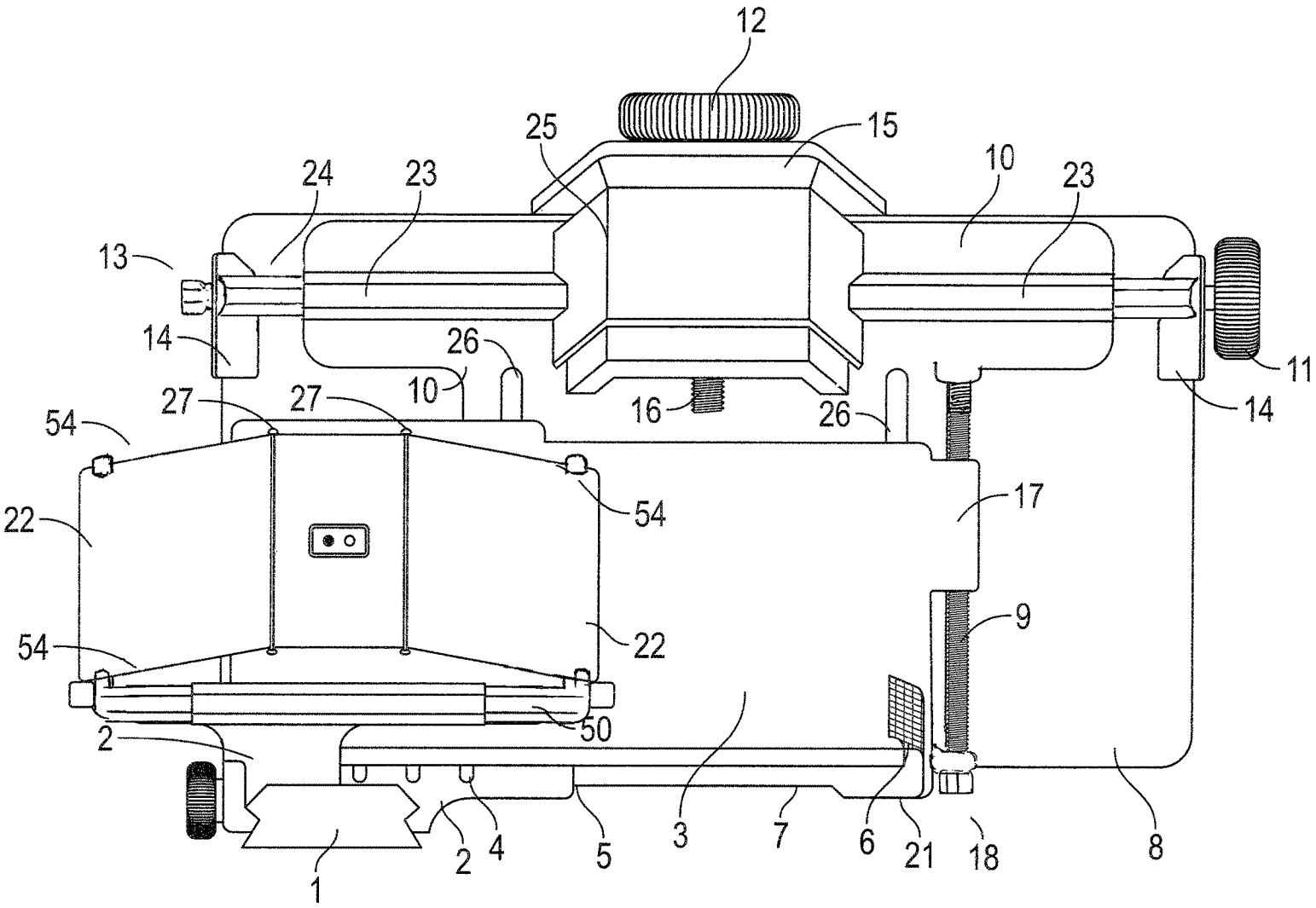
FIG. 15 is an alternative embodiment of the apparatus shown in FIG. 3 with telescopic arms on the device which holds mirrors on the rail mount.
Figure 20A:
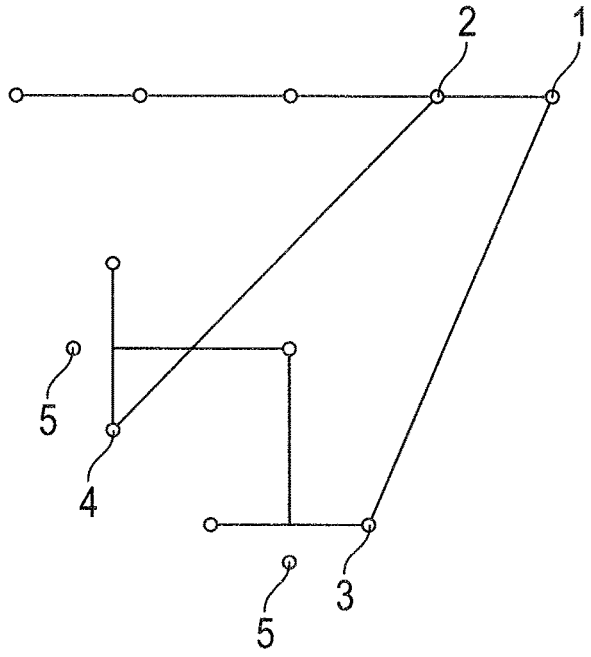
FIG. 20A is a diagram illustrating the sight lines for mirror adjustments in the embodiments referenced above.
Figure 20B:
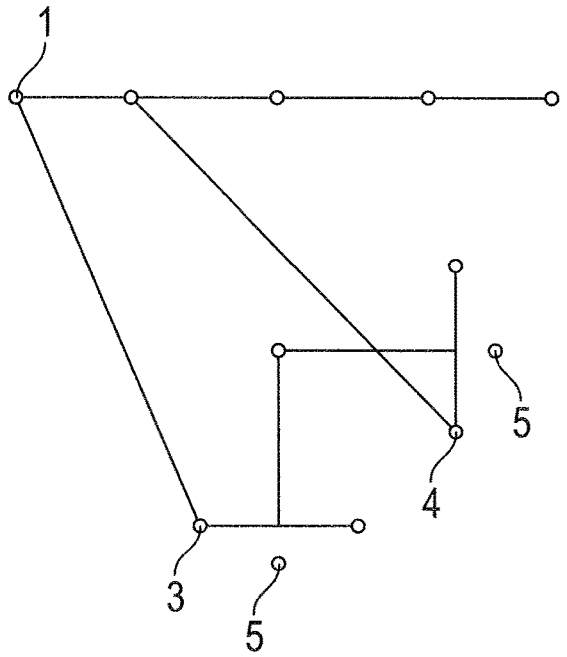
FIG. 20B is alternative diagram diagram illustrating the sight lines for reverse mirror adjustments as referenced in FIG. 20A.

FIG. 15 is an alternative embodiment of the apparatus shown in FIG. 3 with telescopic arms on the device which holds mirrors on the rail mount. In this embodiment, the weapons rail mount extends out laterally and is telescopic in that they are spring-loaded and can expand and retract horizontally from the upper part of the rail mount on each side of the rail mount. These spring-loaded arms compress in as the device is rotated to each side of the weapon as the other side of mirrors 22 that are mounted on the device are pulled, compressing springs on telescopic arms on the opposite side of the weapon that the devices rotated toward. This action also compresses the mere arm on opposite side of the rail mount into the device. The design with spring-loaded telescopic arms keeps mirrors 22 in a full 60° position to the camera lens when the mount is used in a conventional position. This design allows the camera lens to remain at a 1.0 setting without any zoom feature while in use, then mirrors 22 pull the telescopic arms inwardly on the devices rotated, and when the devices rotated to approximately 90° the mirror is positioned at the precise angle to view a target from the side of the weapon and the smart phone screen facing approximately 90° to the weapon. With reference to FIG. 20A and FIG. 20B below, the mount functions that lesser degrees of rotation, and comes into full screen when the camera lens is zoomed out at 1.0, you could full-screen viewing at a less degree of angle when the camera is zoomed in; to get full-screen viewing when the camera is not zoomed in, it comes into view at just less than 90°.

Spring-loaded housing 50 receives telescopic arms 52 that hold mirrors 22 which pivot and adjust for proper angles when the devices rotated to view targets on one side of the firearm or the other. The spring-loaded telescopic arms 52 are integral to the rail mount 2 that remain stationary in parallel to the weapons rail 1. Vertical arms 54 are integral to telescopic arms 52. Vertical arms 54 connect to and slide on mirrors 22, which can have spring-loaded stops to limit movement about the telescopic arms, which allows for control of the desired pivot points to position mirrors 22 at precise angles of rotation.

Figure 16:
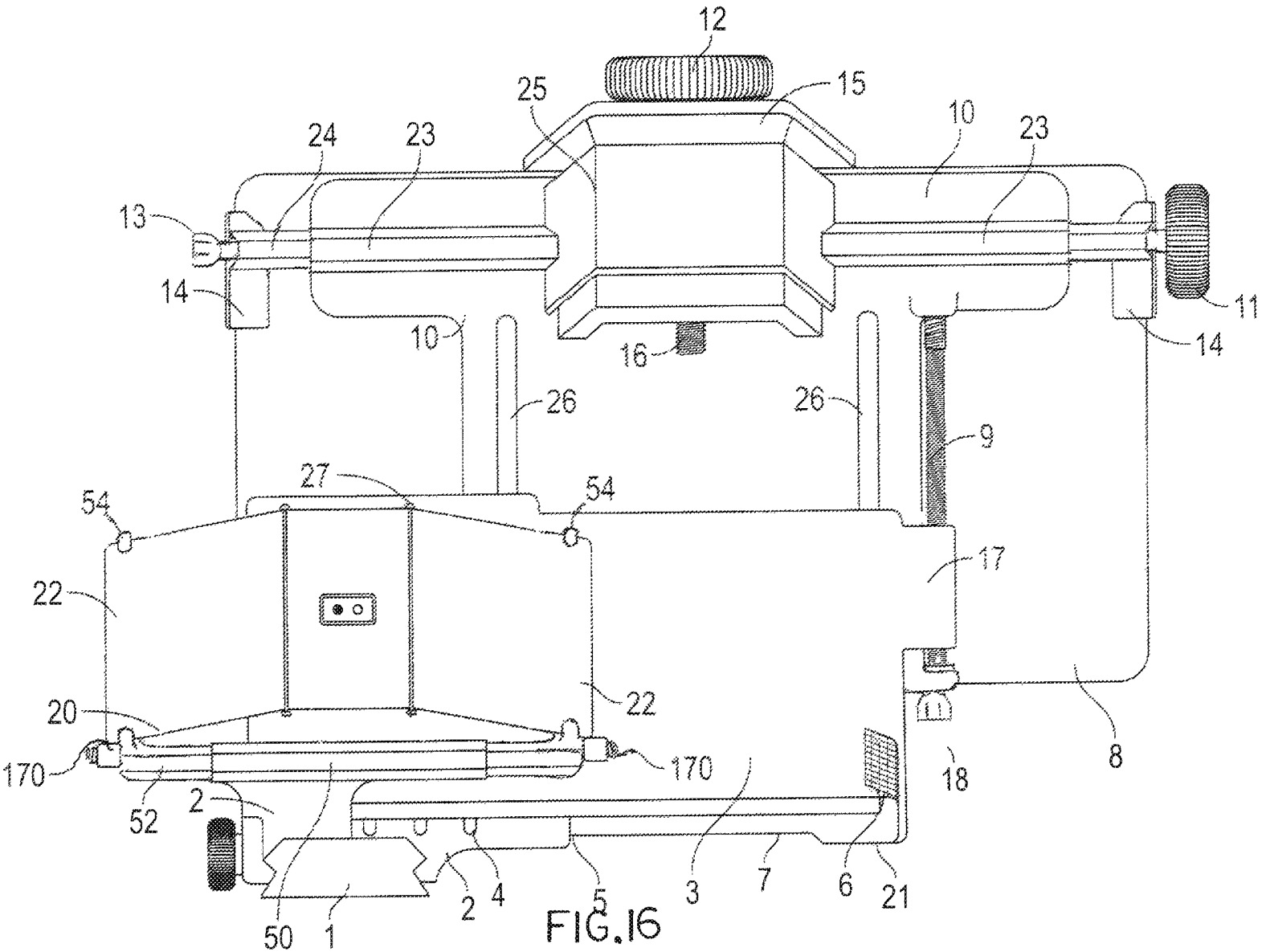
FIG. 16 is a front plan view of the apparatus shown in FIG. 15 adjusted for a smart phone with different lens configuration.

FIG. 16 is a front plan view of the apparatus shown in FIG. 15 adjusted for a smart phone with different lens configuration.

Figure 17:
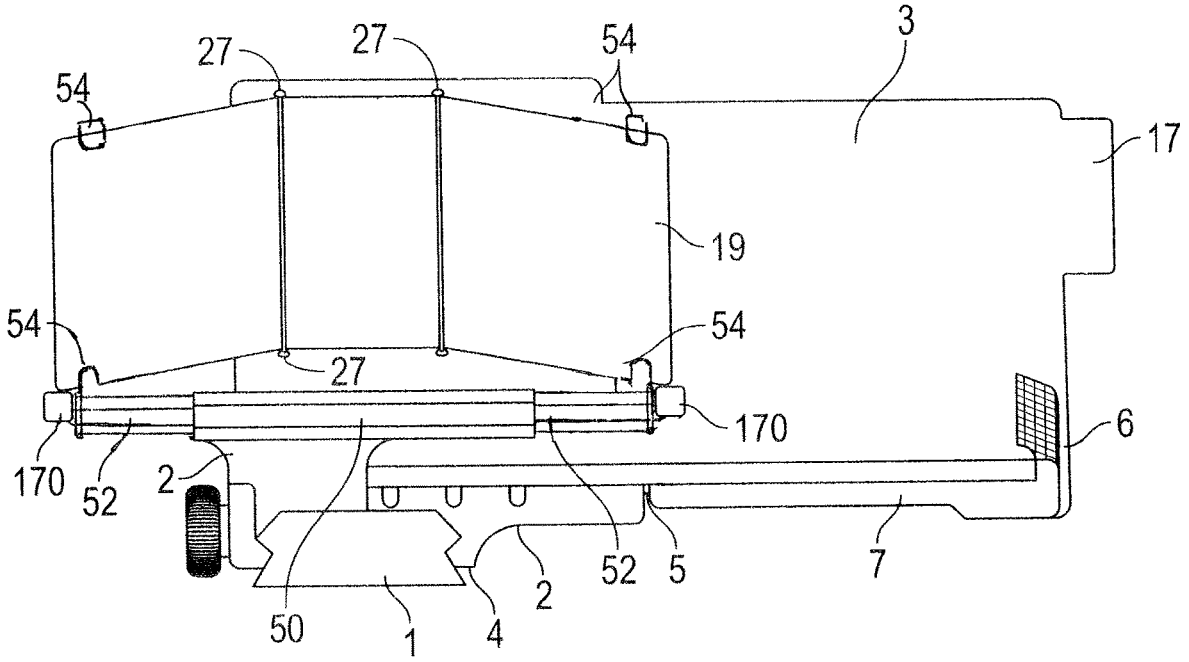
FIG. 17 is a front plan view of the apparatus shown in FIG. 5 with telescopic arms on the device which holds mirrors on the rail mount.

FIG. 17 is a front plan view of the apparatus shown in FIG. 5, with telescopic arms shown in FIG. 15, on the device which holds mirrors on the rail mount.

Figure 18:
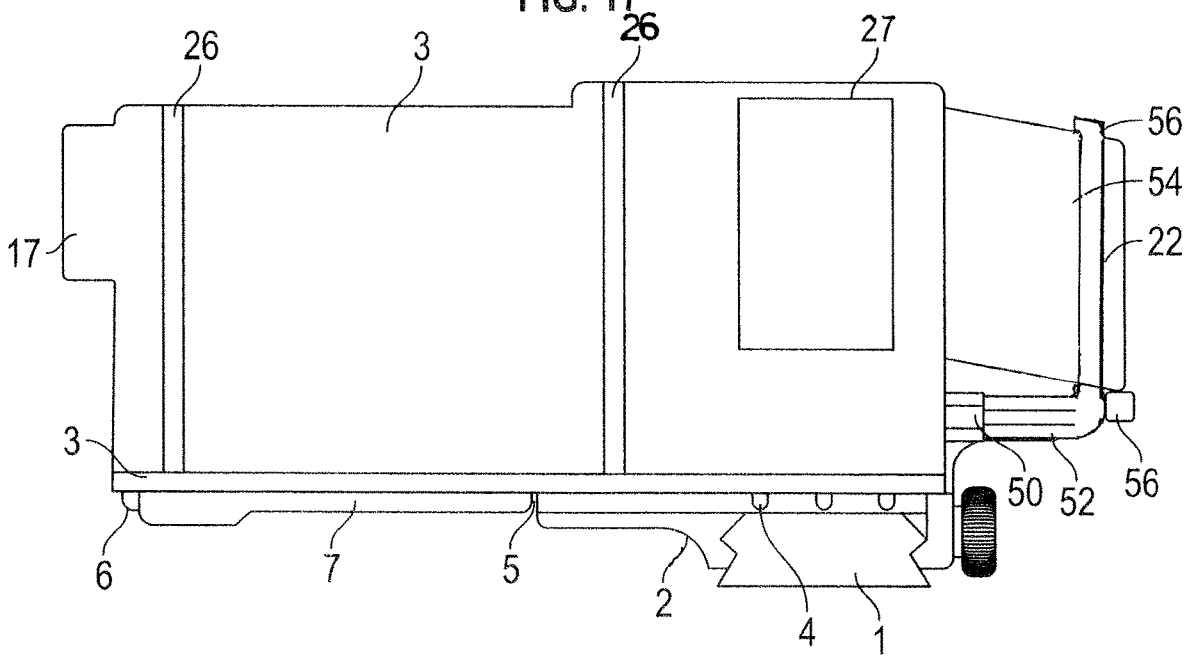
FIG. 18 is a front plan view of the apparatus shown in FIG. 6 with telescopic arms on the device which holds mirrors on the rail mount.

FIG. 18 is a front plan view of the apparatus shown in FIG. 6 with telescopic arms on shown in FIG. 15, the device which holds mirrors on the rail mount.

Figure 19:
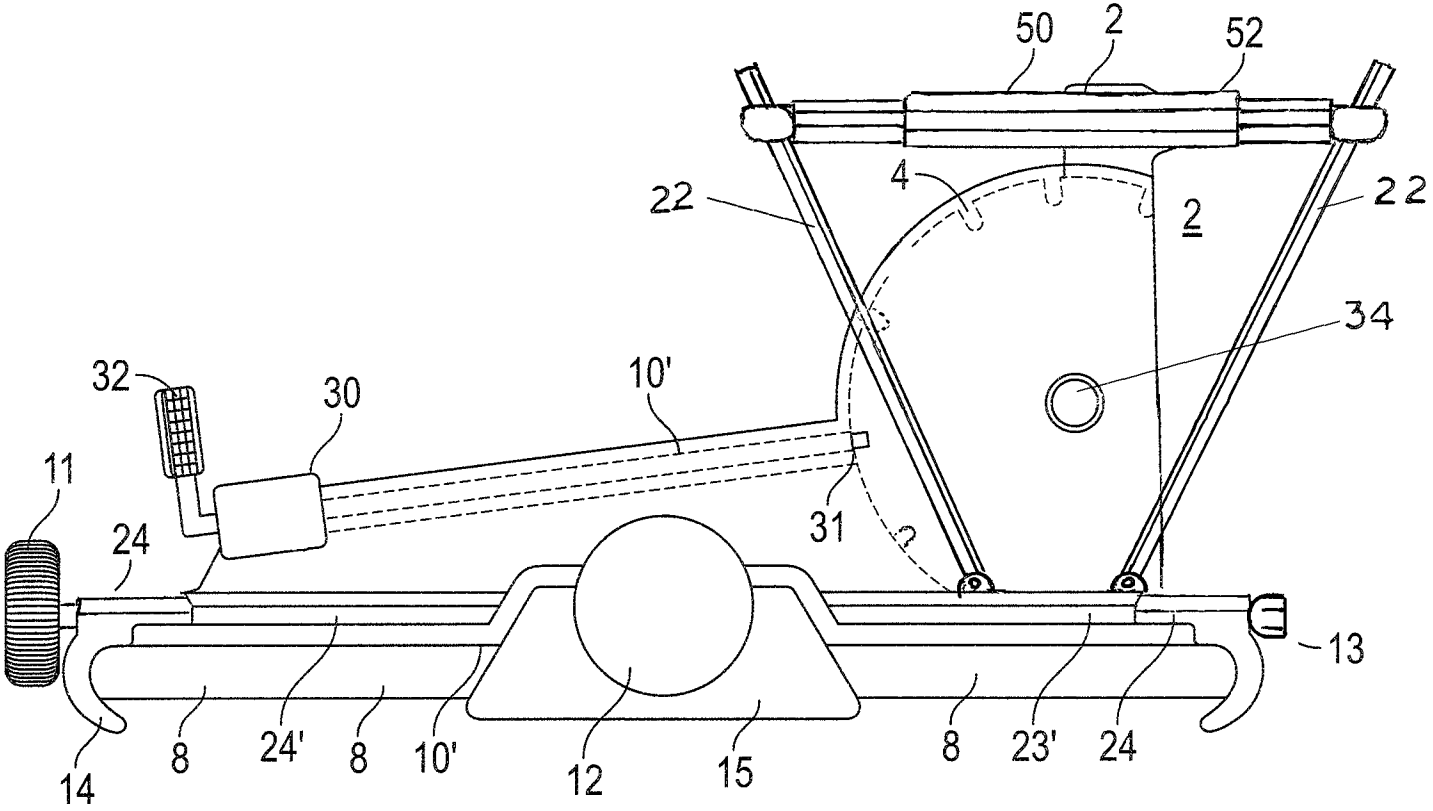
FIG. 19 is a top plan view of the apparatus shown in FIG. 9 with telescopic arms on the device which holds mirrors on the rail mount.

FIG. 19 is a top plan view of the apparatus shown in FIG. 9 with telescopic arms shown in FIG. 15, on the device which holds mirrors on the rail mount.

FIG. 20A is a diagram illustrating the sight lines for mirror adjustments in the embodiments referenced above.

FIG. 20B is alternative diagram diagram illustrating the sight lines for reverse mirror adjustments as referenced in FIG. 20A.

FIG. 20A and FIG. 20B R illustrations depicting pivot points of mirrors 22 and also pivot points on telescopic arms 52 and 54. This illustrates how the mirrors pull the telescopic arms as the devices rotated to the side of the weapon, and as it reaches approximately 90° thereto mirrors 22 automatically achieve the proper angle view for targets. Starting points 1 and 3 on both figures and ending points 2 and 4, the distance between these two points are exactly the same. This design functions to eliminate the need to have the camera lens on the smart phone zoomed out to approximately 2.0, because the camera lens when facing forward can remain at 60°, its normal setting at 1.0.

With respect to FIG. 20A, this diagram illustrates pivot points of mirror 22 when facing forward and rotated to the left side of the weapon. Pivot point 1 of mirror 22 on the right side of the device at the end of the telescopic arm with the device facing forward and telescopic armful extended. Pivot point 2 of mirror 22 on the right side of the device when rotated to the left side of the weapon with telescopic mirror arm pulled in to the stopping point. Pivot point 3 of mirror 22 on the right side of the device when in the forward facing position. Pivot point 4 of mirror 22 on the right side of the device when the devices rotated 90° to the left side of the weapon and the target is being viewed from the left side of the weapon. The length between pivot points 1 and 3, and 2 and 4 are exactly the same, such that as the devices rotated, mirror 22 pulls the telescopic arm inwardly and mirror 22 terminates in the precise position to view the target from the cited the weapon. Pivot point 5 indicates the camera lens on the smart phone.

Referring now to the FIG. 20B, this diagram illustrates pivot points of mirror 22 when facing forward and rotated to the right side of the weapon. Pivot point 1 of mirror 22 on the left side of the device at the end of the telescopic arm with the device facing forward and telescopic armful extended. Pivot point 2 of mirror 22 on the left side of the device when rotated to the left side of the weapon with telescopic mirror arm pulled in to the stopping point. Pivot point 3 of mirror 22 on the left side of the device when in the forward facing position. Pivot point 4 of mirror 22 on the left side of the device when the devices rotated 90° to the right side of the weapon and the target is being viewed from the right side of the weapon. The length between pivot points 1 and 3, and 2 and 4 are exactly the same, such that as the devices rotated, mirror 22 pulls the telescopic arm inwardly and mirror 22 terminates in the precise position to view the target from the cited the weapon. Pivot point 5 indicates the camera lens on the smart phone.

Figure 21A:
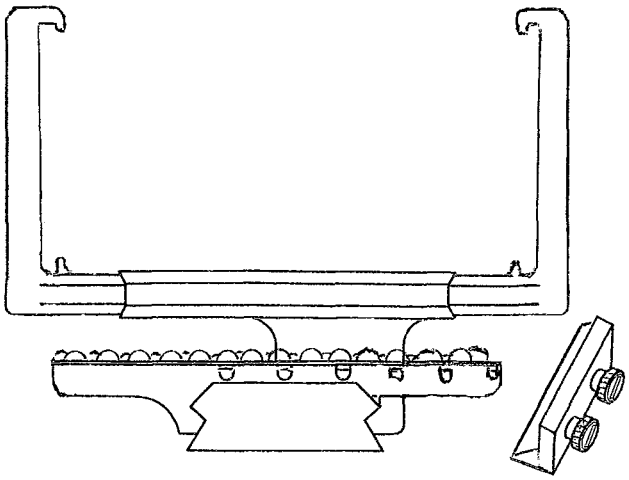
FIG. 21A is an alternative perspective view of the bearing race assembly of the instant invention in conjunction with the rail mount having telescopic arms.

FIG. 21A is an alternative perspective view of the bearing race assembly 40, 41', and 2' of FIG. 12, FIG. 13 and FIG. 14 of the instant invention, and in conjunction with the rail mount having telescopic arms 50, 52, and 54 FIG. 15.

Figure 21B:
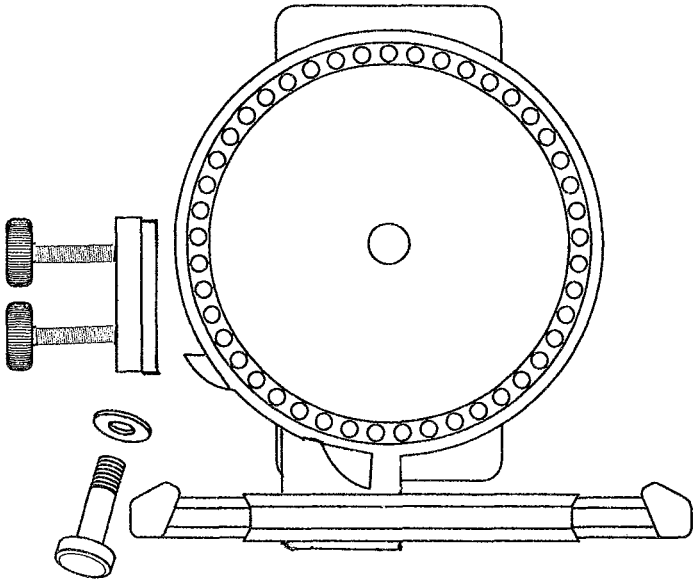
FIG. 21B is an alternative top plan view of the bearing race assembly of the instant invention in conjunction with the rail mount having telescopic arms.

FIG. 21B is an alternative top plan view of the bearing race assembly 40, 41', and 2' of FIG. 12, FIG. 13 and FIG. 14 of the instant invention, and in conjunction with the rail mount having telescopic arms 50, 52, and 54 FIG. 15.

Figure 22:
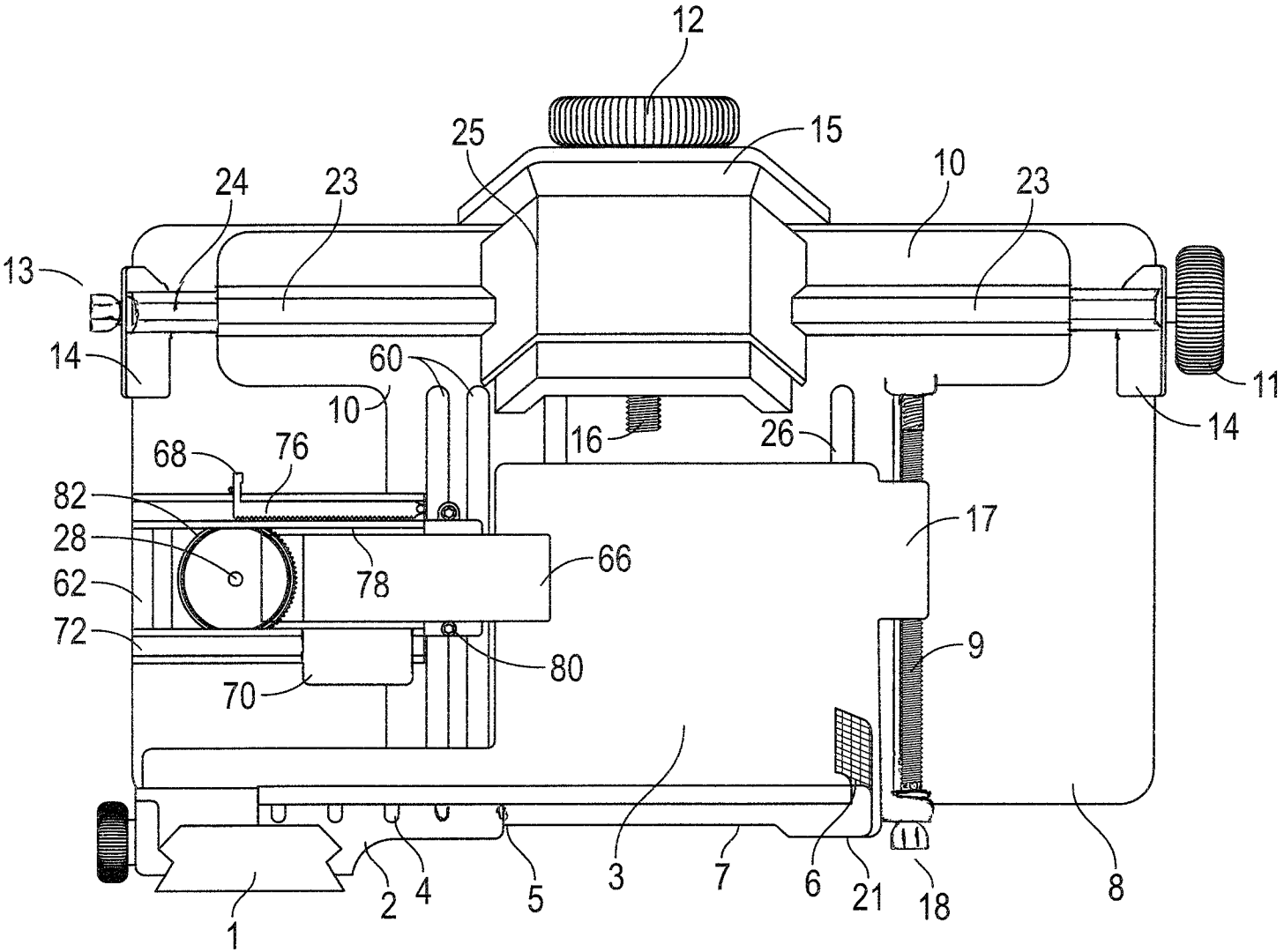
FIG. 22 is a front view of an alternative embodiment of the present invention with a rotating angle adjusting mirror and finger pull assembly illustrating the smart phone mount having adjustable components.

Referring now to FIG. 22, an alternative embodiment is shown which has a rotating angle adjusting mirror that adjusts the angle of the mirror with a finger pull assembly, and rotates the finger pull and mirror assembly from one side of the smart phone camera lens to the other, in order to view targets from either side of the firearm through the gun sights or with sight apps, and allowing the user to view the smart phone screen from any position in relationship to the weapon. FIG. 22 is similar to FIG. 3, and the structure and components of the rotatable and adjustable smart phone mount and plates shown and described in FIG. 3. The differences in this embodiment relates to the components described hereinafter.

The device shown in FIG. 22 is easily adjustable and the rotating mirror only rotates 180° and snaps into and out of two positions with a small ball catch or similar friction catch. A finger pull slides and adjusts within its own track, and the mirror and finger pull are connected to one another with a small arm that works as a leaver. Finger pull has a track on the side in which a small pin or slide rides within, such that as one would pull the finger pull back on the track the mirror quickly flips over to the angle where the mirror needs to be adjusted to view the target with the smart phone set at different angles. This device begins working with the smart phone set at about 45° with the zoom set at 2.0. In order to view the target and the surrounding area in the smart phone at a full setting of 1.0 and no zoom, the smart phone must be positioned closer to 90°.

Another device located at the base of the mirror consists of a lengthwise flat gear that rotates the mirror assembly with a second gear that extends halfway around the base of the mirror, and which rotates the mirror assembly 180° and snap-locks into position with a small fraction or ball catch as the device is rotated and the target is being viewed from the left side of the weapon.

FIG. 22 is a front view which illustrates the device with the rotating mirror assembly. In this embodiment, mount plate 10 includes two tracks 60 within which the pivoting and rotating mirror assembly rides on for vertical adjustment. The pivoting and rotating mounting base 62 is shown in conjunction with the small friction or ball catches 64. These allow the mirror 66 to snap into and out of 180° when the mirror base is actuated by handle 68 on the straight sliding gear that rotates the mirror base through 180° on the gear that extends around the rotating mirror base. Finger pull 70 includes an internal track that is connected to an arm of the mirror that flips over and adjusts the angle of the mirror. Finger pull 70 slides within track 72 and adjusts the angle of the mirror, as well as controls the flipping of the rotating and adjustable mirror 22 from one side to the other. Tensioning screw 74 adjust the tension spring within the housing that adjusts the friction plate and ball slide between the finger slide and track, and keeps the mirror and adjustment while the firearm is in use, as well as during recoil. Slide gear 76 rotates the mirror base. Gear teeth 78 on slide gear 32 and one-half of the rotating mirror base as shown engage one another and rotate mirror 66 when activated by handle 68. Smart phone camera lens 28 is shown in a centered position. Brackets 80 include set screws that lock the rotating adjustable mirror assembly in the desired position. The angle adjusting mirror, as well as the angle adjusting finger pull and track, rotate upon rotating collet 82.

Figure 23:
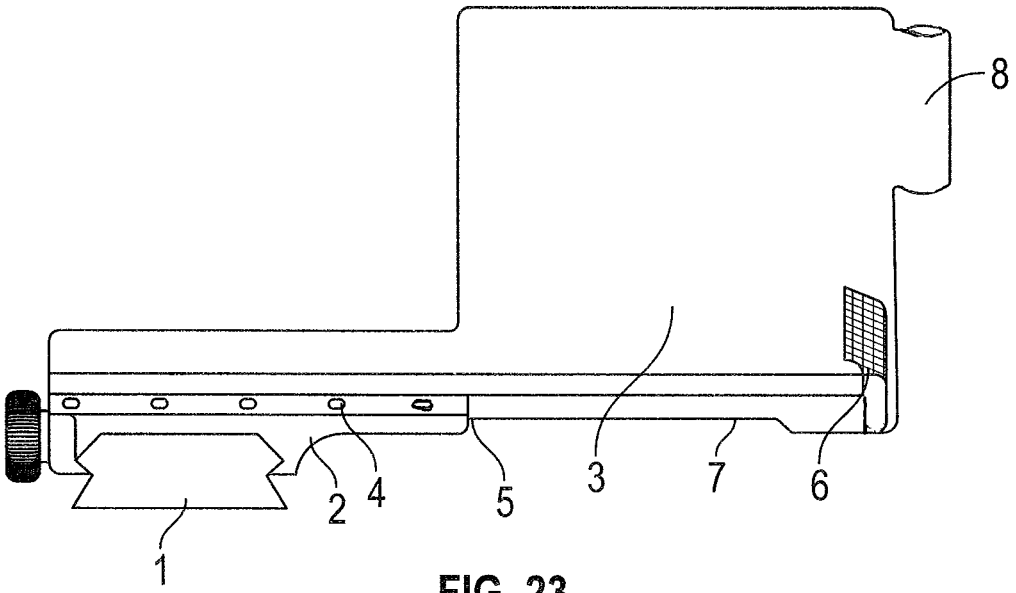

FIG. 23 is a front view, which is similar to the structure shown and described in FIG. 5 with the mirror assemblies removed, illustrating mount plate 3 in this embodiment.

Figure 24:
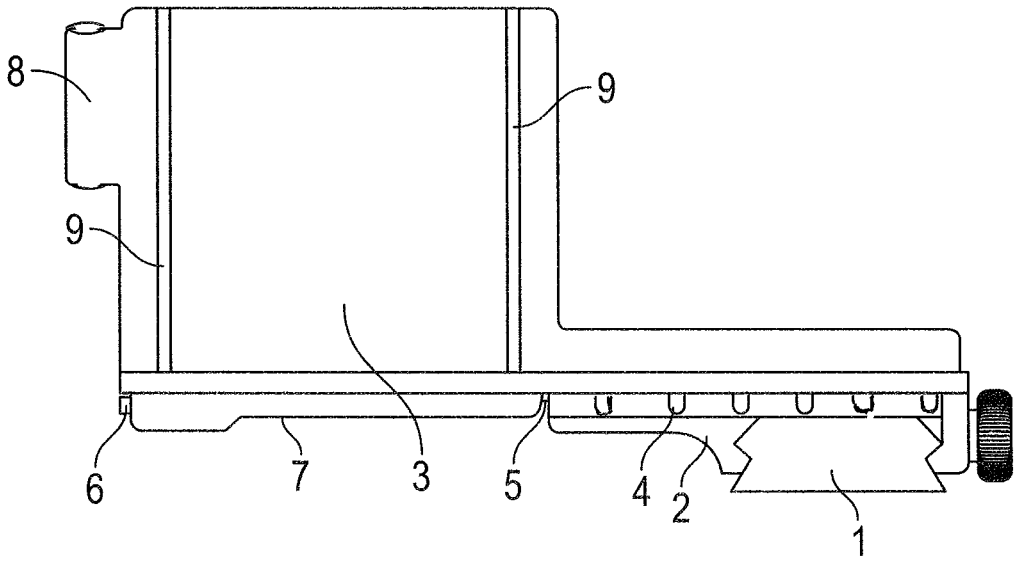
FIG. 24 is a view of the backside of the apparatus shown in FIG. 23.

FIG. 24 is a back side view, which is similar to the structure shown and described in FIG. 6 with the mirror assemblies removed, illustrating mount plate 3 in this embodiment.

Figure 25:
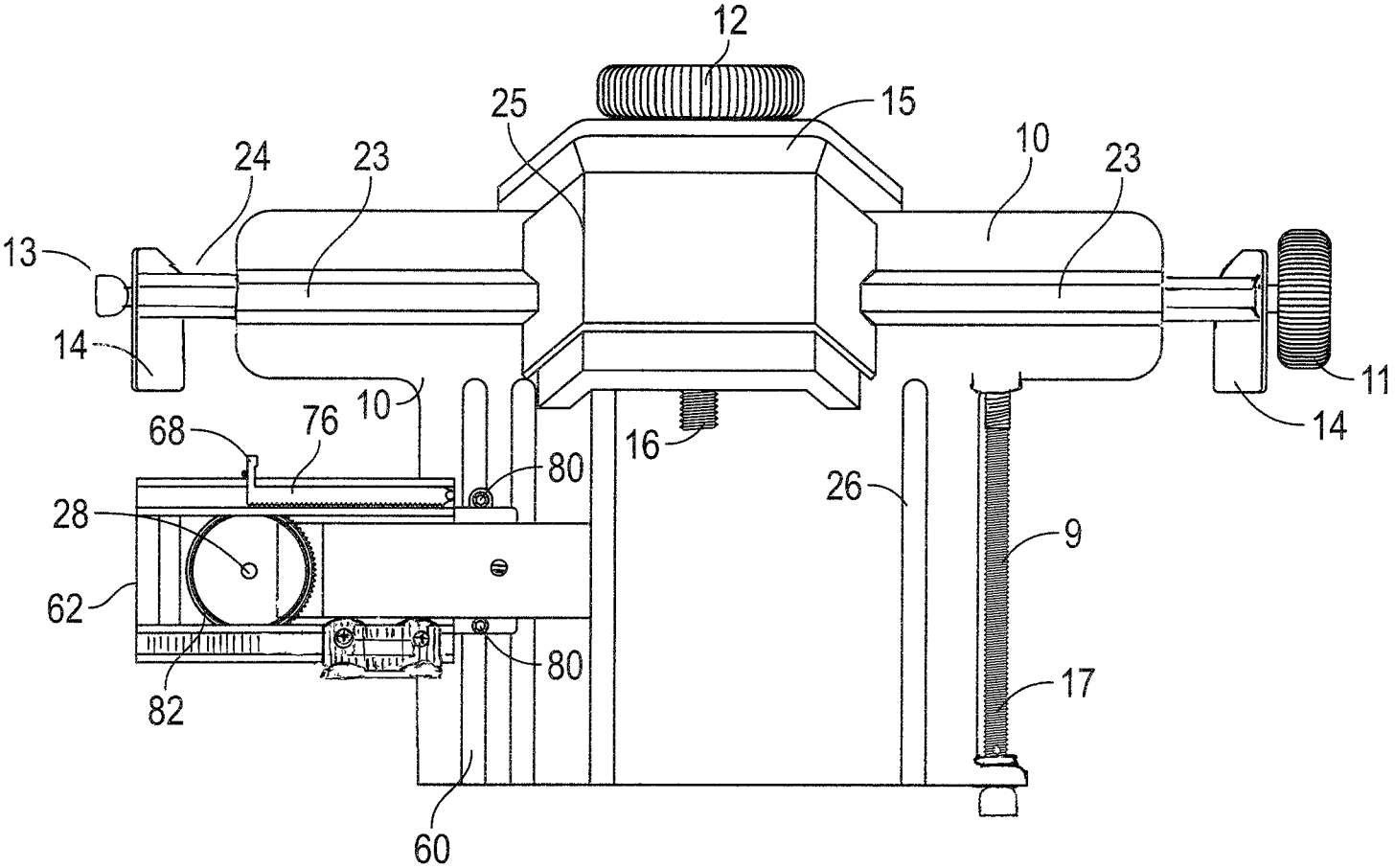
FIG. 25 is a front view of the smart phone mounting bracket of FIG. 22 along with the rotating angle adjustable mirror assembly.

FIG. 25 is similar to the structure shown and described in FIG. 7, and is a front view of the smart phone mounting bracket described in conjunction with FIG. 22, along with the rotating and adjustable mirror and finger pull assemblies.

Figure 26:
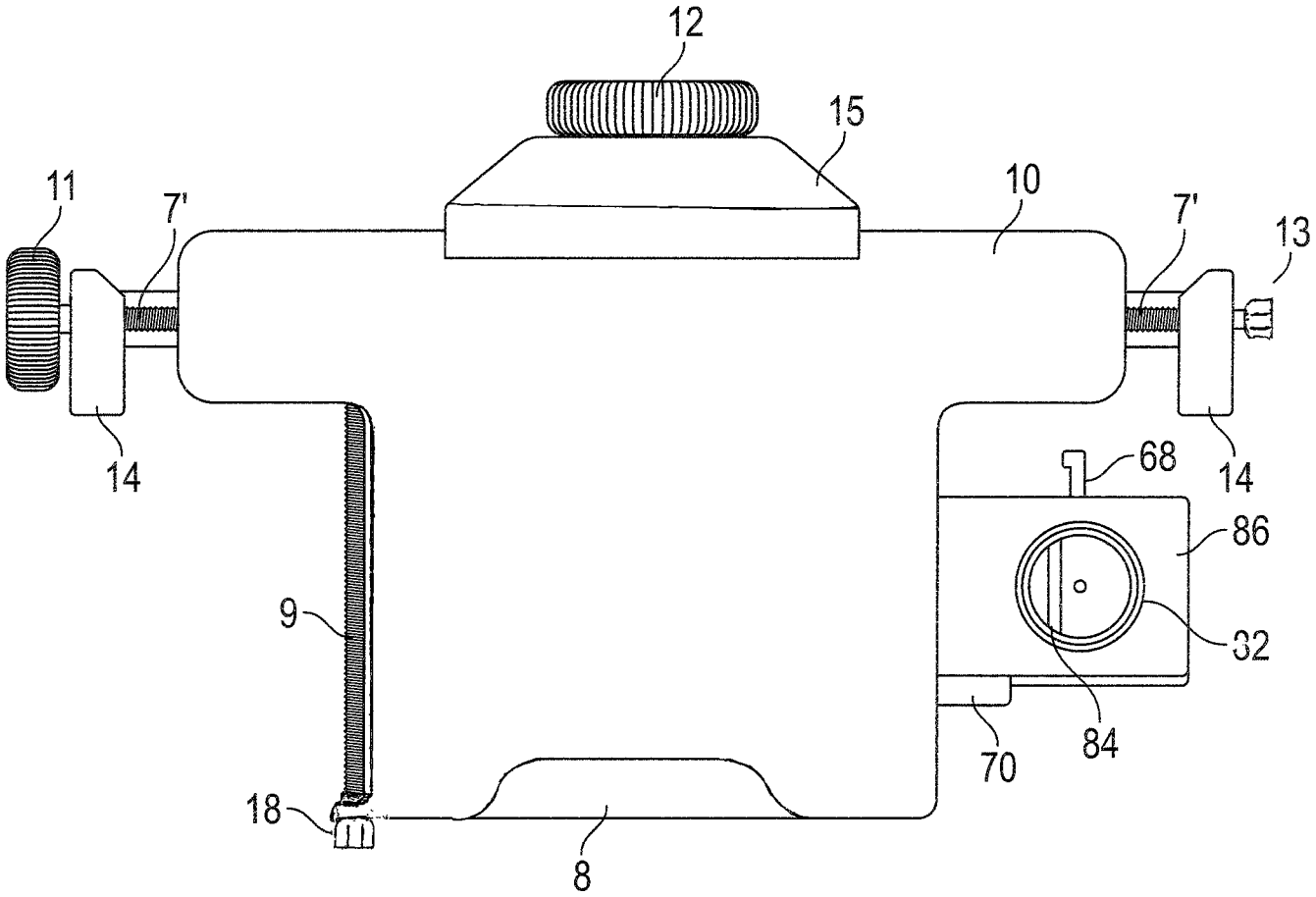
FIG. 26 is the backside view of the apparatus shown in FIG. 25.

FIG. 26 is the backside view of the apparatus shown in FIG. 25, and the plate the smart phone mounts to in the cradle, is secured, and laterally adjusts upon this plate. Pivot point 84 is for the rotating angle adjusting mirror, and is where the mirror attaches to the rotating collet or bearing. Backside 86 is shown for the pivoting, rotating mirror mounting base 62.

Figure 27:
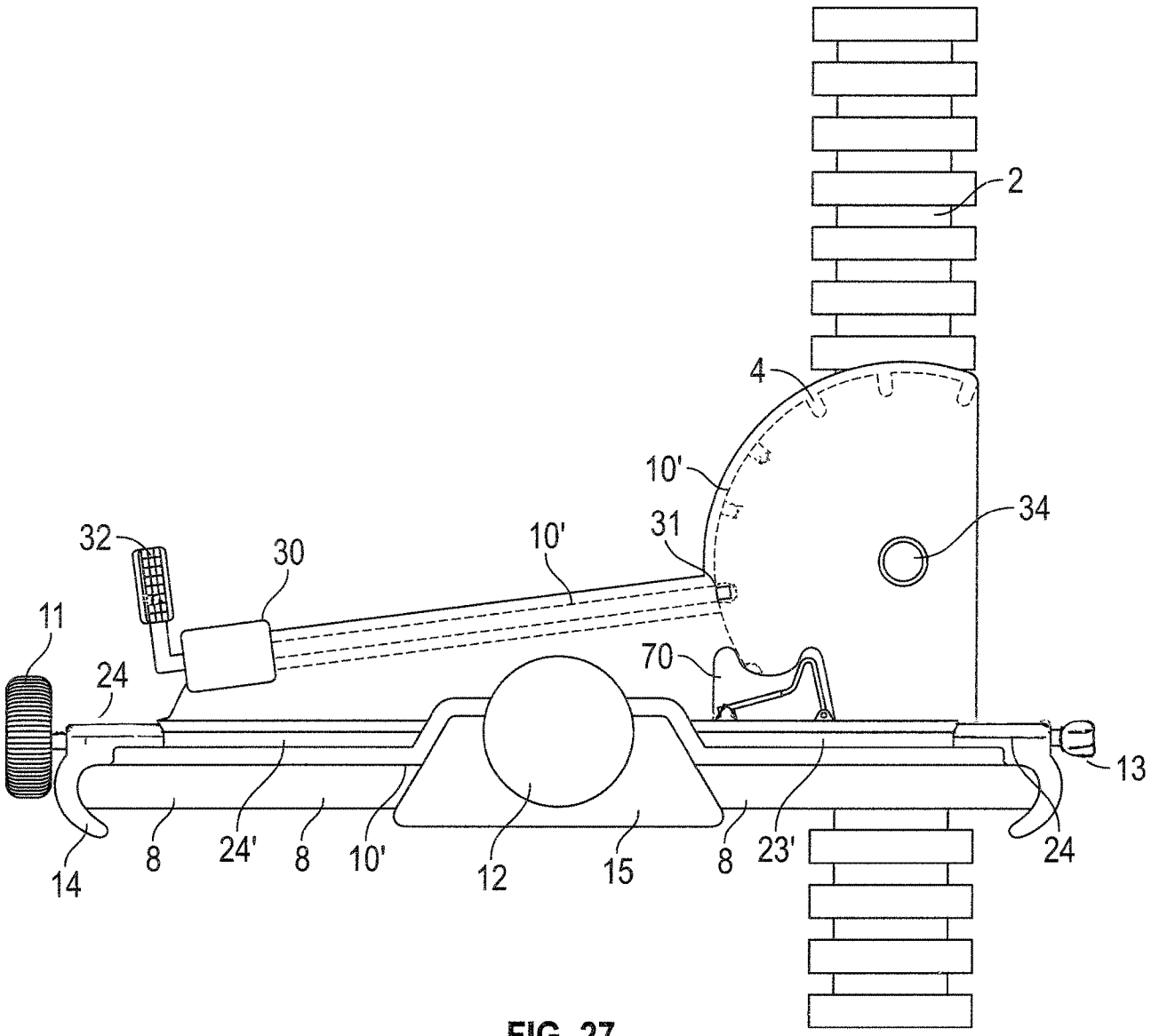
FIG. 27 is a top plan view of the alternative embodiment shown in FIG. 22 illustrating the improved rotatable smart phone mount, components, and phone secured thereto, when viewing a target in the conventional manner in conjunction with a rifle barrel and rail.

FIG. 27 is a top plan view similar to the structure shown and described in FIG. 9, however, with the mirror and finger pull assemblies of FIG. 22. In this illustration, finger pull 70 would be in a position where the mirror for this device would not be in operation and the finger pull is in a starting position. Internal track 88 of the finger pull connects to the arm on the mirror that flips over and adjusts the angle of the mirror. A small pin or bearing on this arm rides in track 88 connecting the arm into the internal track 88 of finger pull 70.

Figure 28:
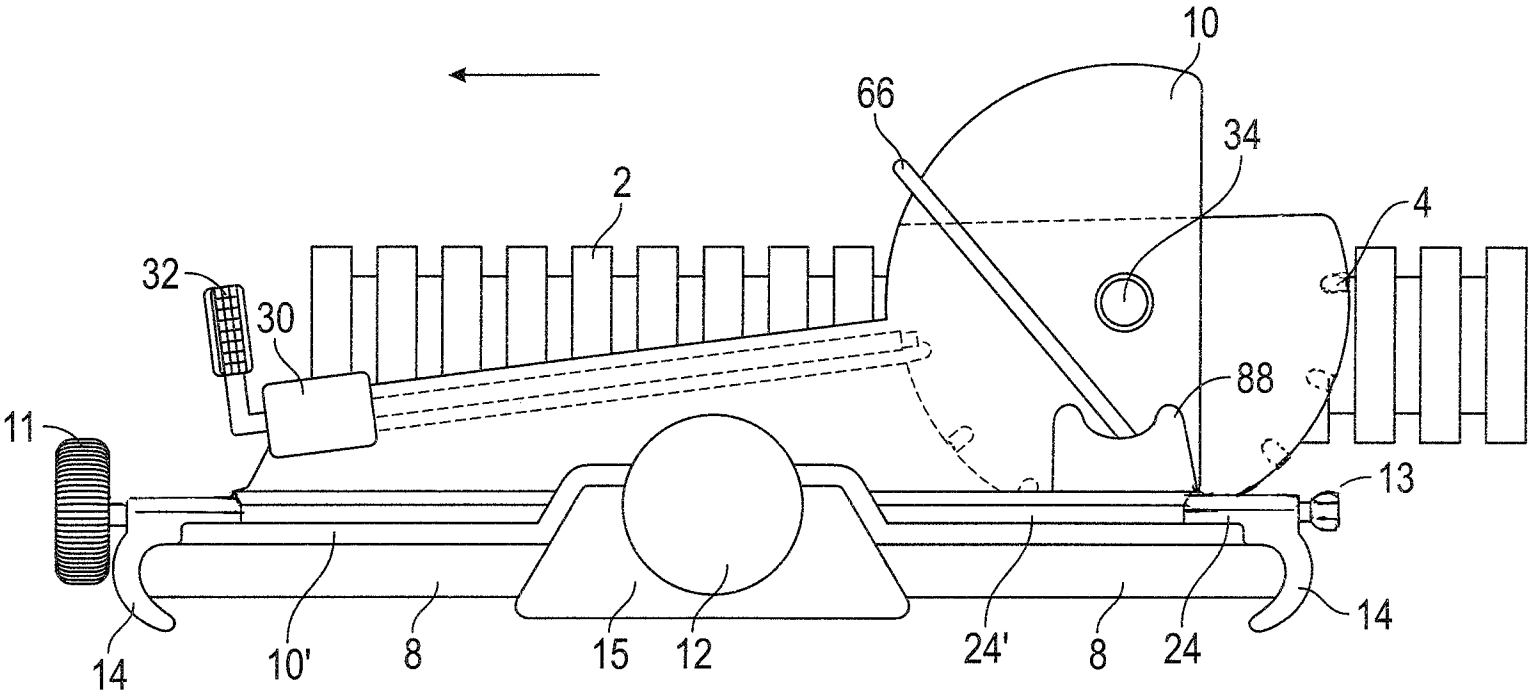
FIG. 28 is a top plan view of an alternative embodiment of the present invention illustrating the improved rotatable smart phone mount, components, and phone secured thereto, when viewing a target in an unconventional manner in a position of the user standing perpendicular to a rifle barrel and rail.

FIG. 28 is alternative top plan view of the apparatus and novel mount and mechanical components shown in FIG. 27, illustrating the improved rotatable smart phone mount, components, and phone secured thereto, when viewing a target in an unconventional manner in a position of the user standing perpendicular to a rifle barrel and rail. The smart phone mounting assembly has rotated to the left side of the firearm and locked into this position, and is now parallel to the gun rail mount 2. The camera lens now views reflected images from mirror 66 and through the rifle sights or scope.

Figure 29:
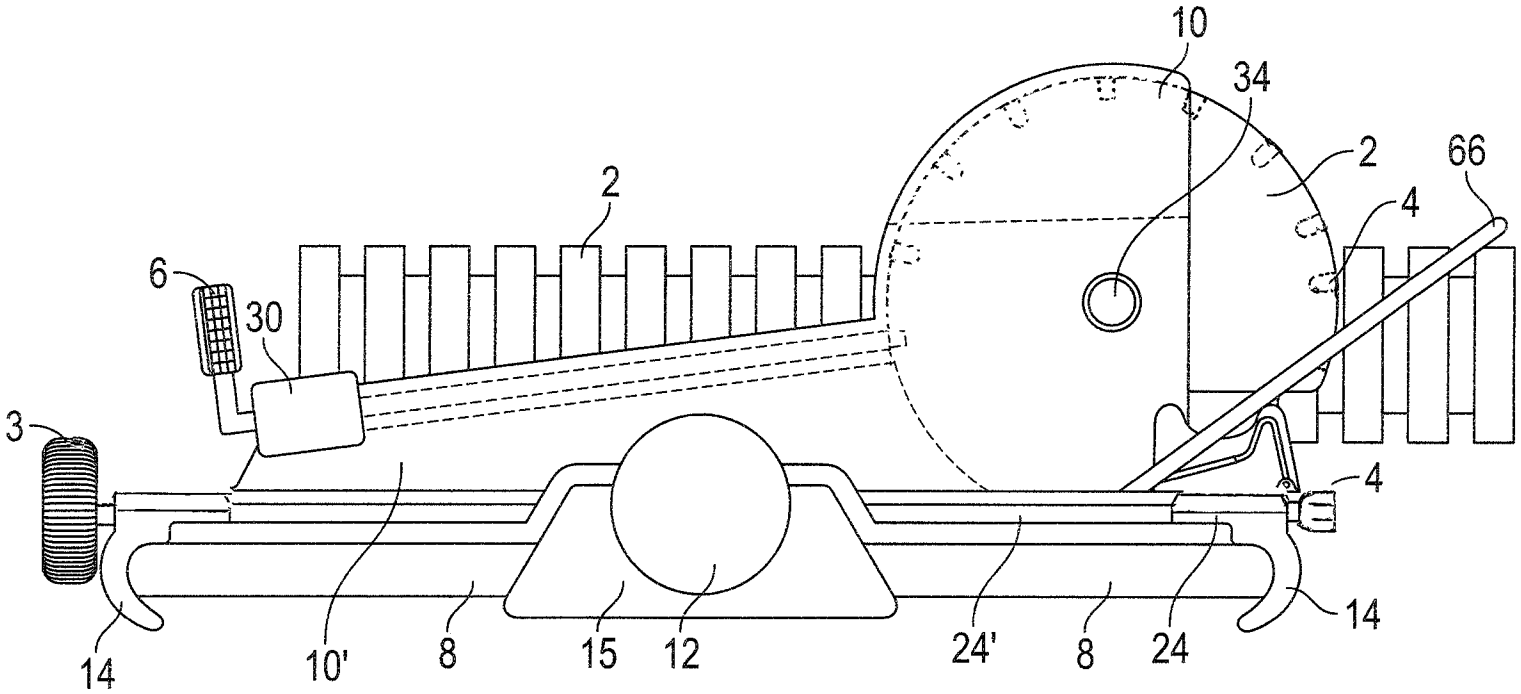
FIG. 29 is alternative top plan view when viewing a target in an unconventional manner in a position of the user standing perpendicular to a rifle barrel and rail, opposite to that of FIG. 28.

FIG. 29 is alternative top plan view of the apparatus and novel mount and mechanical components shown in FIG. 27, illustrating the improved rotatable smart phone mount, components, and phone secured thereto, when viewing a target in an unconventional manner in a position of the user standing perpendicular to a rifle barrel and rail. In this position the finger pull has flipped the mirror over after riding in the internal track and has been adjusted to view targets from the right side of the firearm. The smart phone mounting assembly has rotated to the right side of the firearm and locked into this position, and is now parallel to the gun rail mount 2. The camera lens now views reflected images from mirror 66 and through the rifle sights or scope.

Figure 30:
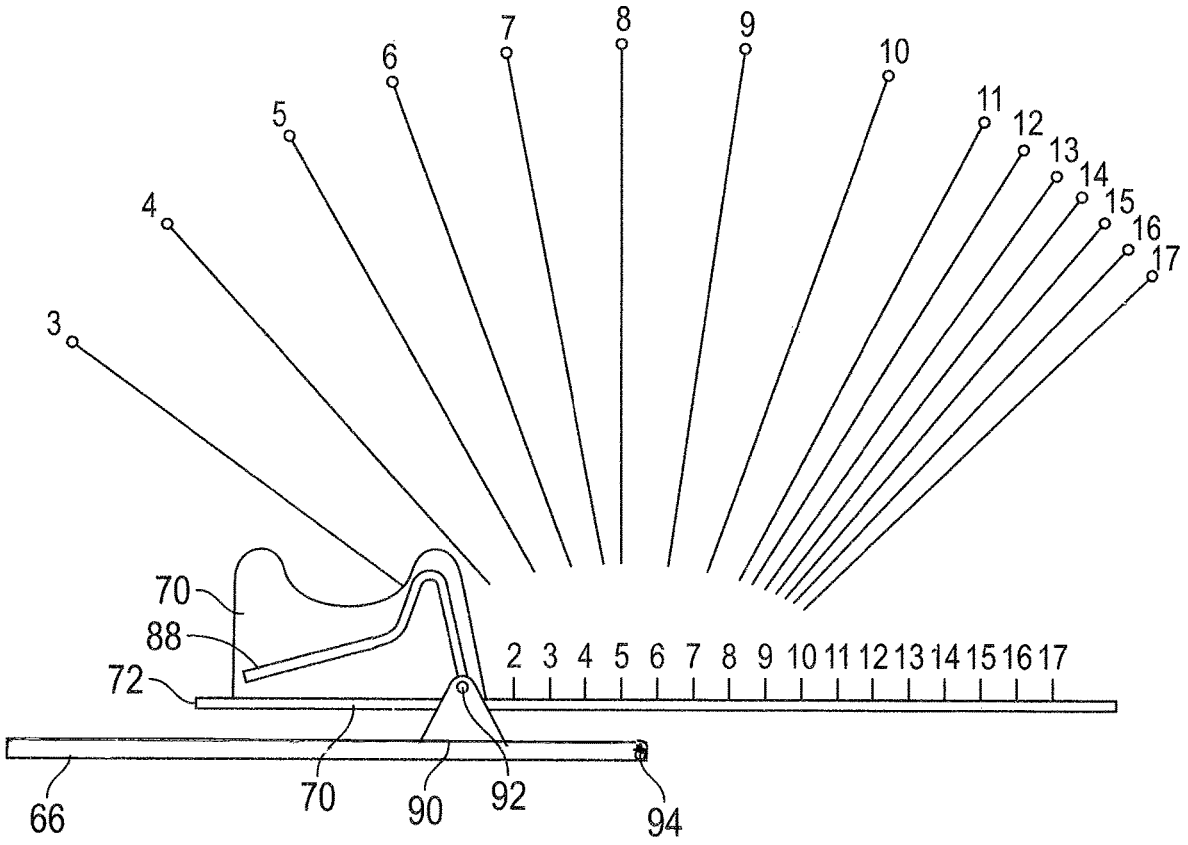
FIG. 30 is diagram depicting the finger pull movement and related angular rotation of the mirror assemblies of FIG. 22.

FIG. 30 is diagram depicting the range of the finger pull 70 movement and related angular rotation of mirror 66. This illustrates the finger pull that rides upon its own longitudinal track 72, along with the internal track 88 that mirror pin or bearing 92 rides within. Pin 92 is secured to mirror arm 90 as indicated. Mirror 66 pivots about point 94 as the mirror is adjusted for movement of arm pin 92 through internal track 88 as the finger pull is moved lengthwise about its track. The mirror assembly rotates 180° on its mounting base along with the mirror arm, and the diagram indicates the angle of adjustment for the mirror with radius positions 1 through 17. Also illustrated is the corresponding related positions 1 through 17 of the finger pull along its track in conjunction with the positions of mirror 66. The sharp rise of track 88 and following drop off and subsequent decreasing linear section of track 88 controls the desired movement, and the highest point at which the mirror is "flipped" over and adjustment starts where this track graduates to a lesser degree of angle subsequent to the flipping of the mirror. The geometry and design of internal track 88 control the desired movement of mirror 66 through the positions referenced above.

Figure 31:
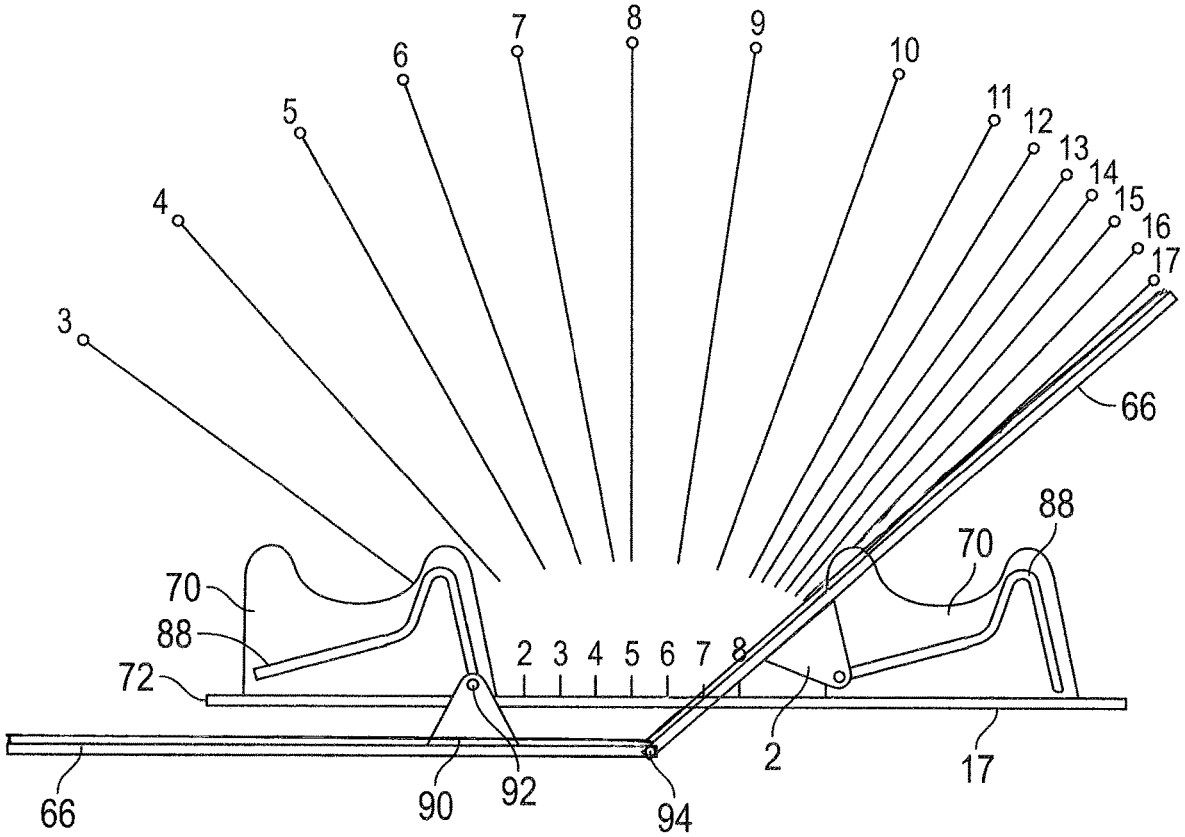
FIG. 31 is a diagram depicting the finger pull movement and related angular rotation of the mirror assemblies from the position set forth in FIG. 30 through the opposite extreme position.

FIG. 31 is a diagram depicting the finger pull movement and related angular rotation of the mirror assemblies from the position 1 set forth in FIG. 30 through the opposite extreme position 17.

Figure 32:
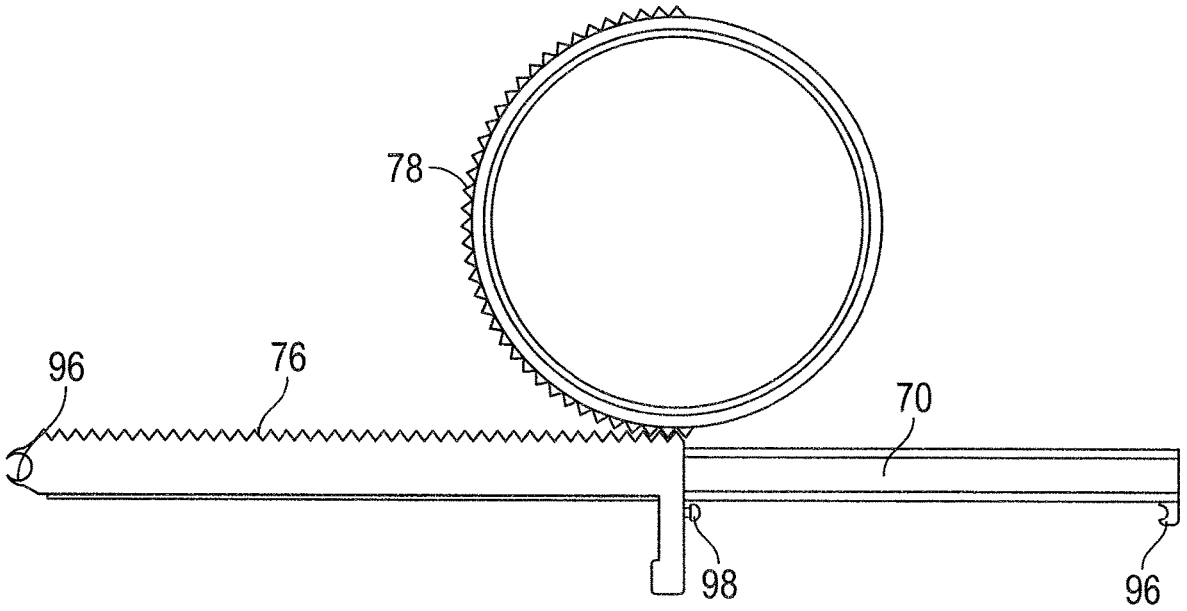
FIG. 32 is an enlarged front view of the gear and track assemblies of FIG. 22.

FIG. 32 is an enlarged front view of the gear and track assemblies of FIG. 22. Straight sliding gear 76 is used to rotate the angle adjusting mirror assembly as well as the base and gear teeth 78 for the rotating mirror and finger assembly, the teeth of which both the sliding gear and base interlock and mesh as the finger pull is moved to desired positions. Gear 78 and its teeth are positioned in a semicircular fashion halfway around the rotating mirror assembly base. Its teeth interlock with those of flat gear 76 as it slides and locks into different positions 180° to one another. Track 72 is integral to the mirror assembly platform that flat gear 76 rides within. Ball catch 98 locks the mirror assembly into position when the mirror is fully rotated. Female ball catches 96 lock the mirror assembly into the opposing positions as indicated, and correspond to viewing targets conventionally as well as unconventionally as described above.

FIG. 33A is an enlarged backside view of the platform that the adjusting mirror assembly is mounted upon as shown in FIG. 22. The platform for the rotating mirror assembly is mounted to tracks 100 and adjusts vertically therein as seen in FIG. 22. Set screws 102 locked the vertical adjusting mirror assembly into position at desired locations. Backside 104 of the pivoting, rotating mirror mounting base is essentially the platform for the entire mirror assembly. Bottom 106 of the finger pull which is used to adjust and flip mirror 66. Handle 106 of the flat gear is also in view.

FIG. 33B is an enlarged front view of the adjusting mirror assembly of FIG. 25, mounted upon the platform of FIG. 33A, and gear components. Spring assemblies and screw adjustments 110 provide attention to increase or decrease the drag or force between the finger pull, its teeth and track for optimal operation.

Figure 34:
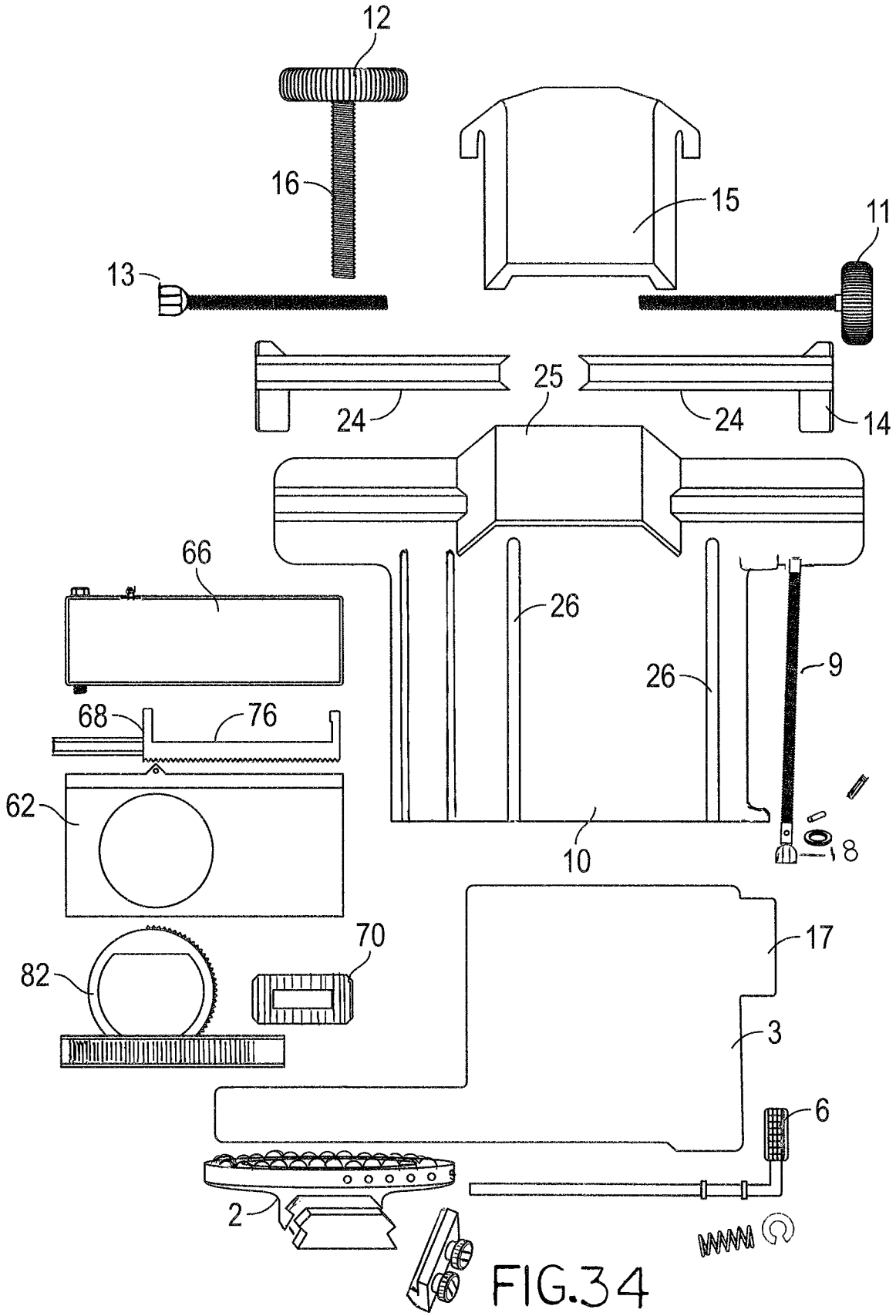
FIG. 34 is an exploded perspective assembly view of the apparatus shown in FIG. 22

FIG. 34 is an exploded perspective assembly view of the rotating and adjustable smart phone mount, platforms, and mirror assemblies as illustrated in FIG. 22 and others, and as described above.

Figure 35:
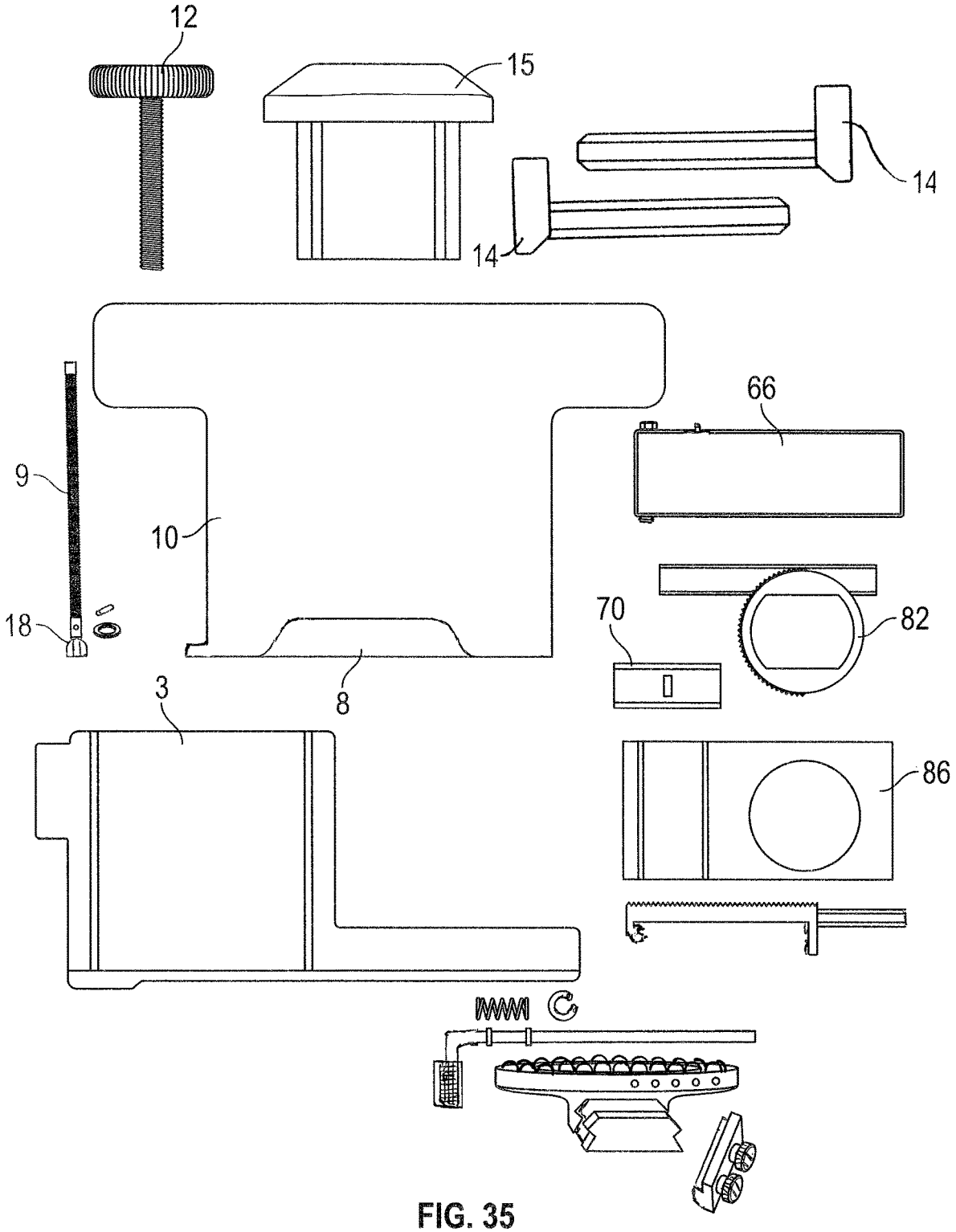
FIG. 35 is an exploded perspective assembly view of the apparatus shown in FIG. 24 and FIG. 26.

FIG. 35 is an exploded perspective assembly view of the rotating and adjustable smart phone mount, platforms, and mirror assemblies as illustrated in FIG. 24, FIG. 26, and others.

Figure 36:
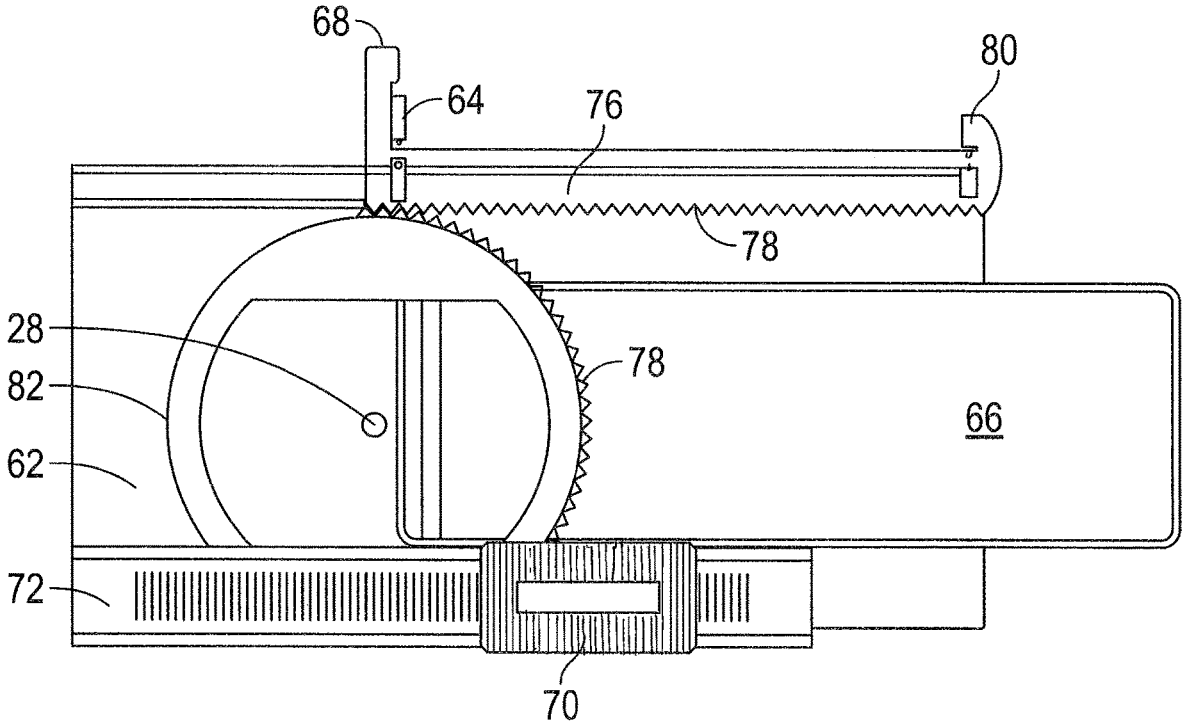
FIG. 36 is an enlarged front view of the rotating and adjustable mirror assembly of FIG. 22.

FIG. 36 is an enlarged front view of the rotating and adjustable mirror assembly of FIG. 22.

Figure 37:
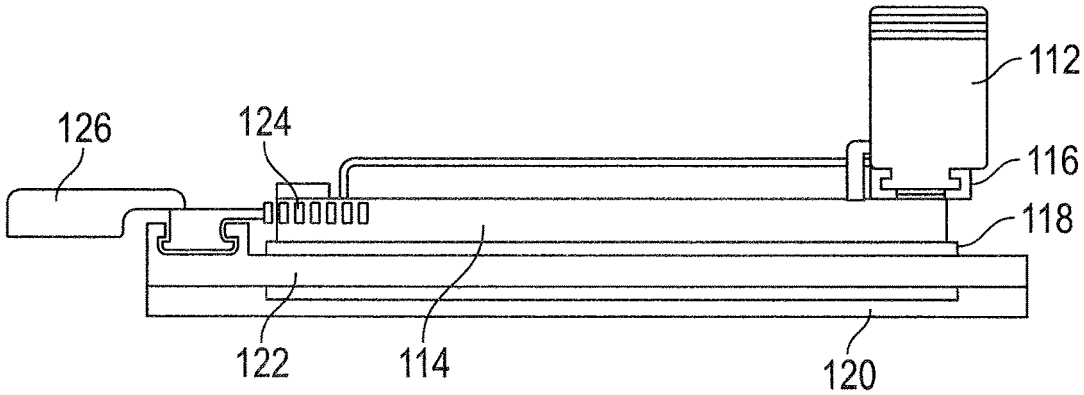
FIG. 37 is an enlarged side view of the rotating and pivoting mirror assembly.

FIG. 37 is an enlarged side view of the rotating and pivoting mirror assembly. Finger pull 112 is shown within collet 114 and collet track 116. Upper lip 118 and lower lip 120 of collet 114 are shown, along with stationary plate 122 which provides for vertical adjustment of the unit. Teeth 124 at the base of the rotating collet 114 that the mirror assembly pivots and rides in and which the finger pull track is a part thereof. Tracks are on the bottom of the mirror assembly that and mirror assembly vertically adjusts on these tracks. Collet 114 rotates on the stationary plate, which again provides for vertical adjustment. Finger pull 126 operates in conjunction with the bar or strap year described above to rotate the mirror assembly through 180° and locks the mirror to each side of the camera lens.

Figure 38A:
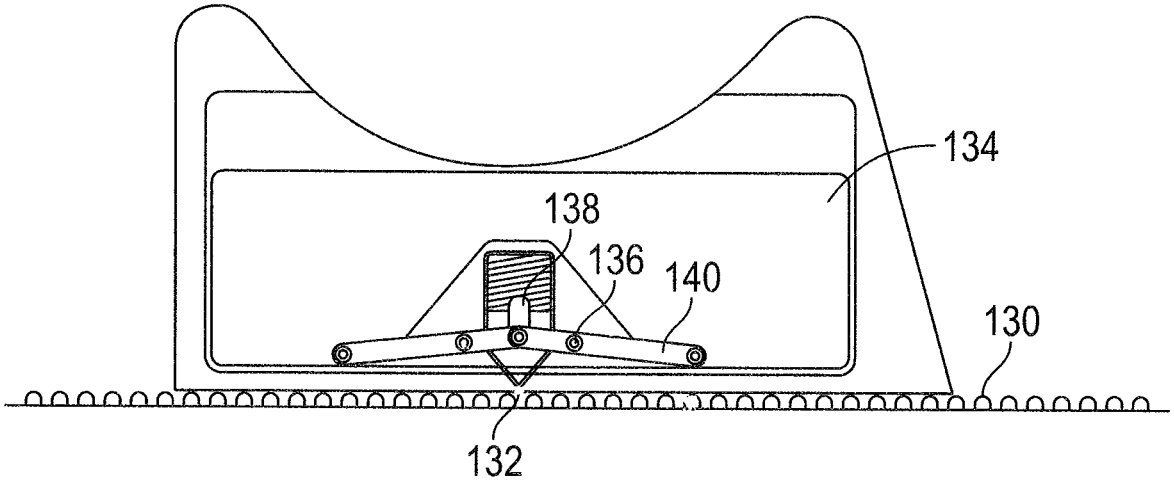
FIG. 38A is a side view the finger pull button assembly in a disengaged position.

FIG. 38A is a side view the finger pull button assembly in a disengaged position. The button 128 is shown in a disengaged position such that it is removed from gear teeth 130 at its teeth engagement point 132. Button or slide 134 is shown as the finger pull is pushed downwardly, and disengages the button tooth 132 through pivot points 136 and spring 138.

Figure 38B:
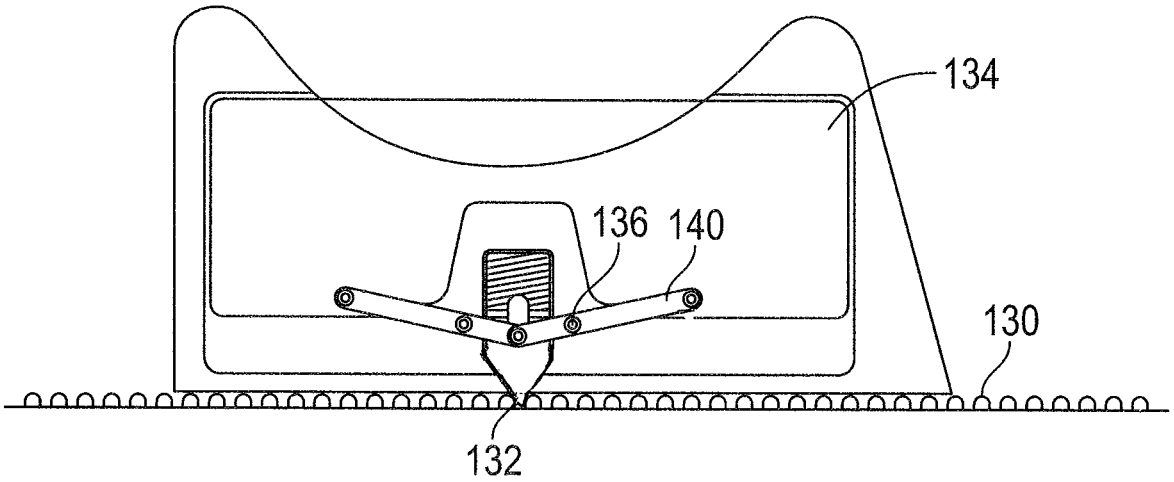
FIG. 38B is a side view the finger pull button assembly in an engaged position.

FIG. 38B is a side view the finger pull button assembly in an engaged position. As button 128 is released from the position shown in FIG. 38A, spring 138 forces lever arms 140 downwardly about pivot points 136, and forcing finger pull teeth 132 to engage gear teeth 130. In this manner, the finger pull locks into place along its track at any desired position.

Figure 39:
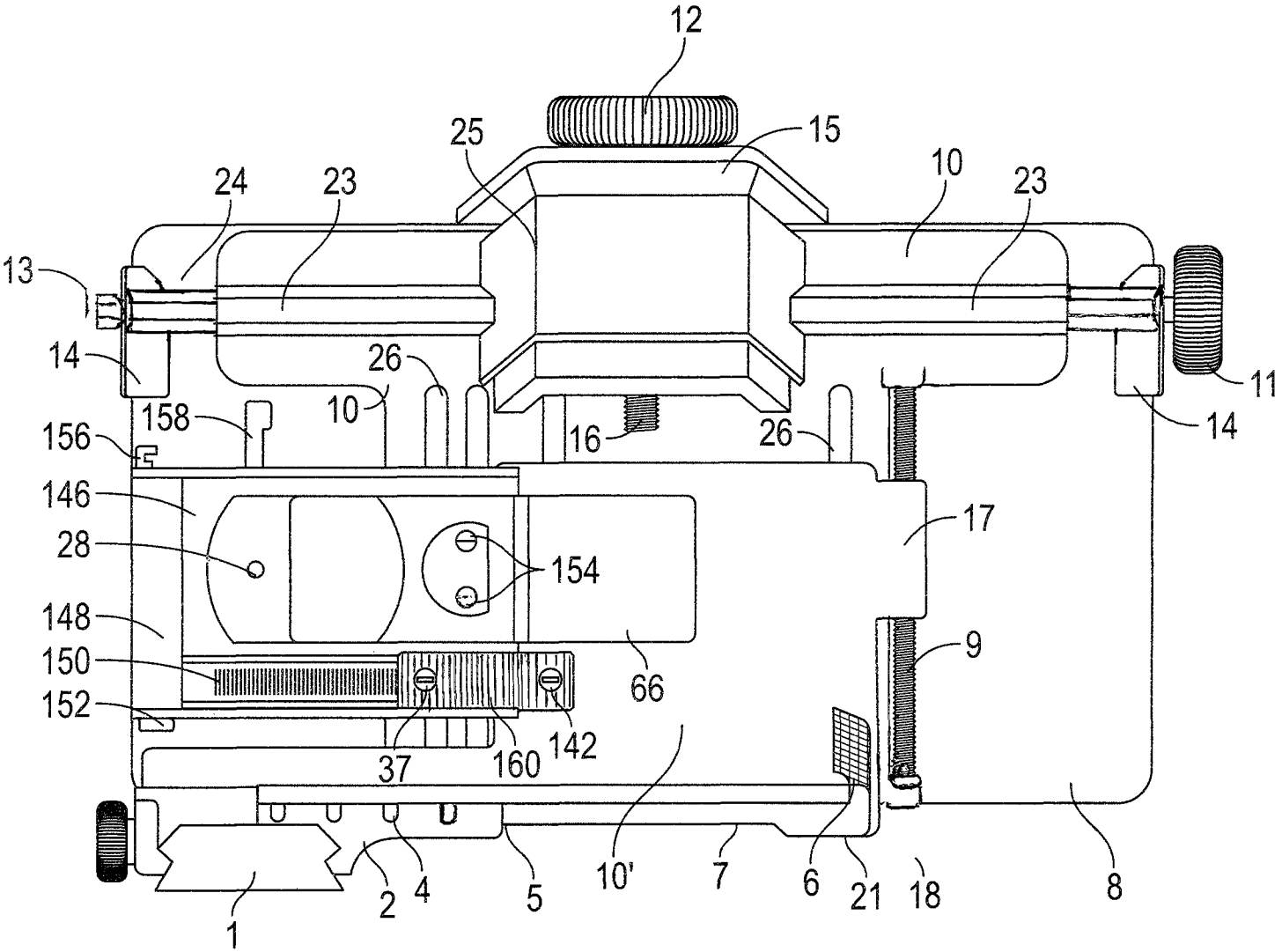
FIG. 39 is a front view of an alternative embodiment of the present inventions with finger pulls, cammed track, and sliding and flipping mirror assemblies illustrating the smart phone mount having adjustable components.

FIG. 39 is a front view of an alternative embodiment of the present inventions with finger pulls, cammed track, and sliding and flipping mirror assemblies illustrating the smart phone mount having adjustable components. The primary smart phone mount plates, lateral and vertical adjustment mechanisms are the same as those shown and described in FIG. 22; however, in this embodiment the finger pulls, cammed track, and sliding and flipping mirror assemblies are different as described hereinafter. An angle adjusting mirror has a finger pull with a cammed track that an arm and finger pull on the mirror rides within and adjusts the mirror angle, and also flips the mirror over and adjust the angle of the opposite side with an additional finger pull that slides and locks the mirror assembly into positions on each side of the smart phone camera lens to view targets on each side of the firearm as in other embodiments. Finger pull 144 includes the internal spring-loaded friction pad 142 which adjusts the friction or drag between the finger pull on the track in the same fashion as the finger pull mechanisms described above. Pivoting mirror assembly base 146 slides back and forth into two primary positions on track 148. Finger pull track 150 allows finger pull 144 to slide back and forth and on angle of the mirror 66, as well as controls the flipping mechanism for the mirror. Stop 152 limits the finger pull in proper position to flip the mirror over automatically with a finger pull remaining in this position. Stop 153 works in conjunction with stop 152. This assembly also includes set screws 154 that lock the pivoting, angle adjusting mirror and finger pull assembly in place once vertical adjustment is completed. The set screws are integral to the assembly. Ball catches 156 locked the sliding mirror assembly into proper positions on each side of the smart phone camera lens. Finger pull 158 is utilized to slide and lock the mirror assembly into proper position. Spring-loaded ball mechanism 160 housed internally in finger pull 144 adjusts tension to work in conjunction with corresponding ribbed or rippled areas in the center of the track for the finger pull.

Figure 40A:
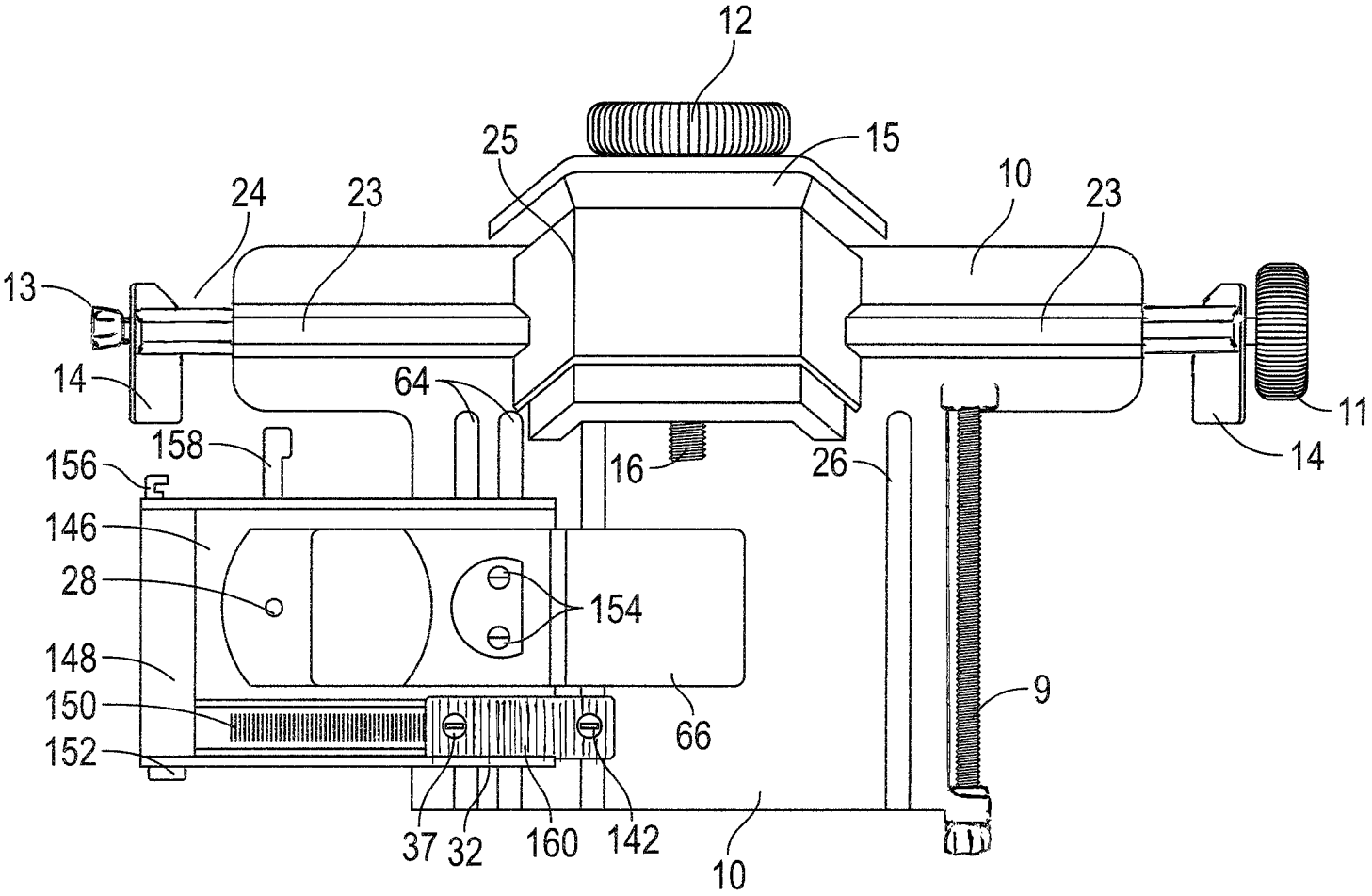
FIG. 40A is a front view of the smart phone mounting bracket of FIG. 22 along with the finger pulls, cammed track, and sliding and flipping mirror assemblies of FIG. 39.

FIG. 40A is a front view of the smart phone mounting bracket of FIG. 22 along with the finger pulls, cammed track, and sliding and flipping mirror assemblies of FIG. 39.

Figure 40B:
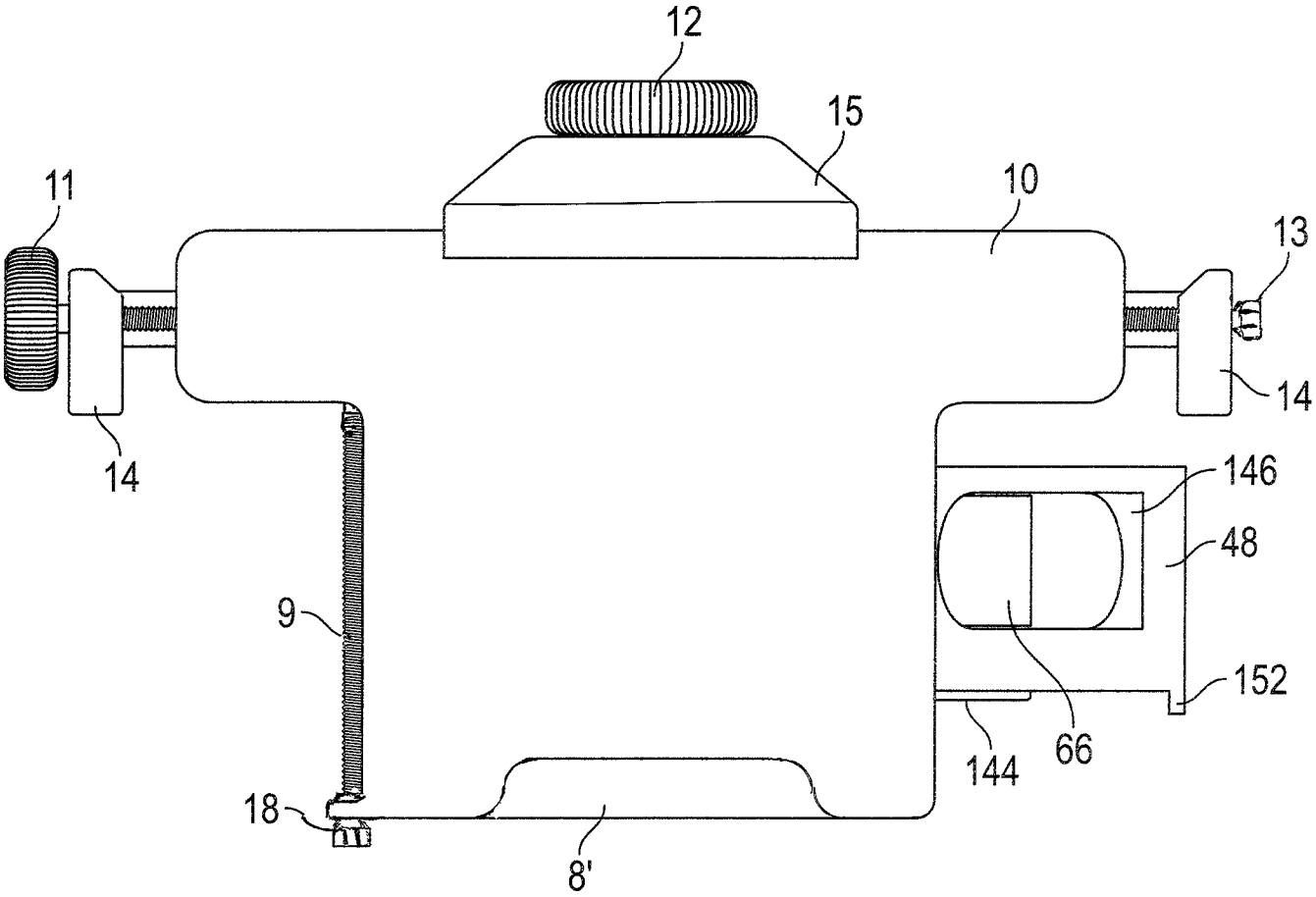
FIG. 40B is the backside view of the apparatus of FIG. 25, along with the finger pulls, cammed track, and sliding and flipping mirror assemblies of FIG. 39.

FIG. 40B is the backside view of the apparatus of FIG. 25, along with the finger pulls, cammed track, and sliding and flipping mirror assemblies of FIG. 39.

Figure 41:
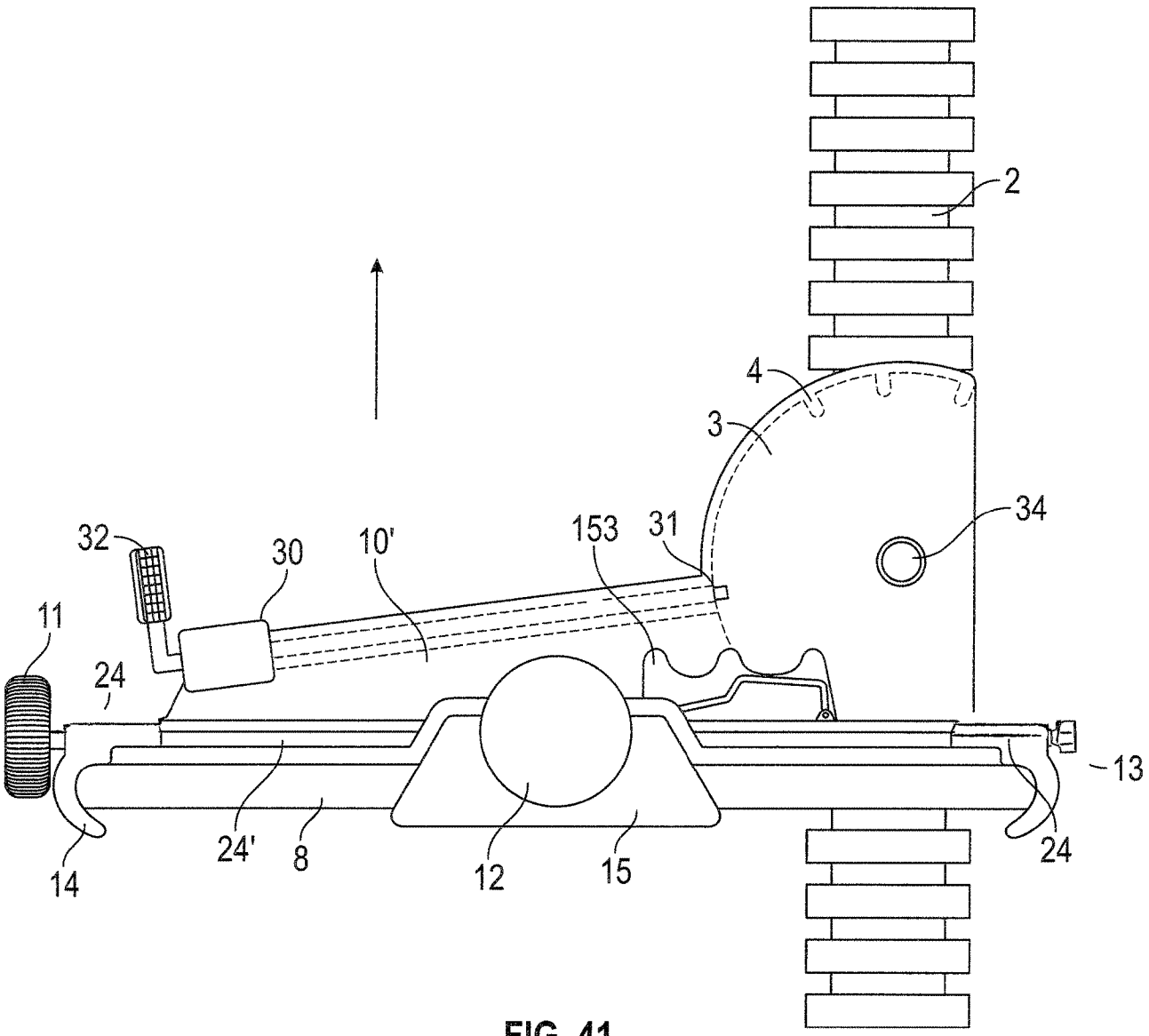
FIG. 41 is a top plan view of the apparatus of FIG. 27, along with the finger pulls, cammed track, and sliding and flipping mirror assemblies of FIG. 39.

FIG. 41 is a top plan view of the apparatus of FIG. 27, along with the finger pulls, cammed track, and sliding and flipping mirror assemblies of FIG. 39.

Figure 42:
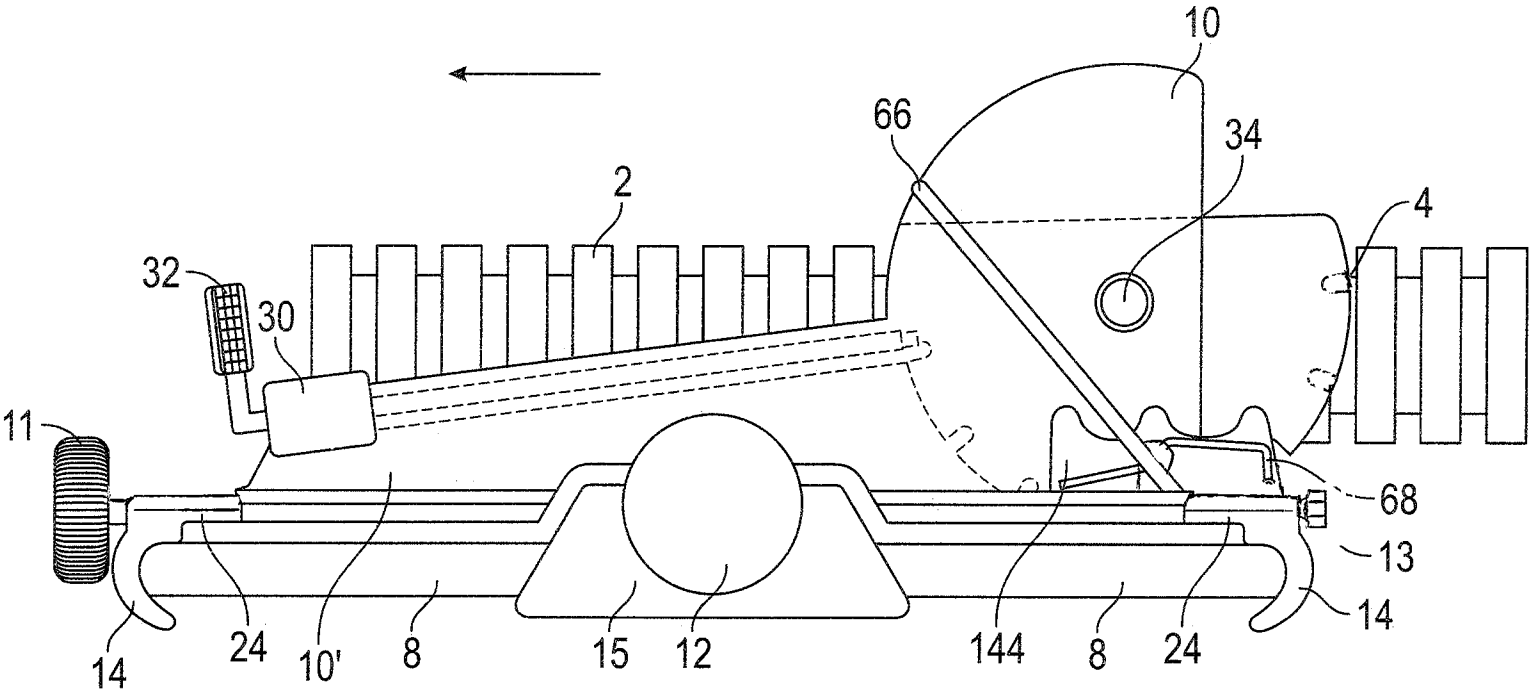
FIG. 42 is a top plan view of the apparatus of FIG. 28, along with the finger pulls, cammed track, and sliding and flipping mirror assemblies of FIG. 39.

FIG. 42 is a top plan view of the apparatus of FIG. 28, along with the finger pulls, cammed track, and sliding and flipping mirror assemblies of FIG. 39.

Figure 43:
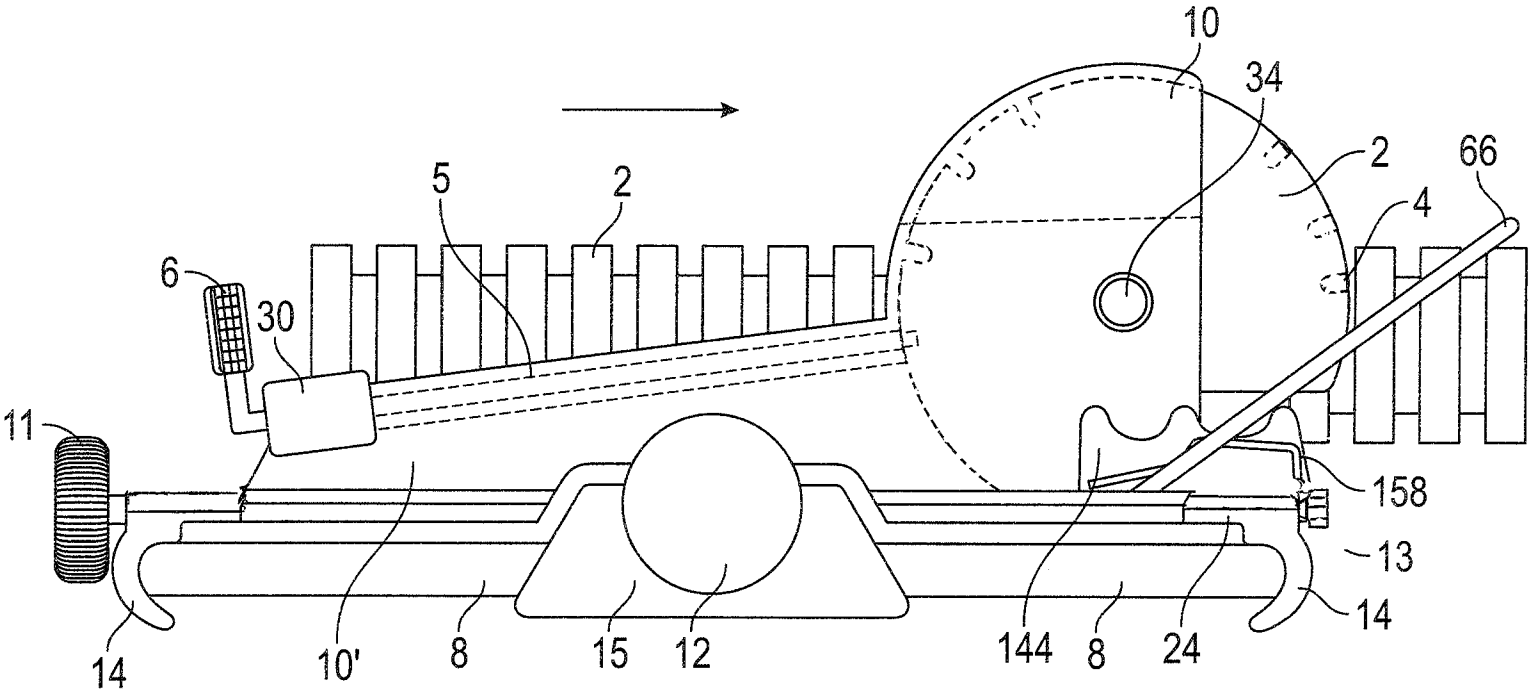
FIG. 43 is a top plan view of the apparatus of FIG. 29, along with the finger pulls, cammed track, and sliding and flipping mirror assemblies of FIG. 39.

FIG. 43 is a top plan view of the apparatus of FIG. 29, along with the finger pulls, cammed track, and sliding and flipping mirror assemblies of FIG. 39.

Figure 44:
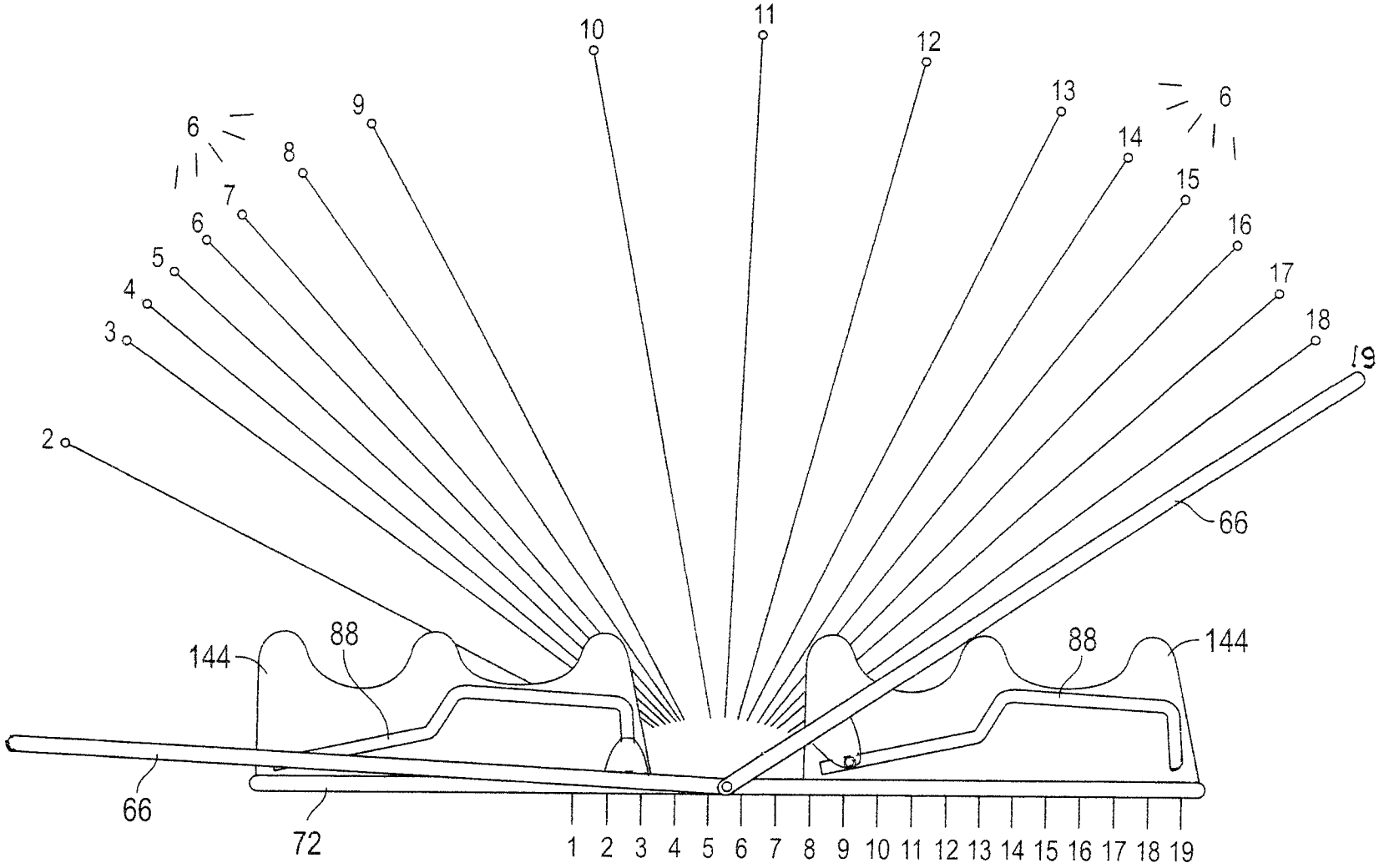
FIG. 44 is diagram depicting the finger pull movement and related angular rotation of the mirror assemblies of FIG. 39.

FIG. 44 is diagram depicting the finger pull movement and related angular rotation of the mirror assemblies of FIG. 39. This diagram is similar to that shown and described in FIG. 30, however, for the finger pull, internal track, and pivoting, rotating and sliding mirror assemblies of this alternative embodiment and engineering designs. The angular gradations for the pivoting, rotation and flipping mirror arm and pin are illustrated, along with the corresponding finger pull positions on its linear track and with its internal track in view.

Referring now to FIG. 45A through FIG. 45F, illustrations depict the movement of the finger pull and mirror in select positions, and in relationship to one another.

Figures 45A, 45B, 45C, 45D, 45E, 45F:
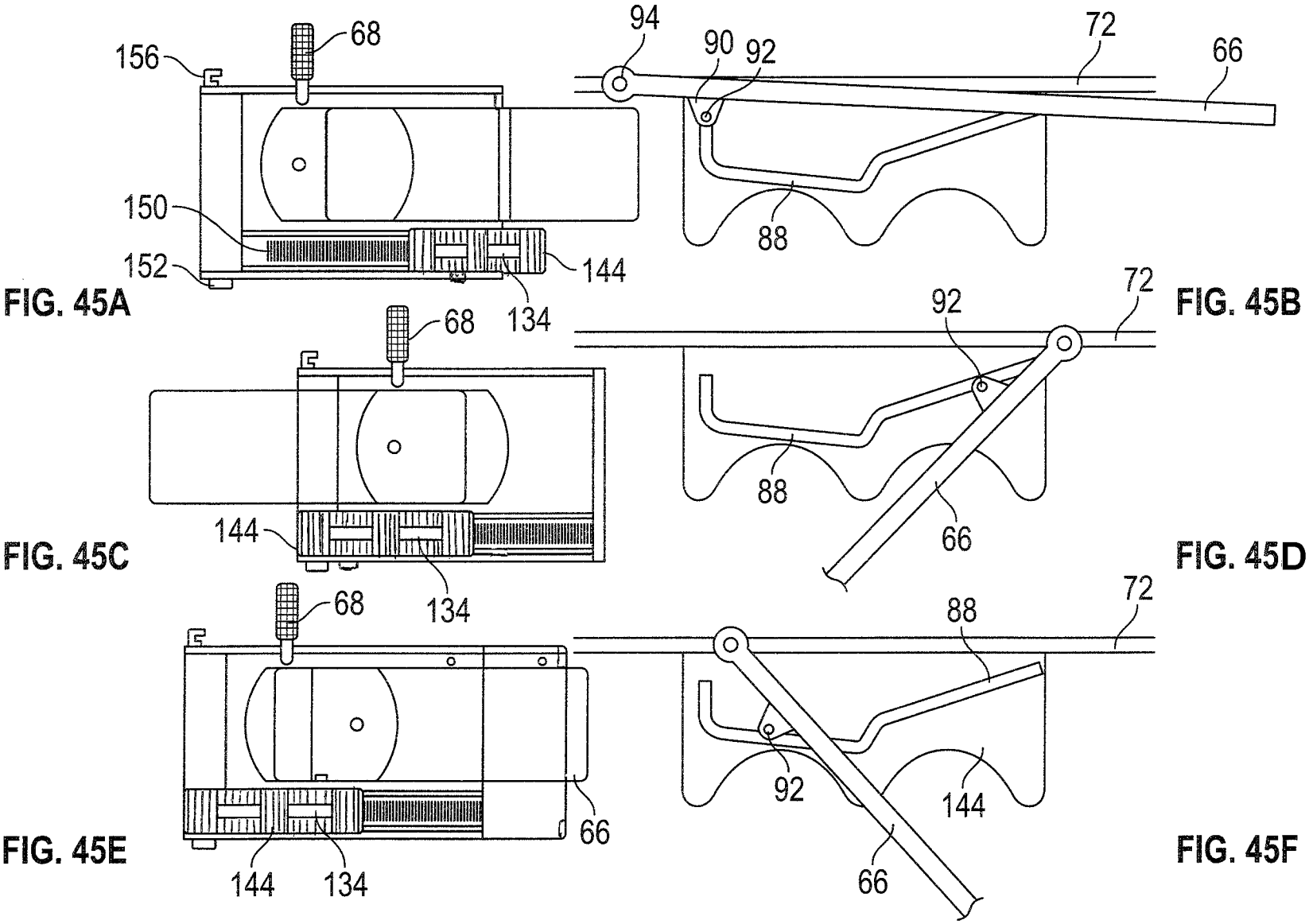
FIG. 45A is a first configuration of the finger pull and mirror assemblies of FIG. 39.
FIG. 45B is a top view of that shown in FIG. 45A.
FIG. 45C is a second configuration of the finger pull and mirror assemblies of FIG. 39.
FIG. 45D is a top view of that shown in FIG. 45C.
FIG. 45E is a third configuration of the finger pull and mirror assemblies of FIG. 39.
FIG. 45F is a top view of that shown in FIG. 45E.

FIG. 45A is a first configuration of the finger pull and mirror of FIG. 39 when the mirror is not in use, and the shooter is using the firearm in a conventional fashion.

FIG. 45B is a top view of that shown in FIG. 45A.

FIG. 45C is a second configuration of the finger pull and mirror of FIG. 39 when the mounting mechanism is rotated to the right side of the firearm and adjusted to view targets from the right side of the weapon.

FIG. 45D is a top view of that shown in FIG. 45C.

FIG. 45E is a third configuration of the finger pull and mirror assemblies of FIG. 39 when the mounting mechanism is rotated to the left side of the firearm and adjusted to view targets from the left side of the weapon.

FIG. 45F is a top view of that shown in FIG. 45E.

Figure 46A:
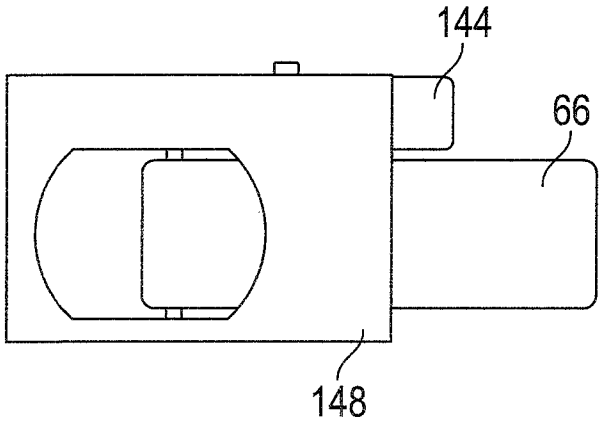
FIG. 46A is a front view of a vertically adjustable platform in FIG. 39.

FIG. 46A is a front view of the vertically adjustable platform in FIG. 39. The vertically adjustable platform is shown, and the pivoting sliding mirror assembly attaches thereto, sliding within the platform tracks.

Figure 46B:
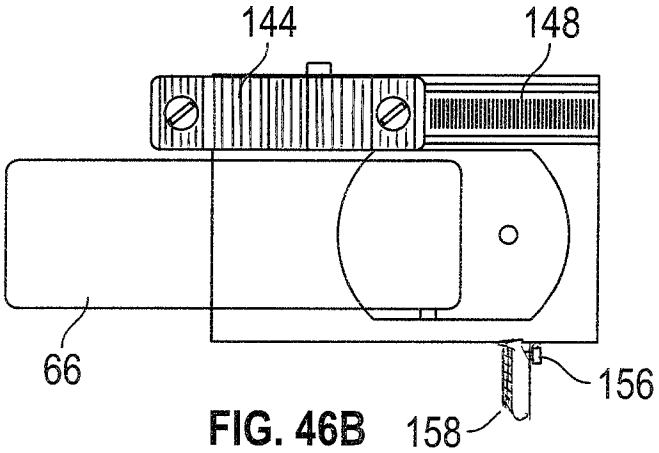
FIG. 46B is a backside view of that shown in FIG. 46A.

FIG. 46B is a backside view of that shown in FIG. 46A.

Figure 46C:
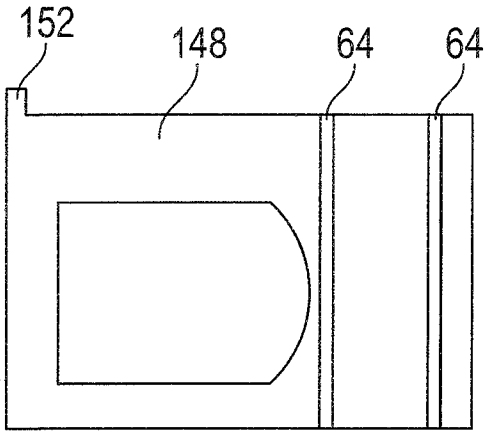
FIG. 46C is a front view of the pivoting mirror and finger pull assembly base of FIG. 39.

FIG. 46C is a front view of the pivoting mirror and finger pull assembly base of FIG. 39 that slides back and forth, and locks into the two positions illustrated in FIG. 46A.

Figure 46D:
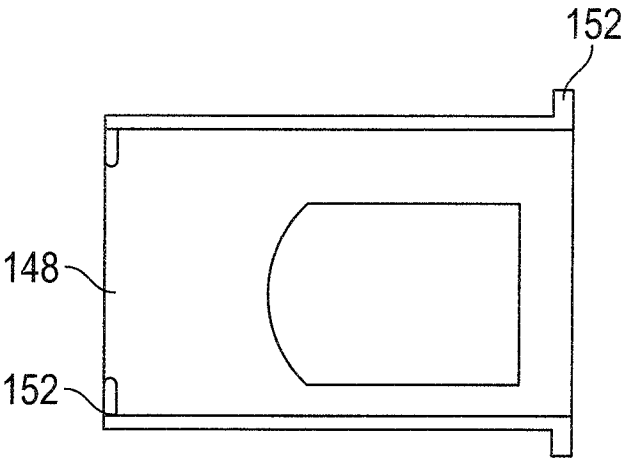
FIG. 46D is a backside view of that shown in FIG. 46C.

FIG. 46D is a backside view of that shown in FIG. 46C.

Figure 47A:
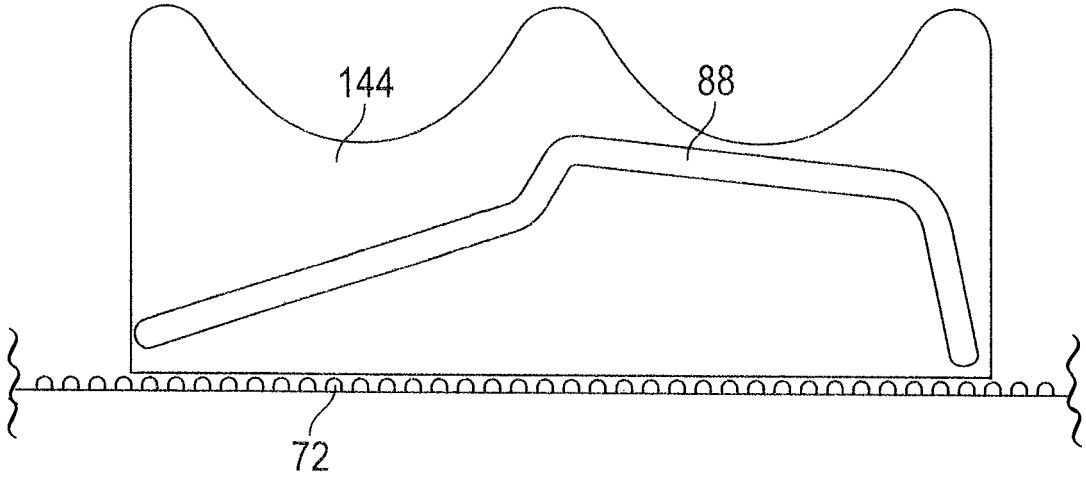
FIG. 47A is a top view of the finger pull of FIG. 39 and its internal track for the mirror arm pin.

FIG. 47A is a top view of the finger pull of FIG. 39 and its internal track for the mirror arm pin.

Figure 47B:
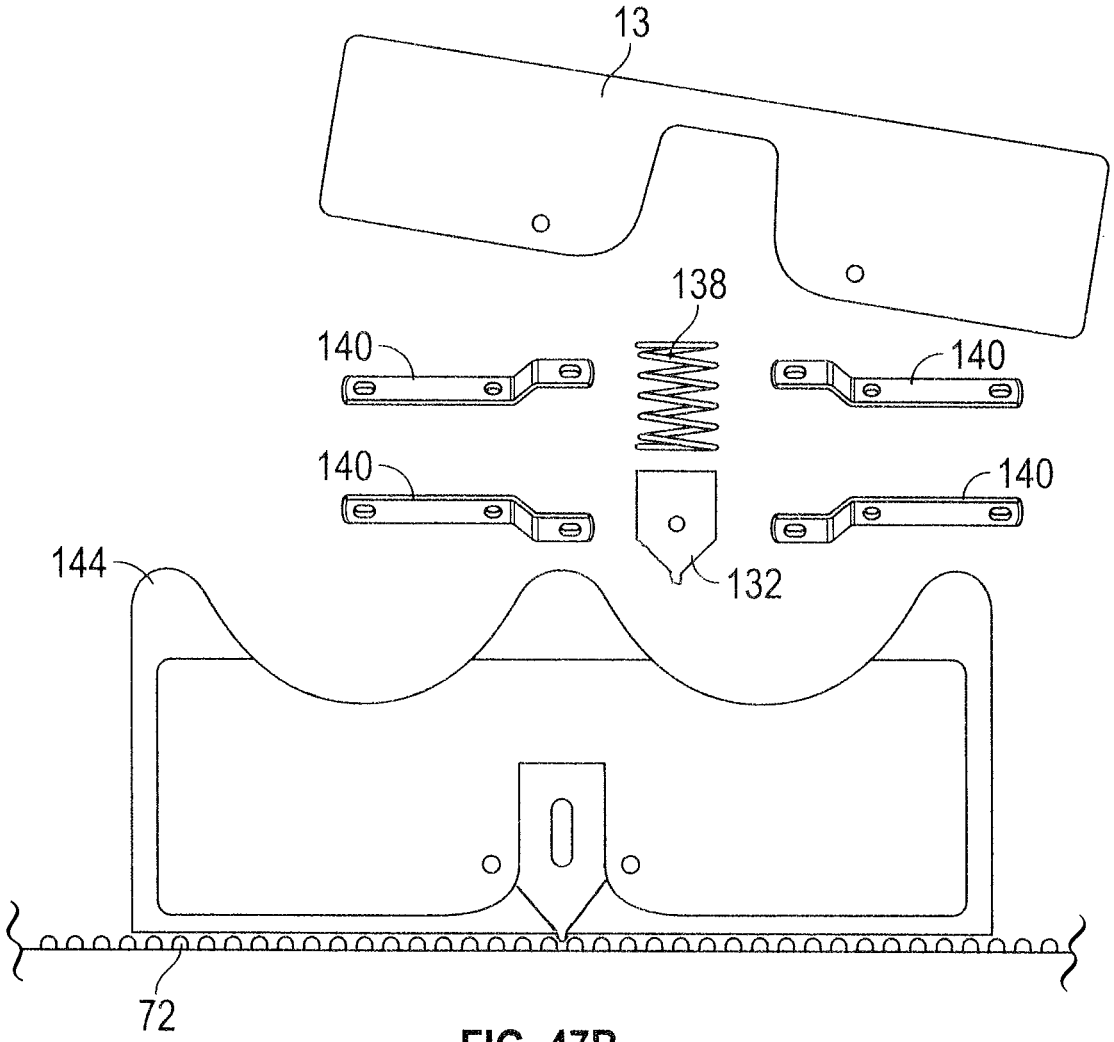
FIG. 47B is an exploded assembly of the apparatus shown in FIG. 47A.

FIG. 47B is an exploded assembly of the apparatus shown in FIG. 47A. The finger pull and its spring biased button and lever mechanisms function in the same way as the button assembly shown and described in FIGS. 38A and 38B.

Figure 48:
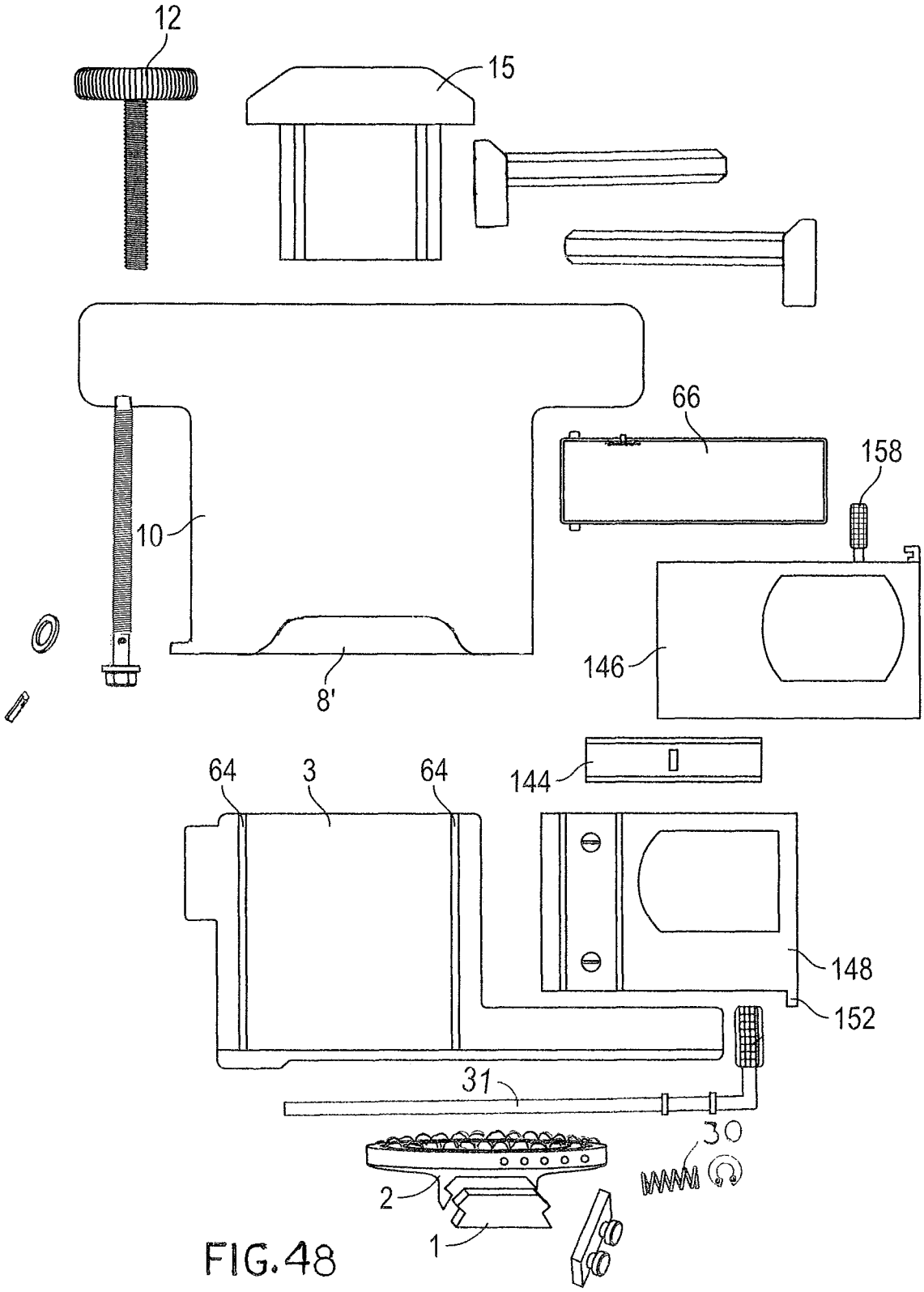
FIG. 48 is an exploded assembly view similar to FIG. 35, but with the finger pulls, cammed track, and sliding and flipping mirror assemblies of FIG. 39.

FIG. 48 is an exploded assembly view similar to FIG. 35, but with the finger pulls, cammed track, and sliding and flipping mirror assemblies of FIG. 39.

Figure 49:
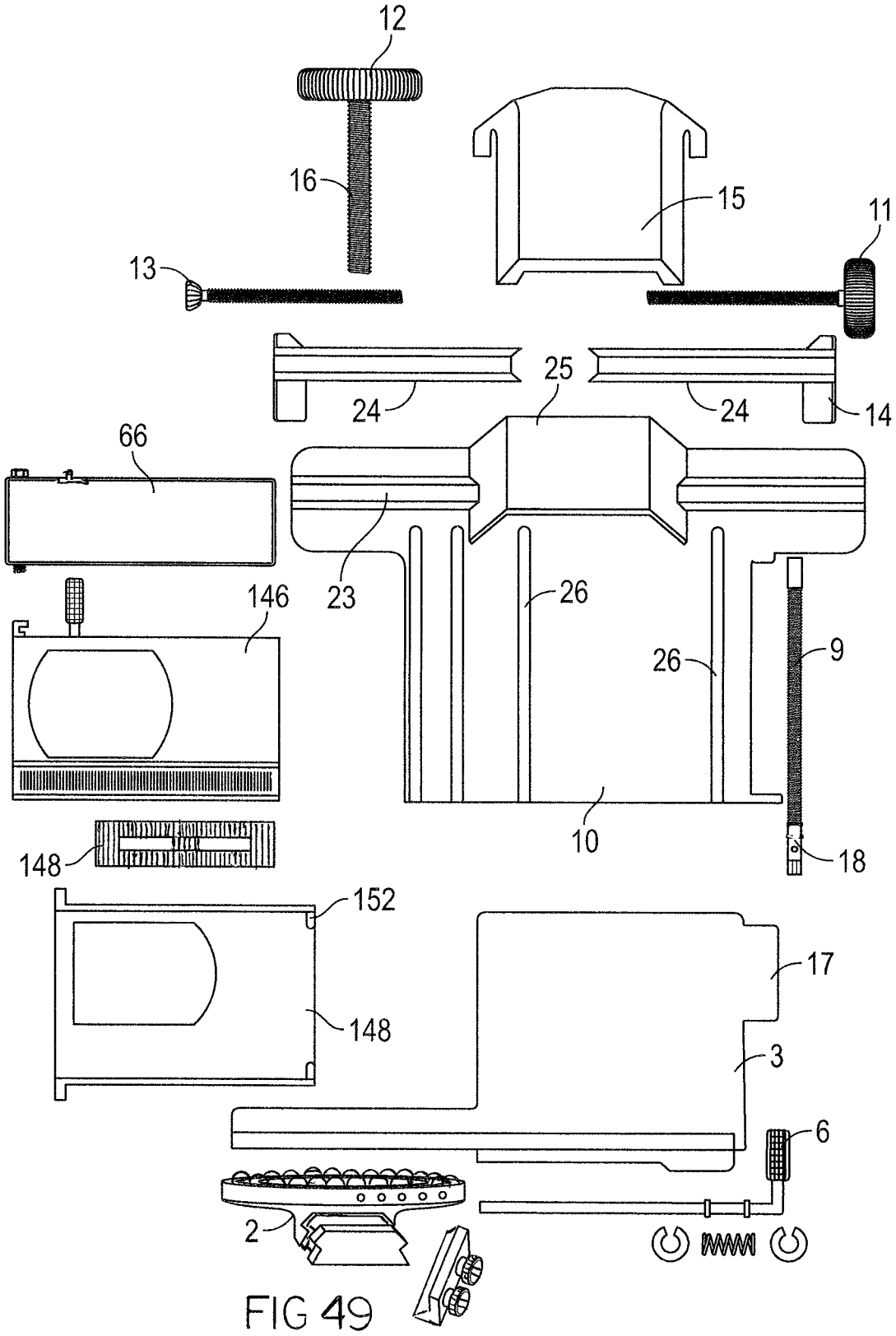
FIG. 49 is an exploded assembly view similar to FIG. 34, but with the finger pulls, cammed track, and sliding and flipping mirror assemblies of FIG. 39.

FIG. 49 is an exploded assembly view similar to FIG. 34, but with the finger pulls, cammed track, and sliding and flipping mirror assemblies of FIG. 39.

Figure 50:
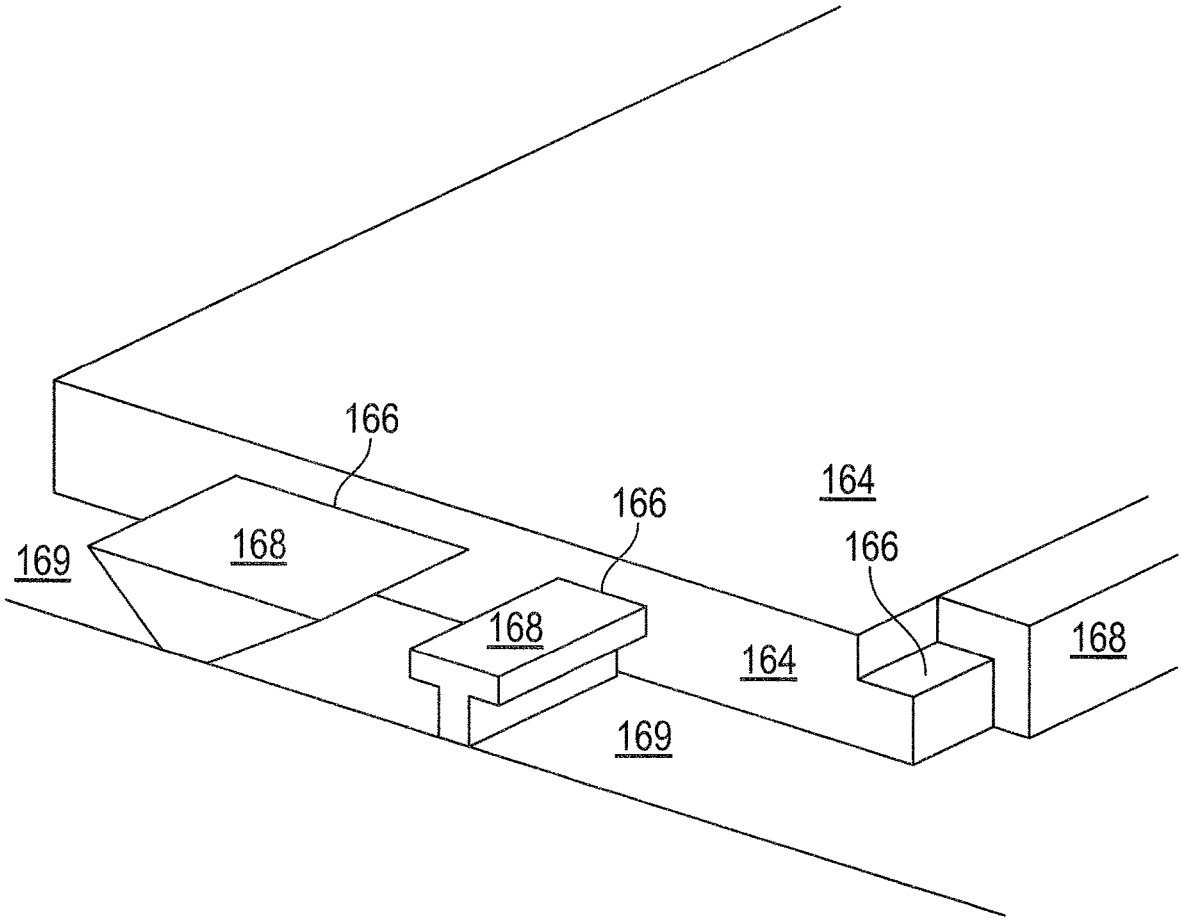
FIG. 50 is a perspective view of the track and channel mating components of the phone mount and plate member of the rotating mount assembly.

FIG. 50 is a perspective view of the track and channel mating components of the phone mount and plate member of the rotating mount assembly. Phone mount 169 includes tracks 168 which mate and interlock with plate member 164 and plate channels 166 in a tongue and groove fashion. As described above in detail in conjunctions with the FIG. 3 and those following, phone mount 169 is slidingly engaged with plate member 164 for adjustment.

Figure 51:
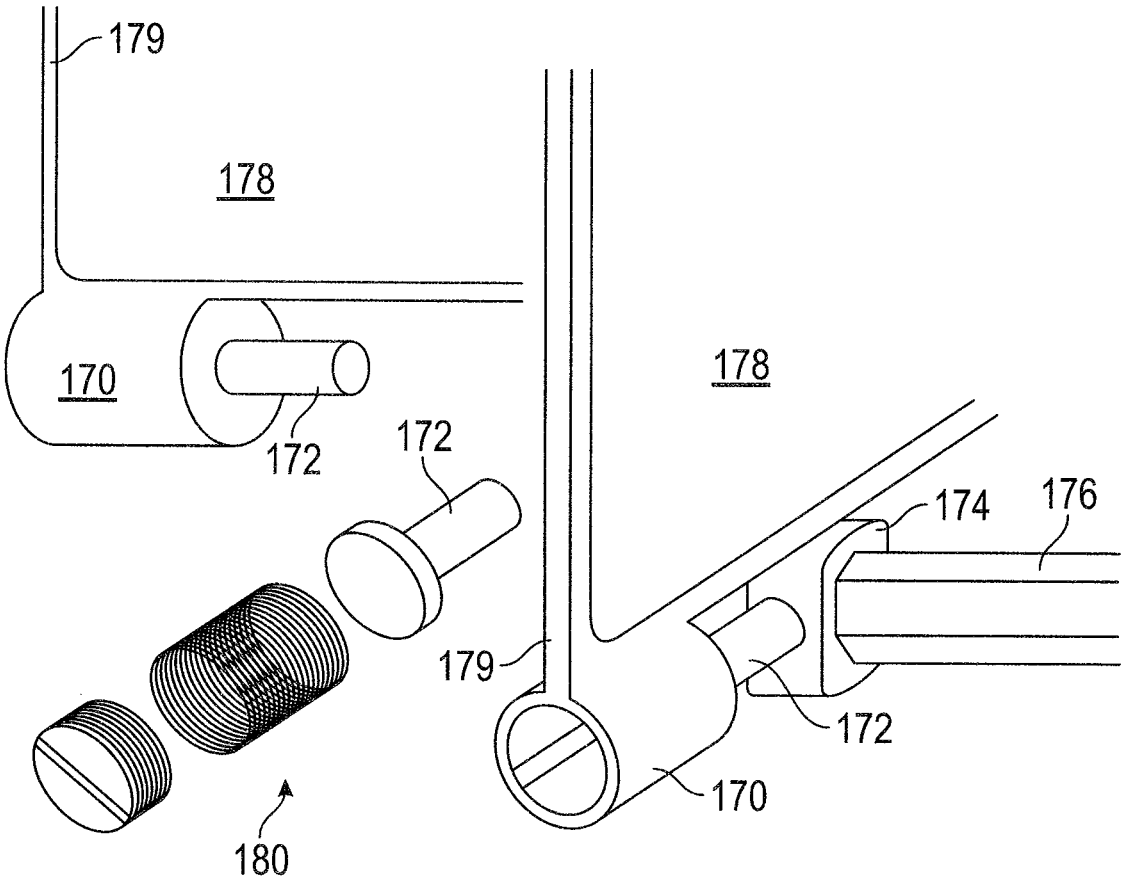
FIG. 51 is a perspective assembly view of the mirror assembly and adjustable rail arm section.

FIG. 51 is a perspective assembly view one mirror assembly and adjustable rail arm section shown and described in reference to FIG. 15 through FIG. 19. Mirror 178 includes mirror frame 179, which is secured to adjustable mirror arm 176 and stop 174 with a spring loaded rod 172 and assembly 180, which is housed within cylindrical housing 170 of the mirror frame.

Consequently, the instant invention has been shown and described herein in what is considered to be the most practical and preferred embodiments. It is recognized, however, that departures may be made therefrom within the scope of the inventions and that obvious modifications will occur to a person skilled in the art. The claims for these inventions follow below.

What is claimed is:

1. A sight adjustable and rotating smart phone mount assembly, for use with both a firearm having a rail and a sight, and a smart phone having a camera, lens and viewing screen, said mount assembly comprising:

a rail mount, said rail mount for securing said mount assembly to said firearm rail;

said mount assembly including mirrors;

said rail mount including means for receiving said mirrors;

a rotatable plate member, said plate member having a base secured to said rail mount and rotatable thereon;

said plate member having an integral vertical plate;

said vertical plate having a lens window;

means for pivoting said mirrors about said lens window; and means for receiving and securing said smart phone.

2. The apparatus of claim 1, further comprising:

said means for receiving and securing said smart phone comprises a phone mount including lateral adjustment brackets for positioning and alignment of said smart phone camera and lens with said lens window and firearm sight;

said phone mount including tensioning means for securing said smart phone; and wherein when said lens is secured for views with said firearm sight, and receives images reflected from said mirrors, one of said mirrors remaining in axial viewing alignment with said sight as said mount assembly rotates from side to side about said firearm rail, allowing a user to be in a protected position viewing images on said viewing screen from the side of the firearm and around obstacles.

3. A sight adjustable and rotating smart phone mount assembly, for use with both a firearm having a rail and a sight, and a smart phone having a camera, lens and viewing screen, said mount assembly comprising:

a rail mount, said rail mount for securing said mount assembly to said firearm rail;

said mount assembly including a mirror assembly, and means for rotating said mirror assembly;

said mirror assembly including a mirror and a lens window, and means for pivoting said mirror;

a rotatable plate member, said plate member having a base secured to said rail mount and rotatable thereon;

said plate member having an integral vertical plate;

a phone mount, said phone mount for receiving and securing said smart phone; and said phone mount secured to said vertical plate and vertically adjustable thereon.

* * * * *